US007223309B2

(12) United States Patent
Takahashi et al.

(10) Patent No.: US 7,223,309 B2
(45) Date of Patent: May 29, 2007

(54) DISPLAY MANUFACTURING APPARATUS AND DISPLAY MANUFACTURING METHOD

(75) Inventors: Tomoaki Takahashi, Matsumoto (JP); Hirofumi Sakai, Suwa (JP)

(73) Assignee: Seiko Epson Corporation (JP)

( * ) Notice: Subject to any disclaimer, the term of this patent is extended or adjusted under 35 U.S.C. 154(b) by 463 days.

(21) Appl. No.: 10/436,884

(22) Filed: May 13, 2003

(65) Prior Publication Data

US 2004/0051817 A1 Mar. 18, 2004

(30) Foreign Application Priority Data

May 17, 2002 (JP) ..... 2002-142339
May 12, 2003 (JP) ..... 2003-133227

(51) Int. Cl.
*B05C 11/00* (2006.01)
*B41J 2/125* (2006.01)
*B41J 29/38* (2006.01)
*B41J 29/393* (2006.01)

(52) U.S. Cl. ..... 118/712; 118/665; 347/10; 347/11; 347/19; 347/81

(58) Field of Classification Search ..... 118/712, 118/713, 665, 704, 679–685, 300, 313; 347/9, 347/10, 11, 17, 19, 81, 54, 68–70
See application file for complete search history.

(56) References Cited

U.S. PATENT DOCUMENTS 5,281,450 A * 1/1994 Yaniv ..... 427/510
5,340,619 A * 8/1994 Chen et al. ..... 427/498
5,824,374 A * 10/1998 Bradley et al. ..... 427/555
6,060,113 A * 5/2000 Banno et al. ..... 427/78

(Continued)

FOREIGN PATENT DOCUMENTS

JP 07-318724 12/1995

(Continued)

OTHER PUBLICATIONS

Communication from PCT corresponding International application No. PCT/JP03/06167.

*Primary Examiner*—Yewebdar Tadesse
(74) *Attorney, Agent, or Firm*—Harness, Dickey & Pierce, P.L.C.

(57) ABSTRACT

A carriage 5 is provided with an injection head 7 to discharge an amount of liquid drops according to the supplied driving pulses and a liquid material sensor 17 to detect the ink amount hit at a filter substrate at each pixel region. A main controller 31 determines a waveform of the driving pulses capable of discharging the short amount of liquid drops according to a level of a detection signal from the liquid material sensor 17 and outputs the determined information on the waveform of the driving pulses to driving signal generator 32. The driving signal generator 32 generates driving pulses according to the received information on the waveform and outputs it to the injection head 7. The injection head 7 adjusts an ink amount at the corresponding pixel region to the target amount of liquid material by injecting the short amount of liquid drops to the corresponding pixel region.

16 Claims, 31 Drawing Sheets

U.S. PATENT DOCUMENTS

| | | | | |
|---|---|---|---|---|
| 6,221,544 | B1 | 4/2001 | Hayashi et al. | |
| 6,258,405 | B1 | 7/2001 | Yamaguchi et al. | |
| 6,779,863 | B2 * | 8/2004 | Usuda | 347/14 |
| 2001/0003349 | A1 * | 6/2001 | Hosono | 239/68 |
| 2002/0018082 | A1 * | 2/2002 | Hosono et al. | 347/1 |
| 2004/0070651 | A1 * | 4/2004 | Usui et al. | 347/84 |

FOREIGN PATENT DOCUMENTS

| | | |
|---|---|---|
| JP | 08-082706 | 3/1996 |
| JP | 08-292311 | 11/1996 |
| JP | 08-320482 | 12/1996 |
| JP | 11-248927 | 9/1999 |

* cited by examiner

DISPLAY MANUFACTURING APPARATUS AND DISPLAY MANUFACTURING METHOD

BACKGROUND OF THE INVENTION

1. Technical Field

The present invention relates to a display manufacturing apparatus and a display manufacturing method for manufacturing a variety of displays such as a color filter for a liquid crystal display device, an electroluminescent display device and the like by discharging liquid material.

2. Background Art

In order to manufacture a color filter for a liquid crystal display device, an electroluminescent display device or a plasma display device, there has been appropriately used an injection head (for example, an ink jet head) by which a liquid state material (liquid material) can be discharged in a liquid state. In a display manufacturing apparatus using an injection head, for example, a color filter is manufactured by injecting liquid material discharged out of nozzle openings to a plurality of pixel regions provided on the surface of a substrate. However, a variation in the characteristics at every nozzle opening may results in defects such as color nonuniformity or decoloring at the pixel regions. Also, when the defects occur, liquid material is discharged to the defective pixel regions for restoration. For example, Japanese Unexamined Patent Application Publication No. 7-318724 suggests a technique to restore the defects by discharging a certain color of ink drops to the non-uniformly colored or decolored portions of a color filter.

On the other hand, in case of the manufacturing apparatus disclosed in the above publication, an injection head having a heat-generating element has been used. The injection head of this type discharges ink drops by causing the heat-generating element to generate heat and boiling the ink in a pressure chamber. In other words, a liquid state ink is pressurized by boiling bubbles and discharged out of the nozzle openings. Therefore, the amount of discharged ink is determined mainly by the volume of the pressure chamber and the area of the heat-generating element. Also, since it is difficult to control the volume of the boiling bubbles with high precision, it is also difficult to control the amount of discharged liquid with high accuracy by adjusting the quantity of supply power.

Therefore, in order to make a restoration of the non-uniformly colored or decolored portions by filling up an extremely small amount of liquid material, it is necessary to include exclusive nozzles or heads used only for restoration, as disclosed in Japanese Unexamined Patent Application Publication No. 8-82706 or Japanese Unexamined Patent Application Publication No. 8-292311, for example.

However, when the exclusive nozzle or head is separately provided, the structure of the apparatus gets so complex as to result in an increase in the number of parts. Further, it may bring about additional problems in common use.

SUMMARY

In order to accomplish the object of the present invention, there is provided the following. In a display manufacturing apparatus including: pressure chambers communicating with nozzle openings and capable of reserving liquid material; electromechanical conversion elements capable of changing the volume of the pressure chambers; an injection head capable of discharging the liquid material out of the nozzle openings in its liquid drop state accompanied by the supply of driving pulses to electromechanical conversion elements; and driving pulse generating means capable of generating the driving pulses; and constructed to apply liquid material discharged out of nozzle openings to liquid material regions on the surface of a display substrate, the improvement comprising:

liquid material amount detecting means capable of detecting the amount of liquid material applied at each liquid material region;

short amount acquiring means for acquiring the short amount of liquid material at the corresponding liquid material region based on a difference between the amount of applied liquid material detected by the liquid material detecting means and the target amount of liquid material; and pulse shape setting means for setting a shape of the driving pulses to be generated by the driving pulse generating means;

wherein the pulse shape setting means sets a waveform of the driving pulses according to the short amount of liquid material acquired by the short amount acquiring means; and wherein the short amount of liquid material is supplemented to the corresponding liquid material region by generating the driving pulses from the driving pulse generating means and supplying them to the electromechanical conversion elements.

It should be appreciated that the word 'display' as used herein has a mean which is more broad than its normal meaning and includes a color filter used for a display device as well as the display device itself. Furthermore, 'liquid material' includes not only solvent (or dispersion medium), but also dyes, pigments or other materials. Liquid material also includes other sorts of liquid material blended with solid material if it can be discharged out of nozzle openings. Also, 'liquid material region' means hitting regions (application regions) of liquid material discharged as liquid drops.

According to the above configuration, the amount of applied liquid material is detected at each liquid material region by the liquid material amount detecting means, and the excess or short amount of liquid material is acquired by a difference between the detected amount of applied liquid material and the target amount of liquid material at the liquid material region. If the amount of applied liquid material is less than the target amount of liquid material, a waveform of the driving pulse is set up according to the short amount of liquid material to thereby generate a driving pulse by the driving pulse generating means and moreover supplement as much liquid material as needed. Therefore, the amount of liquid material corresponding to the target amount of liquid material and the amount of liquid material corresponding to the additional amount of liquid material to be supplemented can be discharged by using one injection head. As a result, it is possible to manufacture a display device set up with the amount of applied liquid material at each liquid material region.

Since there is no need to include an exclusive injection head or nozzles, the configuration of the apparatus can be simplified. Further, there is no need to change an injection head or nozzles to be controlled suitably to the usage, so that it becomes possible to simplify the configuration of the apparatus.

In the above configuration, preferably, the liquid amount detecting means is constructed with a light-emitting element to be a light source and a light-receiving element capable of outputting electrical signals according to the intensity of the received light;

wherein the liquid material region is irradiated with the light from the light-emitting element, and the light from the liquid material region is received at the light-receiving element so as to detect the amount of liquid material applied at the liquid material region according to the intensity of the received light.

'Light emitted from the liquid material regions' includes both light that is reflected at the liquid material regions and light that is transmitted through the liquid material regions.

Further, in the aforementioned configuration of the apparatus, preferably, the driving pulses are first driving pulses including: an expansion component to expand a normal volume of the pressure chambers at a speed that will not allow for the discharge of liquid material; an expansion hold component to hold the expanded pressure chambers; and a discharge component to discharge the liquid material by abruptly contracting the pressure chambers held at their expanded state; and wherein the pulse shape setting means sets a driving voltage from its maximum voltage to its minimum voltage in the first driving pulses.

Further, in the above configuration, preferably, the driving pulses are first driving pulses including: an expansion component to expand a normal volume of the pressure chambers at a speed that will not allow for the discharge of liquid material; an expansion hold component to hold the expanded pressure chambers; and a discharge component to discharge the liquid material by abruptly contracting the pressure chambers held at their expanded states; and wherein the pulse shape setting means sets an intermediate potential corresponding to the normal volume of the pressure chambers.

Further, in the above configuration, preferably, the driving pulses are first driving pulses including: an expansion component to expand a normal volume of the pressure chambers at a speed that will not allow for the discharge of liquid material; an expansion component to hold the expanded pressure chambers; and a discharge component to discharge the liquid material by abruptly contracting the pressure chambers held at their expanded state; and wherein the pulse shape setting means sets the duration of the expansion component.

Further, in the above configuration, preferably, the driving pulses are first driving pulses including: an expansion component to expand a normal volume of the pressure chambers at a speed that will not allow for the discharge of liquid material; an expansion hold component to hold the expanded pressure chambers; and a discharge component to discharge the liquid material by abruptly contracting the pressure chambers held at their expanded state; and wherein the pulse shape setting means sets the duration of the expansion hold component.

Further, in the above configuration, preferably, the driving pulses are second driving pulses including: a second expansion component to abruptly expand a normal volume of the pressure chambers so as to greatly draw in meniscus to the side of the pressure chambers; and a second discharge component to discharge the central part of the meniscus drawn in by the second expansion component in a liquid drop state by contracting the pressure chambers; and wherein the pulse shape setting means sets a driving voltage from its maximum voltage to its minimum voltage in the second driving pulses.

Further, in the above configuration, preferably, the driving pulses are second driving pulses including: a second expansion component to abruptly expand a normal volume of the pressure chambers so as to greatly draw in meniscus to the side of the pressure chambers; and a second discharge component to discharge the central part of the meniscus drawn in by the second expansion component in a liquid drop state by contracting the pressure chambers; and wherein the pulse shape setting means sets an intermediate potential corresponding to the normal volume of the pressure chambers.

Further, in the above configuration, preferably, the driving pulses are second driving pulses including: a second expansion component to abruptly expand a normal volume of the pressure chamber so as to greatly draw in meniscus to the side of the pressure chambers; and a second discharge component to discharge the central part of the meniscus drawn in by the second expansion component in a liquid drop state by contracting the pressure chambers; and wherein the pulse shape setting means sets a termination potential of the second discharge component.

Further, in the above configuration, preferably, a configuration can be employed that the driving pulse generating means is constructed to be capable of generating a plurality of driving pulses within a unit period, thereby making it possible to adjust the discharge amount of liquid material by varying the supply number of driving pulses to the pressure generating element at the unit period.

According to each of the aforementioned configurations, the amount of liquid material to be supplemented can be controlled with extremely high precision, so as to make it possible to set up a variety of levels of liquid material to be applied at each liquid material region. Further, the flying speed of liquid material to be discharged can be also controlled, so that the position of liquid material to be applied can be accurately controlled even if the liquid material is discharged with the injection head being scanned. Furthermore, various levels of flying speed can be arranged depending on the different amounts of discharged liquid material. It is possible to correspondingly cope with an extremely small amount of liquid material, which is affected considerably by the viscosity resistance of air.

Further, in the above configuration, liquid state material including light emitting material, liquid state material including hole injection/transport layer forming material, or liquid state material including conductive fine particles can be used as the above liquid material.

Further, in the above configuration, liquid state material including coloring components can be used as the above liquid material. Furthermore, in this configuration, preferably, the display manufacturing apparatus further comprises: excess amount acquiring means for acquiring the excess amount of liquid material based on a difference between the amount of applied liquid material detected by the liquid material amount detecting means and the target amount of liquid material at the corresponding liquid material region; and coloring component decomposing means for decomposing the coloring component of liquid material, and wherein the coloring component decomposing means is operated according to the excess amount of liquid material to thereby decompose the excess amount of coloring component. Moreover, in this configuration, preferably, the coloring component decomposing means can be configured by an excimer laser light source that can generate excimer laser light.

Furthermore, in each of the above configurations, the electromechanical conversion elements are piezoelectric vibrators.

BRIEF DESCRIPTION OF THE DRAWINGS

FIG. 1(*a*) is a plan view illustrating a manufacturing apparatus; and FIG. 1(*b*) is a partially enlarged view illustrating a color filter.

FIG. 9(*a*) illustrates a variation in the flying speed of liquid drops when a change is made in driving voltage; and FIG. 9 (*b*) illustrates a variation in the weight of liquid drops when a change is made in driving voltage.

FIG. 12(*a*) is a variation in the flying speed of liquid drops when a change is made in the duration; and FIG. 12(*b*) is a variation in the weight of liquid drops when a change is made in the duration.

FIG. 16(*a*) illustrates a variation in the flying speed of liquid drops when a change is made in driving voltage; and FIG. 16(*b*) is a variation in the weight of liquid drops when a change is made in driving voltage.

DETAILED DESCRIPTION

Hereinafter, embodiments of the present invention will be described with reference to the accompanying drawings.

Figure 1A:
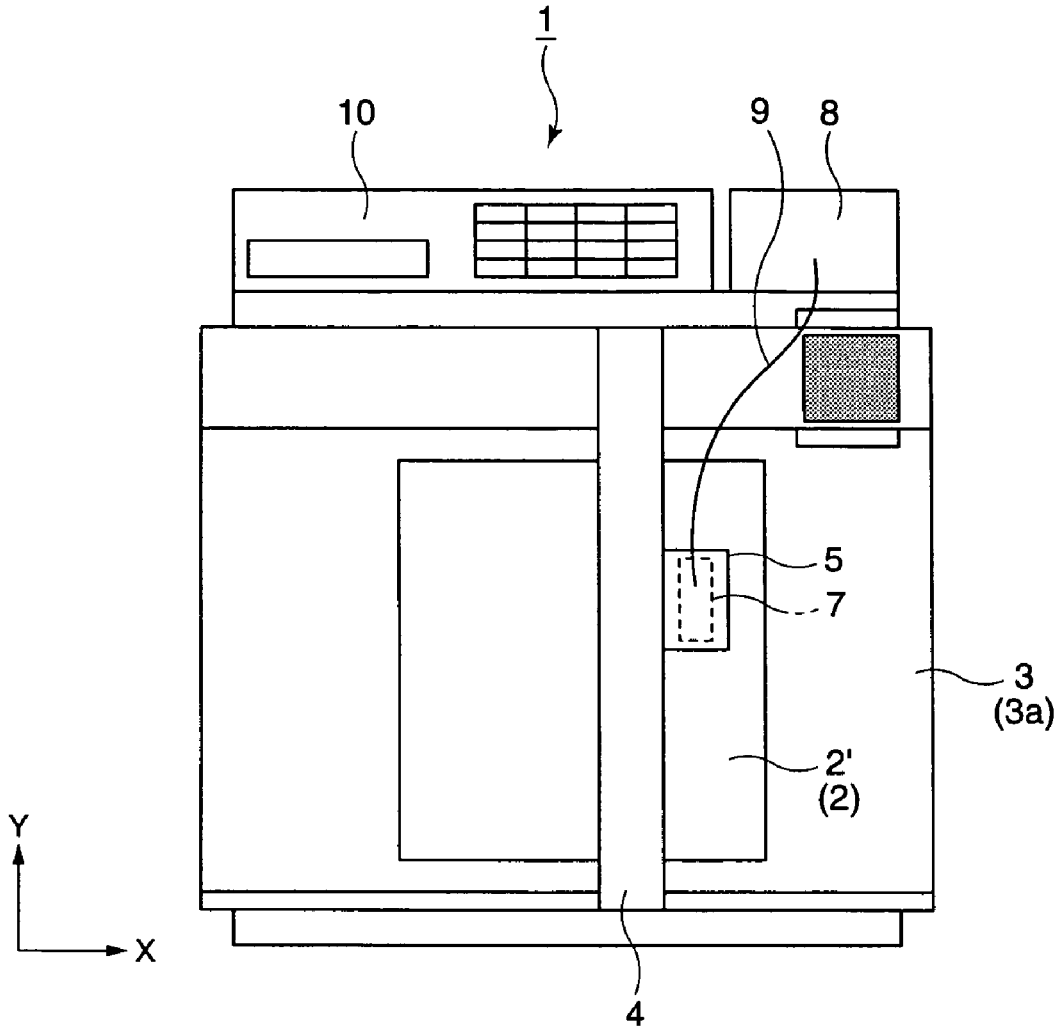
FIG. 1 illustrates an example of a display manufacturing apparatus.
Figure 1B:
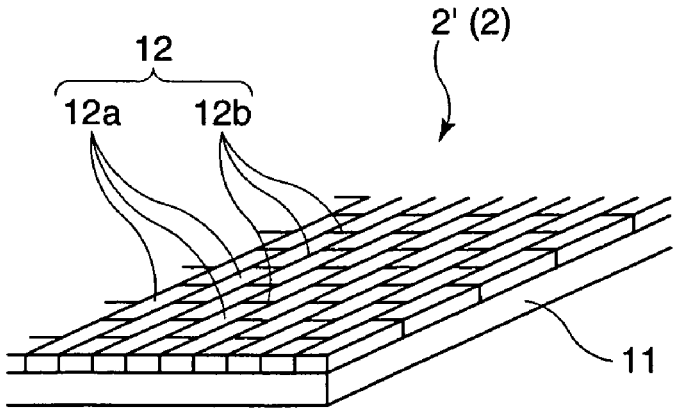
Figure 2:
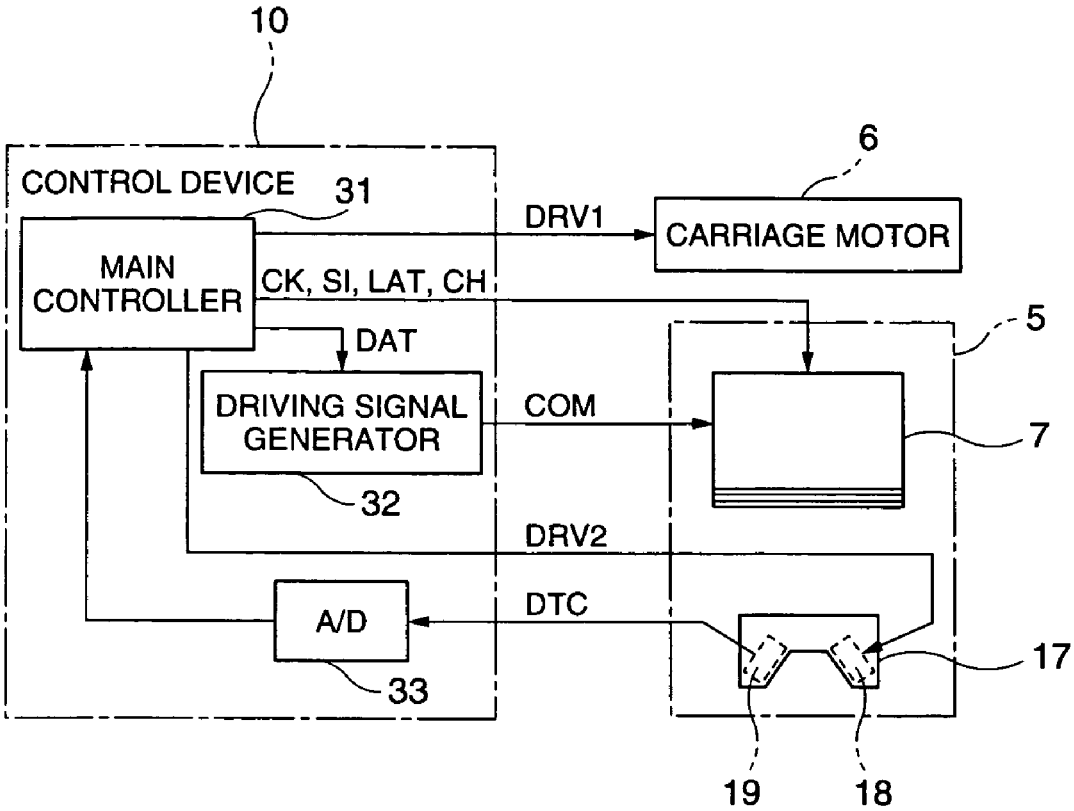
FIG. 2 is a block diagram illustrating a key structure of a display manufacturing apparatus.

Referring to FIGS. 1 and 2, first, a description will be made of a basic configuration of a display manufacturing apparatus 1 (hereinafter, referred to as manufacturing apparatus 1).

The manufacturing apparatus 1 shown in FIG. 1(*a*) comprises: a rectangular placing base 3 having a placing surface, on which a substrate for a color filter 2 (equivalent to a type of a display in the present invention), i.e., a filter substrate 2' (equivalent to a type of a display substrate in the present invention) can be placed; a guide bar 4 that can be moved along one side (main scanning direction) of the placing base 3; a carriage 5 that is attached to the guide bar 4, and can be moved along the longitudinal direction (sub-scanning direction) of the guide bar 4; a carriage motor 6 (refer to FIG. 2) as a driving source when the guide bar 4 and carriage 5 are moved; a liquid material reservoir 8 that can reserve liquid material to be supplied to an injection head 7; a supply tube 9 connected between the liquid material reservoir 9 and the injection head 7 to form a flow passage of liquid material; and a control device 10 for electrically controlling the operation of the injection head 7, etc. In the present embodiment, ink liquid as a type of liquid material (liquid state material including coloring components such as dyes or pigments) is reserved in the liquid material reservoir 8.

As shown in FIG. 1(*b*), the filter substrate 2', for example, is substantially configured with a substrate 11 and a colored layer 12 laminated on the surface of the substrate 11. Although a glass substrate is utilized as the substrate 11 in the present embodiment, it is possible to use any substrate other than the glass substrate with a satisfactory level of transparency and mechanical strength. The colored layer 12 is formed from photosensitive resin with a plurality of pixel regions 12*a* (also called filter elements, a type of liquid material regions of the present invention), which are colored in any one of colors including red (R), green (G) and blue (B). In the present embodiment, the pixel regions 12*a* are made into a rectangular shape as seen from in a plan view. The respective pixel regions 12*a* are provided in a zigzag-shaped lattice.

Also, the injection head 7 can selectively discharge liquid materials, i.e., each color of ink liquid, as liquid drops (ink drops), to desired pixel regions 12*a*. Moreover, in the present embodiment, before the liquid drops are discharged to each pixel region 12*a*, partition walls 12*b* for partitioning adjacent pixel regions 12*a*, 12*a* are formed on the substrate 11. Furthermore, a partition wall 12*b* is configured with a black matrix 72 and a bank 73 (refer to FIG. 20).

Figure 19:
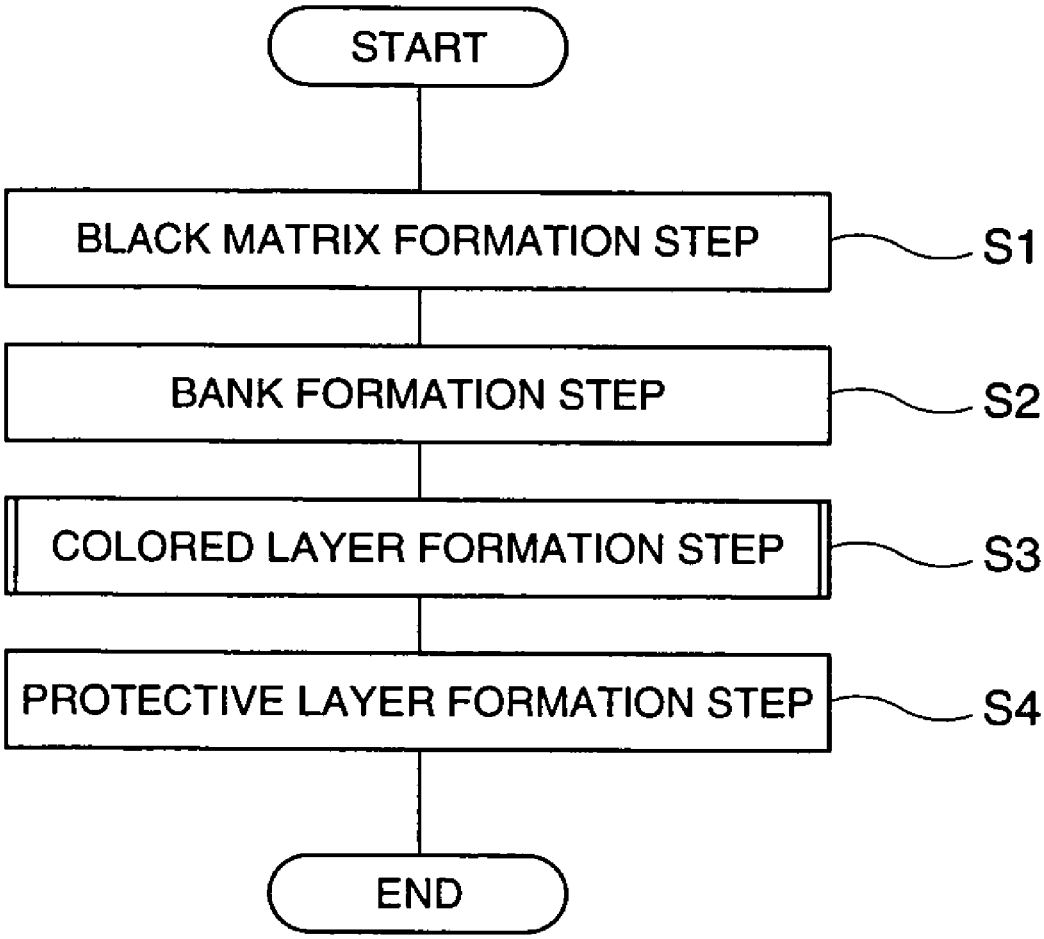
FIG. 19 is a flowchart illustrating a color filter manufacturing process.

Moreover, a manufacturing process of a color filter 2 will be described below with reference to FIGS. 19 and 20.

The placing base 3 is a substantially rectangular, plate-shaped member having its placing surface 3*a* configured by a light-reflecting surface. The size of the placing base 3 is defined on the basis of that of the filter substrate 2' and set to be slightly bigger than at least that of the filter substrate 2'. Further, the guide bar 4 is a flat rod-like member and which is installed parallel to a short-side direction (corresponding to the Y-axis or sub-scanning direction) of the placing base 3 and attached to be capable of being moved to a long-side direction (corresponding to the X-axis or main scanning direction) of the placing base 3.

As shown in FIG. 2, the carriage 5 is a block-shaped member mounted with the injection head 7 and a liquid material sensor 17.

Figure 3:
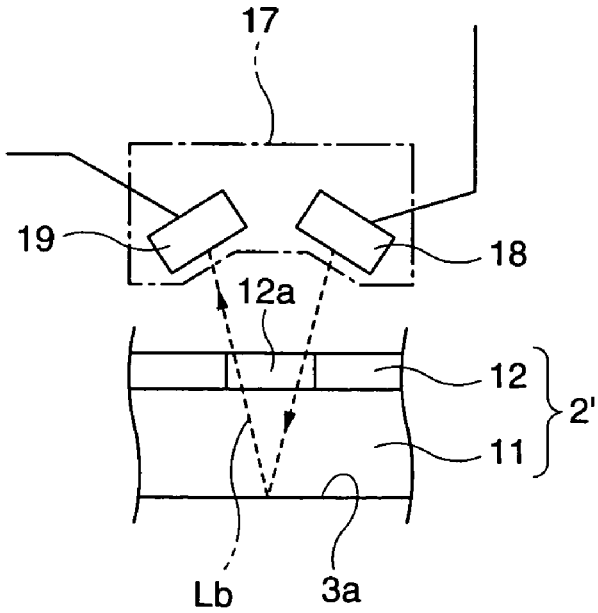
FIG. 3 is a mimetic diagram illustrating a liquid material sensor.

The liquid material sensor 17 is a type of liquid material amount detecting means of the present invention, comprising a light-emitting element as a light source and a light-receiving element capable of outputting electrical signals of voltage according to the intensity of the received light. In the present embodiment, a laser light emitting element 18 is used as the light-emitting element, and a laser-light receiving element 19 is used as the light-receiving element. As shown in FIG. 3, the laser light Lb from the laser-light emitting element 18 is irradiated to the pixel region 12*a*, and the reflecting laser light Lb from the pixel region 12*a* is received by the laser-light receiving element 19. In the liquid material sensor 17, the laser-light receiving element 19 outputs voltage signals depending on the light receiving quantity (the strength of the receiving light). The light receiving quantity is varied according to the amount of liquid material (the amount of ink in the present embodiment) shot at the pixel region 12*a*. In other words, as the amount of liquid material shot at the pixel region 12*a* increases, the quantity of light to be received decreases. As the amount of liquid material shot at the pixel region 12*a* decreases, the quantity of light to be received increases. As a result, the amount of liquid material shot at the pixel region 12*a* can be acquired by detecting the voltage signals outputted from the liquid material sensor 17.

Figure 4:
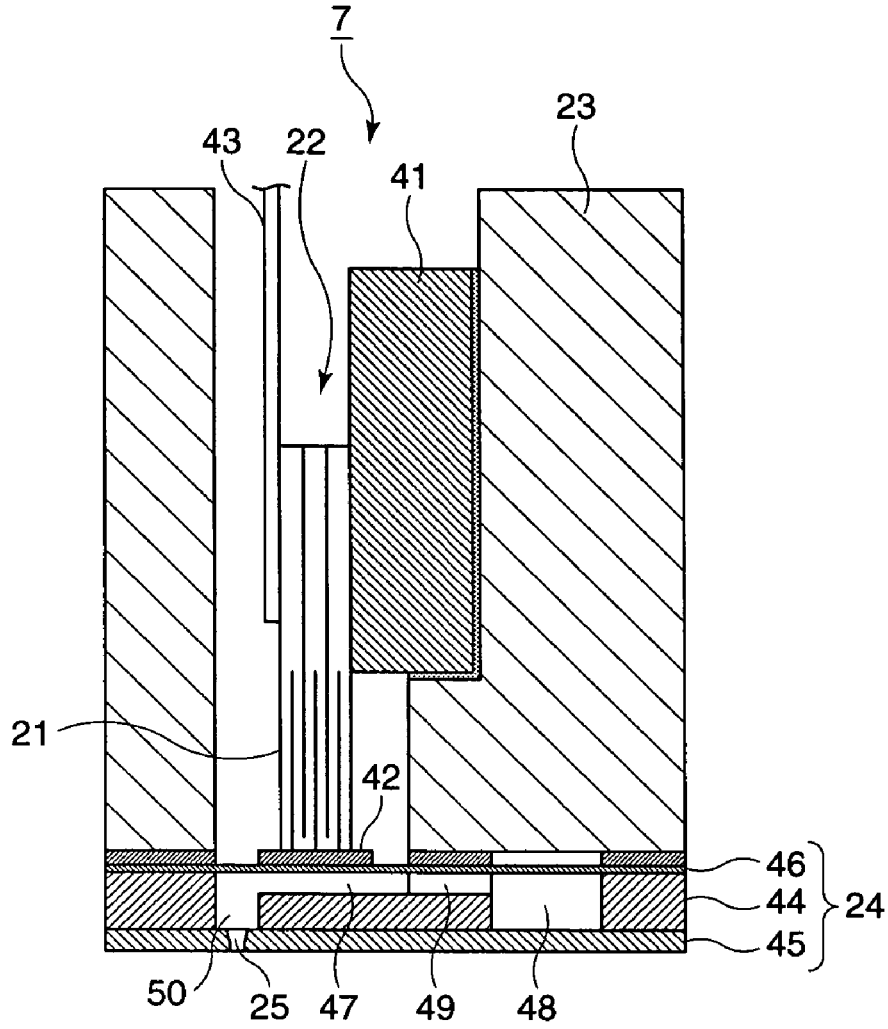
FIG. 4 is a cross-sectional view illustrating an injection head.

For example, as shown in FIG. 4, the injection head 7 comprises a vibrator unit 22 having a plurality of piezoelectric vibrators 21, a case 23 capable of accommodating the vibrator unit 22 and a flow passage unit 24 joined to the end face of the case 23. The injection head 7 is attached with nozzle openings 25 of the flow passage unit 24 being directed downward (toward the placing base 3) and can discharge liquid material out of the nozzle openings 25 in a liquid drop state. Three colors of ink liquid consisting of R, G and B can be individually discharged in the present embodiment. Furthermore, the injection head 7 will be further described in detail below.

The liquid material reservoir 8 separately reserves the liquid material to be supplied to the injection head 7. In the present embodiment, as described above, three colors of ink liquid consisting of (for example) R, G and B are reserved separately. Further, the supply tube 9 is provided with a plurality of lines according to the type of ink liquid to be supplied to the injection head 7.

The control device 10 comprises a main controller 31 including CPU, ROM, RAM and the like (none are shown here), driving signals generator 32 to generate driving signals to be supplied to the injection head 7 and an analog digital converter 33 (hereinafter referred to as an A/D converter 33) to convert the output voltage from the laser-light receiving element 19 into digital data. The signals of the A/D converter 33 are inputted to the driving signal generator 32.

The main controller 31 functions as main control means to perform a control in the manufacturing apparatus 1, for example, generating discharge data (SI) related to the discharge control of liquid drops or movement control information (DRV1) to control the carriage motor 6. Further, the main controller 31 generates control signals (CK, LAT, CH) of the injection head 7 or waveform information (DAT) outputted to the driving signal generator 32. Accordingly, the main controller 31 also functions as pulse shape setting means in the present invention. Moreover, the main controller 31 also functions as short amount acquiring means or excess amount acquiring means in the present invention, as will be described below.

The discharge data relates to the possibility of discharging liquid drops and the amount of liquid drops to be discharged when the liquid drops are discharged. In the present embodiment, the discharge data consists of 2 bit data. A discharge state per one discharge cycle is divided into 4 steps to thereby represent the discharge data. For example, the 4 steps of discharged amount are represented, such as 'hon-discharge' with no liquid drop discharged, 'discharge 1' with a small amount of liquid drops discharged, 'discharge 2' with a medium amount of liquid drops discharged, and 'discharge 3' with a large amount of liquid drops discharged. Also, 'non-discharge' is represented by discharge data '00' and 'discharge 1' is represented by discharge data '01'. Further, 'discharge 2' is represented by discharge data '10' and 'discharge 3' is represented by discharge data '11'.

The control signals of the injection head 7 include a clock signal (CK) as a movement clock, a latch signal (LAT) for defining a latching timing of discharge data a channel signal (CH) for defining a supply start time of respective driving pulses in a driving signal. Accordingly, the main controller 31 outputs the clock signal, latch signal, and channel signal (CK, LAT, CH) properly to the injection head 7.

The waveform information (DAT) defines a waveform of a driving signal generated by the driving signal generator 32. In the present embodiment, the waveform information consists of data that shows an increase or decrease in voltage per unit time of renewal. Furthermore, the main controller 31 sets a waveform of a driving pulse according to the voltage information (that is, the amount of applied liquid material detected by the liquid material amount detecting means) generated by the A/D converter 33 (which will be described later).

The driving signal generator 32 is a type of the driving pulse generating means in the present invention. In other words, on the basis of the waveform information from the main controller 31, driving signals and a waveform of the driving pulses included in the driving signal are set, and the resultant waveform of driving pulses is generated. At this time, the driving signal generated by the driving signal generator 32 is a signal shown in FIG. 7, for example. A plurality of driving pulses (PS1 to PS3) for discharging a predetermined amount of liquid drops out of the nozzle openings 25 of the injection head 7 are included in a discharge cycle T. Also, the driving signal generator 32 generates the driving signal repeatedly at every discharge cycle T. The driving signal will be further described in detail below.

Next, the injection head 7 will be described in detail. First, a mechanical configuration of the injection head 7 will be described.

The piezoelectric vibrators 21 are electromechanical conversion elements of the present invention, i.e., a type of elements that can convert electrical energy into kinetic energy, varying the volume of the pressure chamber 47. The piezoelectric vibrators 21 are separated into thin comb-teeth shape having an extremely small width of 30 μm to 100 μm. The piezoelectric vibrators 21 presented as an example are deposition type piezoelectric vibrators constructed by alternately depositing piezoelectric substrates and internal electrodes, i.e., vertical vibration mode of piezoelectric vibrators 21 that can be expanded/contracted in the longitudinal direction of the element perpendicular to the main electric field direction. Furthermore, each of piezoelectric vibrators 21 is at its proximal end joined to a fixing plate 41 and at its free end attached in a cantilever configuration protruding out of the edge of the fixing plate 41.

Furthermore, the end face of each piezoelectric vibrator 21 is fixed to an island part 42 of the flow passage unit 24 in a state abutted thereon, and a flexible cable 43 is electrically connected to each of piezoelectric vibrators 21 at the lateral side of the vibrator group opposite to the fixing plate 41.

Figure 5:
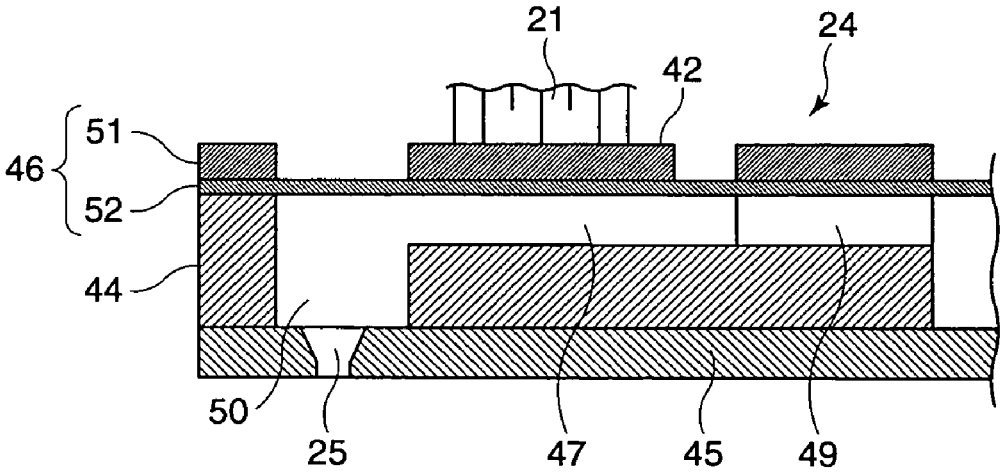
FIG. 5 is an enlarged cross-sectional view illustrating a flow passage unit.

As shown in FIG. 5, the flow passage unit 24 is constructed by arranging a nozzle plate 45 on one surface of the flow passage forming substrate 44 and by arranging and depositing an elastic plate 46 on the other surface thereof, opposite to the nozzle plate 45, with a flow passage forming substrate 44 being sandwiched therebetween.

The nozzle plate 45 is a thin plate made of stainless steel with a plurality of nozzle openings 25 provided in a row at a pitch corresponding to the dot-forming density. In the present embodiment, forty-eight nozzle openings 25 are provided in a row at a pitch of 90 dpi, and a nozzle row is configured by these nozzle openings 25.

The flow passage forming substrate 44 is a plate-shaped member to form hollow portions to be pressure chambers 47 corresponding to the respective nozzle openings 25 of the nozzle plate 45 and to form other hollow portions to be liquid supply ports and a common liquid chamber.

The pressure chamber 47 is a chamber elongated in a direction perpendicular to a row direction of the nozzle openings 25 (direction of a nozzle row), which is constructed into a flat concave chamber. Also, a liquid supply port 49, whose width of flow passage is sufficiently narrower than that of the pressure chamber 47, is formed between one end of the pressure chamber 47 and the common liquid chamber 48. Further, a nozzle communication hole 50 is penetrated in the direction of the plate thickness that communicates with the nozzle opening 25 and the pressure chamber 47 at the other end of the pressure chamber 47 farthest from the common liquid chamber 48.

The elastic plate 46 is laminated in a double structure of, for example, a polyphenylene sulphide (PPS) resin film 52 mounted on a support plate 51 of stainless steel. Also, the island part 42 is formed by annularly etching a part of the support plate 51 corresponding to the pressure chamber 47. The resin film 52 is left after a part of the support plate 51 corresponding to the common liquid chamber 48 is removed by an etching process.

In the injection head 7 having the above construction, the piezoelectric vibrators 21 are expanded/contracted in their longitudinal direction by an electric charging/discharging. In other words, the piezoelectric vibrators 21 are expanded by an electric discharging and the island part 42 is pressurized to the nozzle plate 45. On the other hand, an electric charging contracts the piezoelectric vibrators 21, and thus the island part 42 moves far from the nozzle plate 45. Also, the expansion of the piezoelectric vibrators 21 results in the transformation of the resin film 52 around the island part and the contraction of the pressure chamber 47. Further, the contraction of the piezoelectric vibrators 21 results in the expansion of the pressure chamber 47. In this manner, when the expansion or contraction of the pressure chamber 47 is controlled, there is a change in the liquid pressure within the pressure chamber 47 to thereby discharge liquid drops (ink drops) out of the nozzle openings 25.

Figure 6:
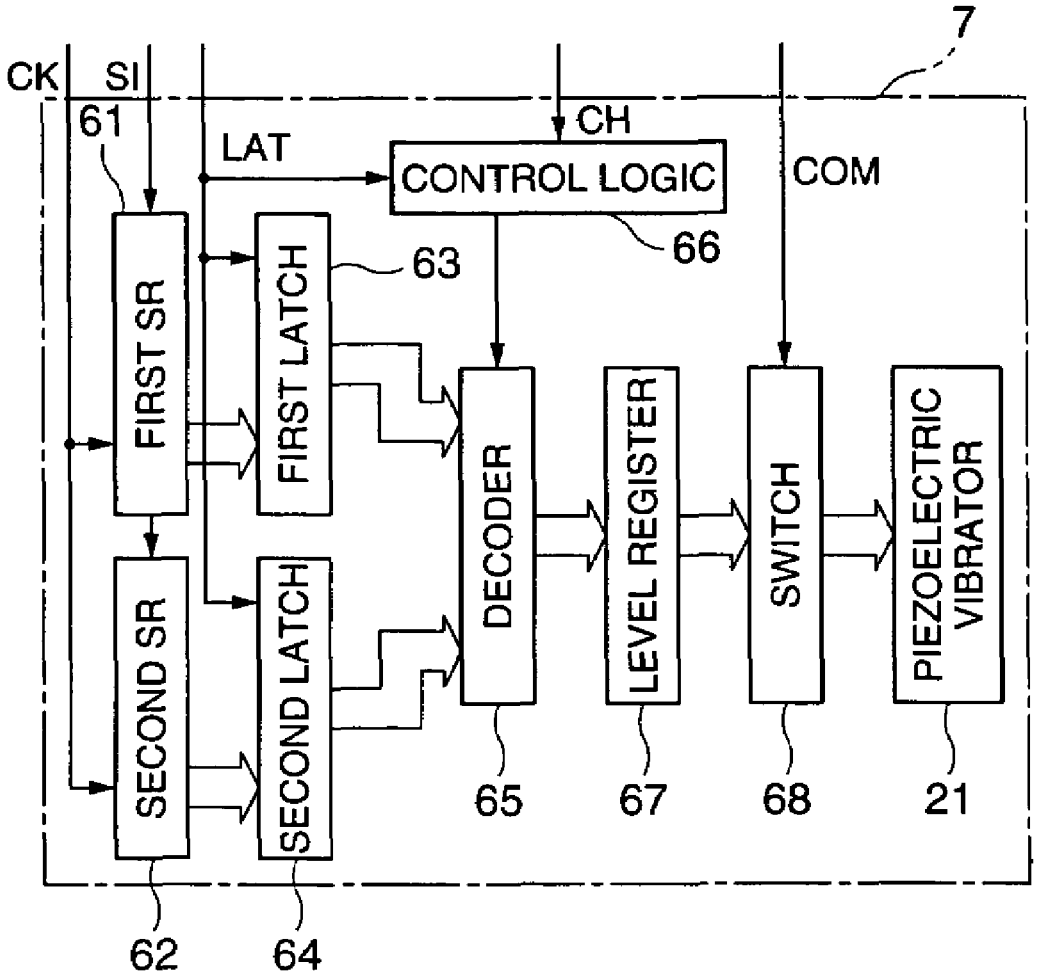
FIG. 6 is a block diagram illustrating an electrical configuration of an injection head.

Next, a description will be made of the electrical configuration of the injection head 7. As shown in FIG. 6, the injection head 7 comprises shift registers 61, 62 for setting discharge data, latch circuits 63, 64 for latching the discharge data set at the shift registers 61, 62, a decoder 65 for translating the discharge data latched at the latch circuits 63, 64 into pulse selecting data, a control logic 66 for outputting timing signals, a level shifter 67 functioning as a voltage amplifier, and a switch circuit 68 for controlling the supply of driving signals to the piezoelectric vibrators 21.

The shift registers 61, 62 comprise a first shift register 61 and a second shift register 62. Also, a lower bit (bit 0) of discharge data related to all nozzle openings 25 are set at the first shift register 61, and an upper bit (bit 1) of discharge data related to all the nozzle openings 25 are set at the second shift register 62.

The latch circuits 63, 64 comprise a first latch circuit 63 and a second latch circuit 64. The first latch circuit 63 is electrically connected to the first shift registers 61. The second latch circuit 64 is electrically connected to the second shift register 62. When the latch signals are inputted to the latch circuits 63, 64, the first latch circuit 63 latches the lower bit of discharge data set at the first shift registers 61, and the second latch circuit 64 latches the upper bit of discharge data set at the second shift register 62.

Figure 7:
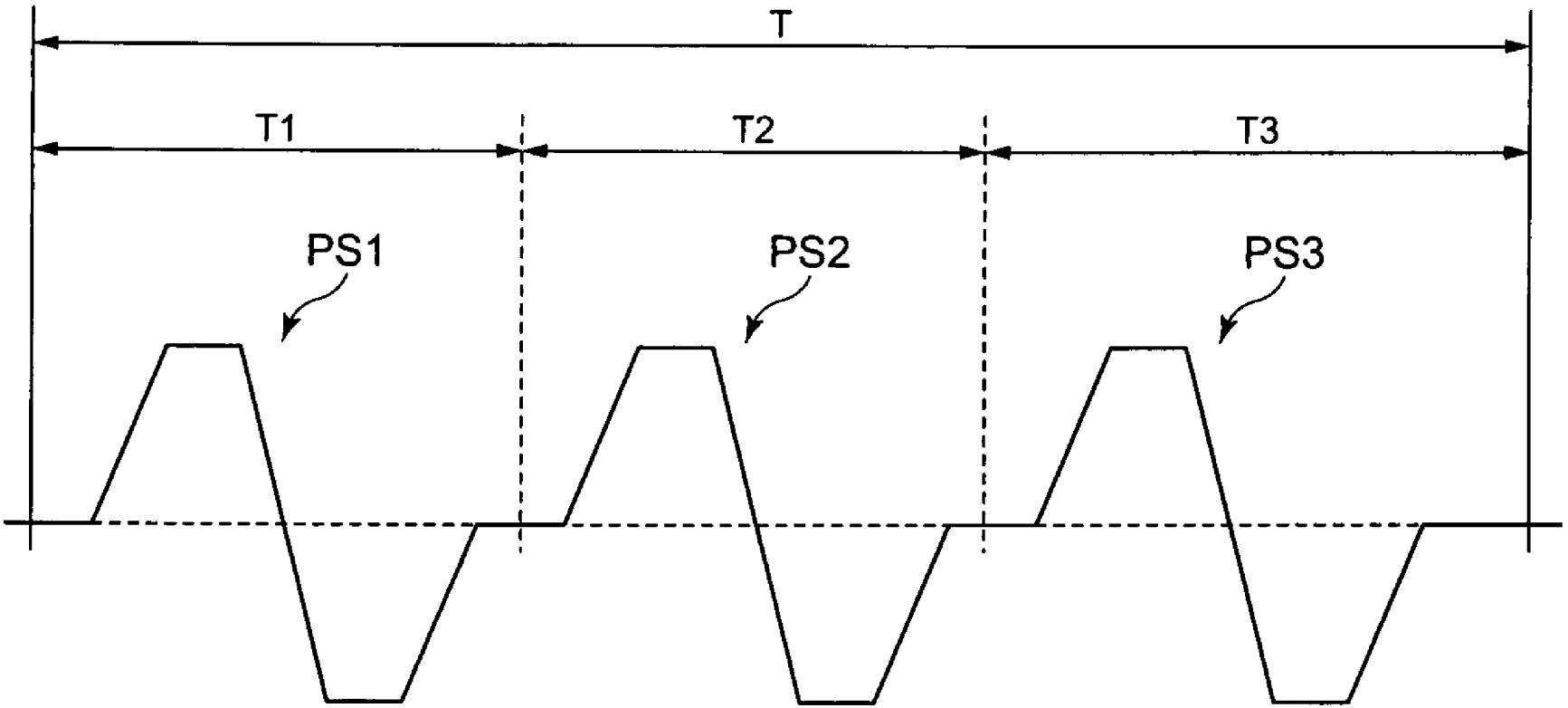
FIG. 7 illustrates a standard driving signal generated by driving signals generator.
Figure 14:
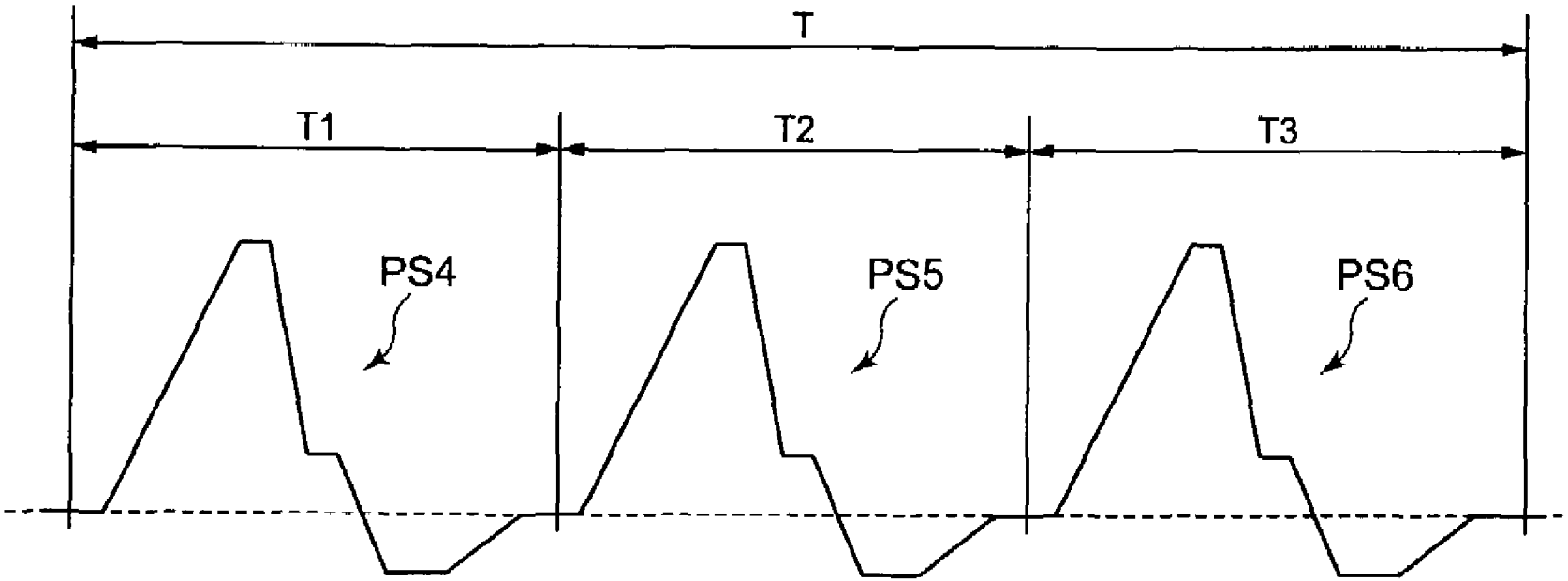
FIG. 14 illustrates a micro-driving signal generated by driving signals generator.

The discharge data latched at the latch circuits 63, 64 are inputted to the decoder 65, which functions as pulse selecting data generating means, thereby translating 2 bits of discharge data and generating a plurality of bits of pulse selecting data. In the present embodiment, as shown in FIGS. 7 and 14, the driving signal generator 32 generates a driving signal having three driving pulses (PS1 to PS3, PS4 to PS6) in the discharge cycle T3, so that the decoder 65 generates 3 bits of pulse selecting data.

In other words, the discharge data [00] discharging no liquid drop are translated to generate pulse selecting data [000], and the discharge data [01] discharging a small amount of liquid drops are translated to generate pulse selecting data [010]. Similarly, the discharge data [10] discharging a medium amount of liquid drops are translated to generate pulse selecting data [101], and the discharge data [11] discharging a large amount of liquid drops are translated to generate pulse selecting data [111].

The control logic 66 generates timing signals whenever a latching signal (LAT) or a channel signal (CH) is received from the main controller 31 and then supplies the generated timing signals to the decoder 65. Then, the decoder 65 inputs the 3 bits of pulse selecting data to the level shifter 67 in sequence from the upper bit thereof.

The level shifter 67 functions as a voltage amplifier, generating a level of voltage that can drive the switch circuit 68, for example, electrical signals whose voltage is raised by about tens of volts, if the pulse selecting data is [1]. The pulse selecting data of [1] whose voltage is raised by the level shifter 67 is supplied to the switch circuit 68. A driving signal (COM) is supplied from the driving signal generator 32 to the input part of the switch circuit 68, and the piezoelectric vibrators 21 are connected to the output of the switch circuit 68. Printing data control the operation of the switch circuit 68. For example, while the pulse selecting data inputted to the switch circuit 68 is [1], the driving signal is supplied to the piezoelectric vibrators 21, making the piezoelectric vibrators 21 vary in accordance with the driving signal. On the other hand, while the pulse selecting data inputted to the switch circuit 68 is [0], the electrical signal to operate the switch circuit 68 is not outputted from the lever shifter 67, resulting in the supply of no driving signal to the piezoelectric vibrators 21. Further, the piezoelectric vibrators 21 operates just like a condenser, so that the potential of the piezoelectric vibrators 21 are kept the same as it was just prior to the discontinuation of the supply of the driving signal while the selecting data is [0].

Next, a description will be made of driving signals to be generated by the driving signal generator 32. The driving signal shown in FIG. 7 is a standard driving signal that can discharge a relatively large amount of liquid drops. The standard driving signal includes three standard driving pulses in the discharge cycle T, i.e., a first standard driving pulse PS1 (T1), a second standard driving pulse PS2 (T2), and a third standard driving pulse PS3 (T3), and these standard driving pulses PS1 to PS3 are generated at a predetermined time interval.

Figure 8:
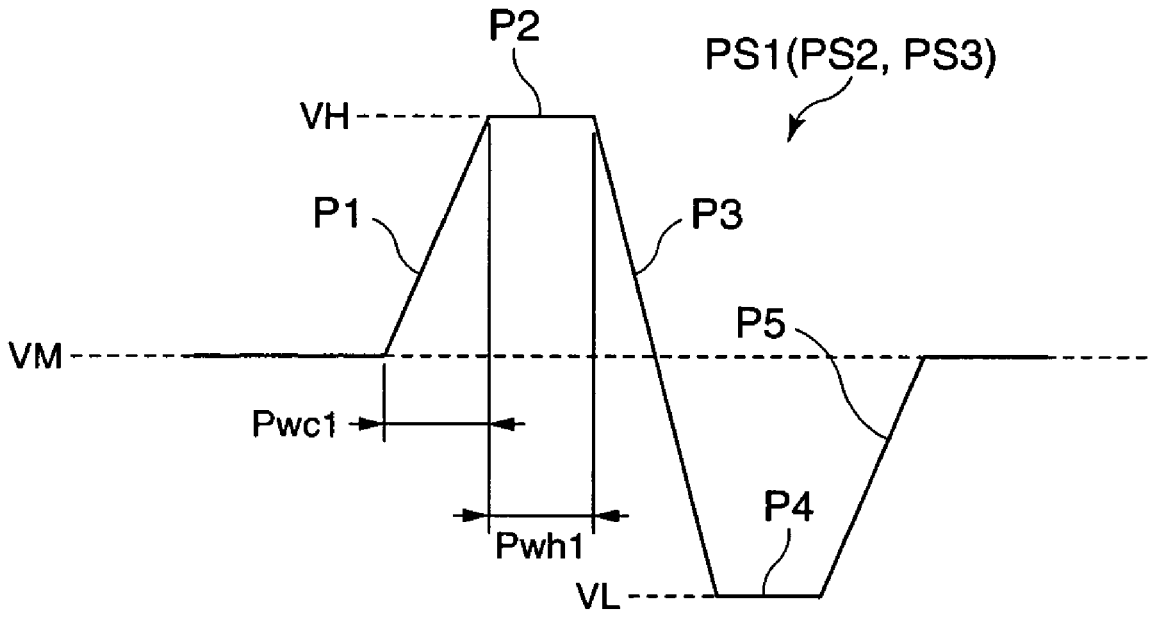
FIG. 8 illustrates a standard driving pulse included in a standard driving signal.

Those standard driving pulses PS1 to PS3 are a type of the first driving pulse in the present invention, and are configured by an identical waveform of pulse signals. For example, as shown in FIG. 8, the standard driving pulses PS1 to PS3 are configured by a plurality of waveform components consisted of an expansion component P1 for raising the potential at a constant gradient that will not discharge liquid drops, from the intermediate potential VM to maximum potential VH, an expansion hold component P2 for holding the maximum potential VH for a predetermined period of time, a discharge component P3 for dropping the potential at a steep gradient from the maximum potential VH to minimum potential VL, a contraction hold component P4 for holding the minimum potential VL for a predetermined period of time and a damping component P5 for raising the potential from the minimum potential VL to the intermediate potential VM.

When those standard driving pulses PS1 to PS3 are supplied to the piezoelectric vibrators 21, a predetermined amount (for example, 15 ng) of liquid drops are discharged out of the nozzle openings 25 whenever each of the standard driving pulses PS1 to PS3 is supplied.

In other words, the piezoelectric vibrators 21 are greatly contracted along with the supply of the expansion component P1, and the pressure chamber 47 is expanded at a level of speed that will not discharge liquid drops from the normal volume corresponding to the intermediate potential VM to the maximum volume corresponding to the maximum potential VH. The pressure in the pressure chamber 47 is decreased by the aforementioned expansion, so that the liquid material of the common liquid chamber 48 is flown into the pressure chamber 47 through the liquid supply port 49. The expanded state of the pressure chamber 47 is maintained for the period of time when the expansion hold component P2 is supplied. Thereafter, the supply of the discharge component P3 results in the significant extension of the piezoelectric vibrators 21, and the pressure chamber 47 is steeply contracted to the minimum volume. The liquid material of the pressure chamber 47 is pressurized by the aforementioned contraction, so that a predetermined amount of liquid drops are discharged out of the nozzle openings 25. The contraction hold component P4 is supplied after the discharge component P3, so that the pressure chamber 47 is maintained in its contracted state. While the pressure chamber 47 is in its contracted state, the meniscus (a free surface of the liquid material exposed at the nozzle opening 25) is greatly vibrated by an influence of the discharged liquid drop. Thereafter, the damping component P5 is supplied at a time capable of restraining vibrations of the meniscus, so that the pressure chamber 47 is expanded and returned to the normal volume. In other words, in order to offset the pressure generated in the liquid material within the pressure chamber 47, the pressure chamber 47 is expanded to reduce the pressure of liquid material. As a result, the vibrations of the meniscus can be restricted for a short period of time, thereby stabilizing the following discharge of liquid drops.

Furthermore, the normal volume is a volume of the pressure chamber 47 corresponding to the intermediate potential VM. If the standard driving pulses PS1 to PS3 are not supplied, the intermediate potential VM is supplied to the piezoelectric vibrators 21. While the liquid drops are not discharged (at a normal state), the pressure chamber 47 gets to its normal state.

If a change is made in the number of standard driving pulses PS1 to PS3 to be supplied within one discharge cycle T, the discharge amount of liquid drops can be set at every discharge cycle T. For example, if only the second standard driving pulse PS2 is supplied to the piezoelectric vibrators 21 within the discharge cycle T, 15 ng of a liquid drop can be discharged. Further, if the first and third standard driving pulses PS 1, PS3 are supplied to the piezoelectric vibrators 21 within a discharge cycle T, 30 ng of a liquid drop can be discharged, for example. Moreover, if the respective standard driving pulses PS1 to PS3 are supplied to the piezoelectric vibrators 21 within a discharge cycle T, for example, 45 ng of liquid drop can be discharged.

Further, in the present specification, the amount of liquid material is designated by weight (ng), a description has been made about the process of controlling the weight of liquid material. However, a control can also be made by the volume (pL) of liquid material.

The discharge of liquid drops is controlled on the basis of the pulse selecting data. In other words, if the pulse selecting data is [000], the switch circuit 68 is in its OFF state at any one of the first, second and third generating time intervals T1, T2, T3 respectively corresponding to the first, second and third standard driving pulses PS1, PS2, PS3. Therefore, none of the standard driving pulses PS1 to PS3 is supplied to the piezoelectric vibrators 21. If the pulse selecting data is [010], the switch circuit 68 is turned to its ON state at the second generating time interval T2, and the switch circuit 68 is turned to its OFF state at the first and third generating time interval T3. As a result, only the second standard driving pulse PS2 is supplied to the piezoelectric vibrators 21. Further, if the pulse selecting data is [101], the switch circuit 68 is turned to its ON state at the first and third generating time intervals T1, T3 and to its OFF state at the second generating time interval T2. As a result, the first and third standard driving pulses PS1, PS3 are supplied to the piezoelectric vibrators 21. Similarly, if the pulse selecting data is [111], the switch circuit 68 is turned to its ON state at the first through third generating time intervals T1 to T3. As a result, respective standard driving pulses PS1 to PS3 are supplied to the piezoelectric vibrators 21.

Further, in order to control the discharge of liquid drops, the type of driving pulses can be changed to vary the amount of liquid drops to be discharged. For example, at the micro-driving signals PS4 to PS6 shown in FIG. 14, a predetermined amount (for example, 5.5 ng) of liquid drops is discharged out of the nozzle openings 25 whenever the micro-driving pulses PS4 to PS6 are supplied.

Figure 15:
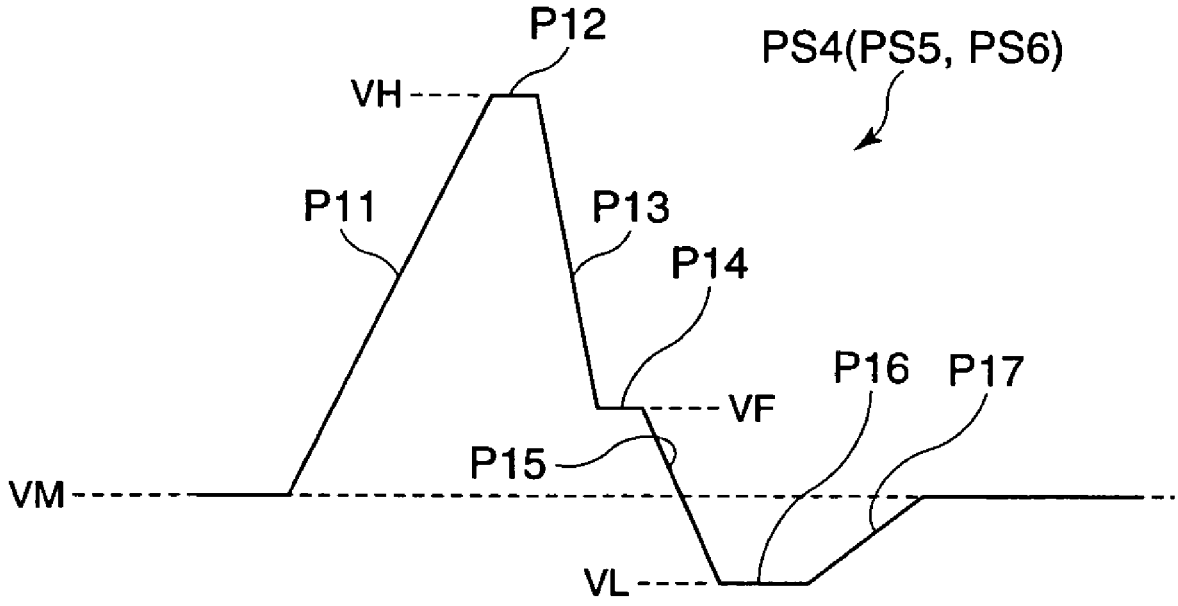
FIG. 15 illustrates a micro-driving pulse included in a micro-driving signal.

The micro-driving pulses PS4 to PS6 are a type of the second driving pulses of the present invention, and are configured by the same waveform of a pulse signal. For example, as shown in FIG. 15, the micro-driving pulses PS4 to PS6 are made of a plurality of waveform components such as a second expansion component P11 for raising the potential at a relatively steep gradient from the intermediate potential VM to the maximum potential VH, a second expansion hold component P12 for holding the maximum potential VH for an extremely short period of time, a second discharge component P13 for dropping the potential at a steep gradient from the maximum potential VH to the discharge potential VF, a discharge hold component P14 for holding the discharge potential VF for an extremely short period of time, a contraction damping component P15 for dropping the potential at a gradient gentler than the second discharge component P13 from the discharge potential VF to the minimum potential VL, a damping hold component P16 for holding the minimum potential VL for a predetermined period of time and an expansion damping component P17 for raising the potential at a relatively gentle gradient from the minimum potential VL to the intermediate potential VM.

If the micro-driving pulses PS4 to PS6 are supplied to the piezoelectric vibrators 21, the state of the pressure chamber 47 or the liquid material in the pressure chamber 47 changes, and the liquid drops are discharged out of the nozzle openings 25.

In other words, the normal volume of the pressure chamber 47 is expanded abruptly along with the supply of the second expansion component P11 to thereby significantly draw in the meniscus to the pressure chamber 47. Also, if the second expansion hold component P12 is supplied for an extremely short period of time, the moving direction of the central part of the drawn-in meniscus is reversed by surface tension. Thereafter, if the second discharge component P13 is supplied, the pressure chamber 47 is abruptly contracted to its discharge volume from its maximum volume. At this time, the central part of the meniscus expanded in the direction of discharging liquid drops in the shape of a pillar is shattered into pieces, being discharged into a state of a liquid drop.

After the second discharge component P13 is supplied, the discharge hold component P14 and the contraction damping component P15 are supplied in sequence. The pressure chamber 47 is contracted from the discharge volume to the minimum volume by the supply of the contraction damping component P15. At this time, the contraction speed is set to a speed capable of restricting the vibrations of the meniscus after the liquid drop is discharged. Since the contraction damping component P15 and the damping hold component P16 are supplied in sequence, the pressure chamber 47 is maintained at its contracted state. Thereafter, when the expansion damping component P17 is supplied at a time that can erase the vibrations of the meniscus, the pressure chamber 47 is expanded and returned to its normal volume to restrict the vibrations of the meniscus.

In the case of the micro-driving signals, the number of micro-driving pulses to be supplied within one discharge cycle T is changed to thereby control the amount of a liquid drop to be discharged. For example, if only the second micro-driving pulse PS5 is supplied to the piezoelectric vibrators 21 within the discharge cycle T, it is possible to discharge the 5.5 ng of a liquid drop, for example. Furthermore, if the first and third micro-driving pulses PS4, PS6 are supplied to the piezoelectric vibrators 21 within the discharge cycle T, it is possible to discharge 11 ng of a liquid drop, for example. Further, if the micro-driving pulses PS4 to PS6 are supplied to the piezoelectric vibrators 21, within the discharge cycle T, it is possible to discharge 16.5 ng of a liquid drop.

The control of discharging liquid drops is made on the basis of the pulse selecting data. Furthermore, the control of discharging liquid drops made on the basis of the pulse selecting data is identical to the control of the standard driving signals described above, and thus the description thereof is omitted.

Moreover, the amount or flying speed of liquid drops to be discharged can be varied by a change in the waveform of the standard driving pulses PS1 to PS3 or micro-driving pulses PS4 to PS6. In other words, a change is made in the type of the driving pulses to thereby significantly vary the amount of a liquid drop to be discharged. If the type of driving pulses can make a change in the amount of liquid drops to be discharged precisely (that is, in high precision) by setting the start and end potentials (differences in potential) or the duration of respective waveform components.

Hereinafter, a description will be made of a change in the amount or flying speed of liquid drops to be discharged along with setting variations of waveform components for each of the driving pulses.

Figure 9A:
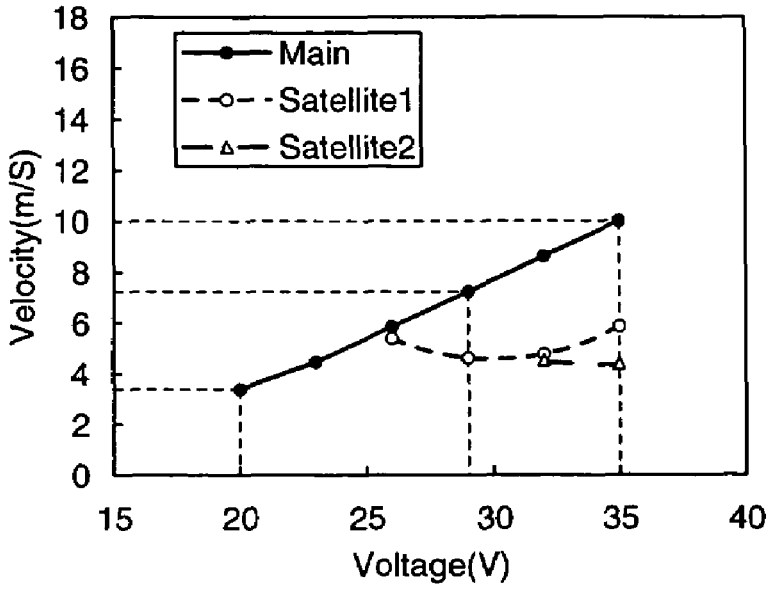
FIG. 9 illustrates a variation in discharge characteristics when driving voltage is adjusted in the standard driving pulse.
Figure 9B:
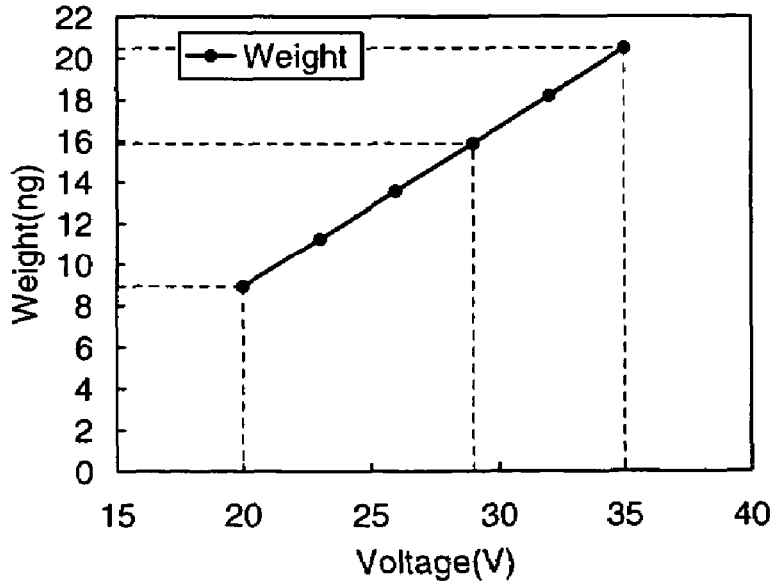

First, a description will be made of the relationship between driving voltage (a potential difference between the maximum potential VH and the minimum potential VL) and discharge characteristics of liquid drops for respective standard driving pulses PS1 to PS3. At this time, FIG. 9 illustrates a change in the discharge characteristics of liquid drops when an adjustment is made to driving voltage: FIG. 9(*a*) indicates a change in flying speed of liquid drops when a change is made in the driving voltage; and FIG. 9(*b*) indicates a change in the weight of liquid drops when a change is made in the driving voltage.

Furthermore, when the driving voltage is set, a change was made in the maximum potential VH with no change in the minimum potential VL and the duration of waveform components (P1 to P5). Further, the intermediate potential VM was varied corresponding to the driving voltage. In FIG. 9(*a*), a solid line having black circles indicates main liquid drops, and a dotted line having white circles indicates satellite liquid drops (liquid drops flying along with main liquid drops). Furthermore, a dotted line having triangles indicates second satellite liquid drops (liquid drops flying along with satellite liquid drops).

As can be understood from FIG. 9, the magnitude of driving voltage and the flying speed and weight of liquid drops can be said to be in direct proportion (a positive coefficient). In other words, if driving voltage gets large, the flying speed and weight of liquid drops increase (that is, the amount of liquid drops to be discharged increases). For example, if the driving voltage is 20 V, the flying speed of the main liquid drops is approximately 3 m/s and their weight is approximately 9 ng. Also, if the driving voltage is 29 V, the flying speed of liquid drops is approximately 7 m/s and their weight is approximately 15.5 ng. Furthermore, if the driving voltage is 35 V, the flying speed of liquid drops is approximately 10 m/s and their weight is approximately 20.5 ng.

It is regarded to be because the variation dimension of the volume of the pressure chamber was varied according to the increase or decrease of driving voltage. In other words, if the driving voltage is set higher than the reference voltage, a volumetric difference between the expanded and contracted states of the pressure chamber gets greater than that of its reference state. Therefore, the amount of liquid material greater than that at the reference state can be discharged out of the pressure chamber 47 and the amount of liquid material to be discharged increases. Further, there is no change in the duration of the discharge component P3, the contraction speed of the pressure chamber 47 at the time of discharging liquid material gets greater than that of its reference state. Therefore, it is possible to discharge liquid drops at a high speed. On the contrary, if the driving voltage is set lower than the reference voltage, a volumetric difference between the expanded and contracted states of the pressure chamber 47 gets smaller than that of its reference state. Therefore, the amount of liquid material to be discharged out of the pressure chamber 47 decreases. Further, the contraction speed of the pressure chamber 47 gets lower than that at the reference state, and the flying speed of liquid drops also decreases.

Furthermore, referring to FIG. 9(*a*), if the driving voltage is greater than 26 V, a liquid drop is divided into a main and a satellite liquid drop to be flown (i.e., ejected and applied). If the driving voltage is 32 V or greater, a second satellite liquid drop appears in addition to the above satellite liquid drop. The flying speed of the satellite liquid drop and the second satellite liquid drop is little affected by the magnitude of driving voltage within the measurement range of FIG. 9(*a*). For example, the flying speed of the satellite liquid drop is approximately 5 m/s if the driving voltage is set to 26 V. If the driving voltage is set to 29 V or 32 V, the flying speed of the satellite liquid drop is approximately 4 m/s. Furthermore, if the driving voltage is set to 35 V, the flying speed is approximately 6 m/s. If the driving voltage is set to 32 V or 35 V, the flying speed of any one of the second satellite liquid drop is almost identical, approximately 4 m/s.

As described above, it can be understood that the flying speed and the weight of the liquid drop to be discharged increase or decrease at the same time depending by the setting of driving voltage. Further, it can be also understood that it is possible to control the generation of the satellite liquid drops and the second satellite liquid drops.

Next, a description will be made about the relationship between the intermediate potential VM and the discharge characteristics of liquid drops at each of standard driving pulses PS1 to PS3.

As described above, the intermediate potential VM defines the normal volume of the pressure chamber 47. Also, the piezoelectric vibrators 21 are contracted by the increase (charge) of potential to thereby expand the pressure chamber 47, while the piezoelectric vibrators 21 are expanded by the decrease (discharge) of potential to thereby contract the pressure chamber 47. If the intermediate potential VM is set higher than the reference potential, therefore, the normal volume is greater in expansion than the reference volume (the volume of the pressure chamber corresponding to the reference intermediate potential VM). On the other hand, if the intermediate potential VM is set lower than the reference potential, the normal volume is smaller in contraction than the reference volume.

At this time, if a change is made in only the intermediate potential VM, the maximum potential VH is the same before and after a change is made in the intermediate potential VM. If the intermediate potential VM is set higher than the reference potential, therefore, the potential difference between the intermediate potential VM and the maximum potential VH is smaller than that when the intermediate potential VM is set to its reference value. As a result, the expansion margin of the pressure chamber 47 gets smaller. On the other hand, if the intermediate potential VM is set lower than the reference value, the potential difference between the intermediate potential VM and the maximum potential VH is greater than that when the intermediate potential VM is set to its reference value. As a result, the expansion margin of the pressure chamber 47 gets greater. The expansion margin defines the amount of liquid material to be flown into the pressure chamber 47. In other words, if the expansion margin is greater than the reference value, the amount of liquid drops to be flown into the pressure chamber 47 from the common liquid chamber 48 gets greater than the reference amount. On the other hand, if the expansion margin is smaller than the reference value, the amount of liquid drops to be flown into the pressure chamber 47 from the common liquid chamber 48 gets smaller than the reference amount.

Further, if a change is made in only the intermediate potential VM, the duration (supply time) of the expansion component P1 becomes the same before and after a change is made in the intermediate potential VM. Therefore, if the intermediate potential VM is set higher than the reference value, the expansion speed of the pressure chamber 47 gets slower when the pressure element P1 is supplied to the piezoelectric vibrators 21. On the other hand, if the intermediate potential VM is set lower than the reference value, the expansion speed of the pressure chamber 47 gets faster.

The expansion margin of the pressure chamber 47 influences the pressure of liquid material in the pressure chamber 47 just after the supply of the expansion component P1. In other words, as the expansion margin gets smaller than the reference value, the pressure of the liquid material in the pressure chamber 47 is closer to its normal pressure just after the supply of the expansion component P1. Therefore, the inflow amount liquid material gets smaller than the reference value, and the inflow speed of liquid material gets smaller. As a result, there is a relatively small change in the pressure of liquid material in the pressure chamber 47. On the contrary, if the expansion margin is greater than the reference value, the pressure of liquid material in the pressure chamber 47 gets significantly smaller just after the supply of the expansion component P1. Therefore, the inflow amount of liquid material gets larger, and the inflow speed of liquid material gets faster, resulting in a big change in the pressure of liquid material in the pressure chamber 47.

At this time, since the pressure chamber 47 can be regarded as an acoustic tube, the energy of a change in the pressure of liquid material made by the supply of the expansion component P1 is conserved in the pressure chamber 47 to be pressure vibration. Also, the discharge component P3 is supplied at the time when the pressure vibration is turned into positive pressure, resulting in contraction of the pressure chamber 47. At this time, the energy conserved in the pressure chamber 47 differs higher according to the expansion margin of the pressure chamber 47 (that is, the magnitude of the intermediate potential VM), so that there is a change in the flying speed and the amount of liquid drops to be discharged even if the potential difference or inclination of the discharge component P3 are the same.

In this case, there is a difference between the degree of change in the flying speed and that in the amount of liquid material to be discharged when there is a change in the intermediate potential VM. In other words, there is a difference in their sensitivity. For example, there is a relatively great change in the flying speed for a change of the intermediate potential VM, while there is a relatively small change in the weight of liquid drops for a change in the intermediate potential VM. It can be considered to be because the weight of liquid drops is greatly affected by driving voltage (a potential difference of discharge component P3), i.e., the contraction amount of the pressure chamber 47.

Accordingly, if the driving voltage and the intermediate potential VM are appropriately set in combination, it is possible to change the amount of liquid drops to be discharged while the flying speed of liquid drops is kept constant.

Figure 10A:
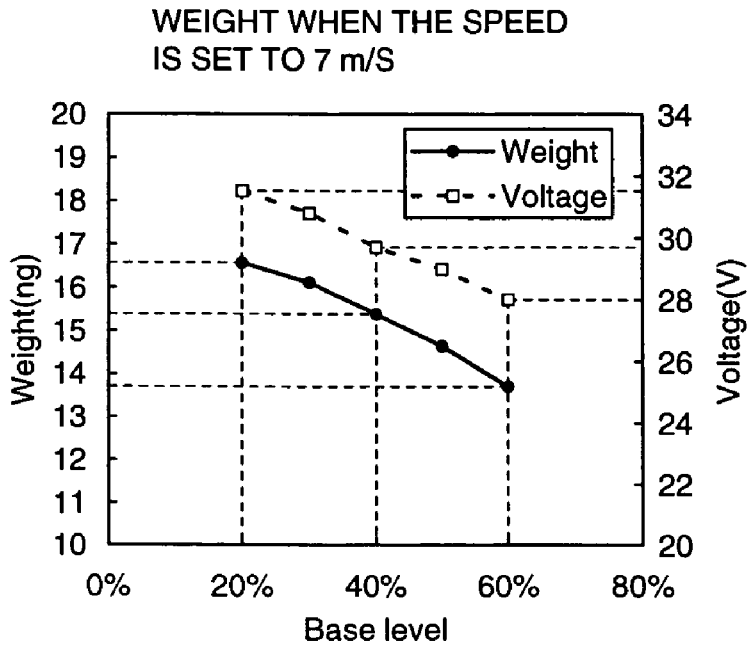
FIG. 10(*a*) illustrates a relationship among driving voltage, intermediate potential and weight of liquid drops when the flying speed of the liquid drops is set to 7 m/s in a standard driving pulse, and FIG. 10(*b*) illustrates a relationship among driving voltage, intermediate potential and flying speed of liquid drops when the weight of the liquid drops is set to 15 ng.
Figure 10B:
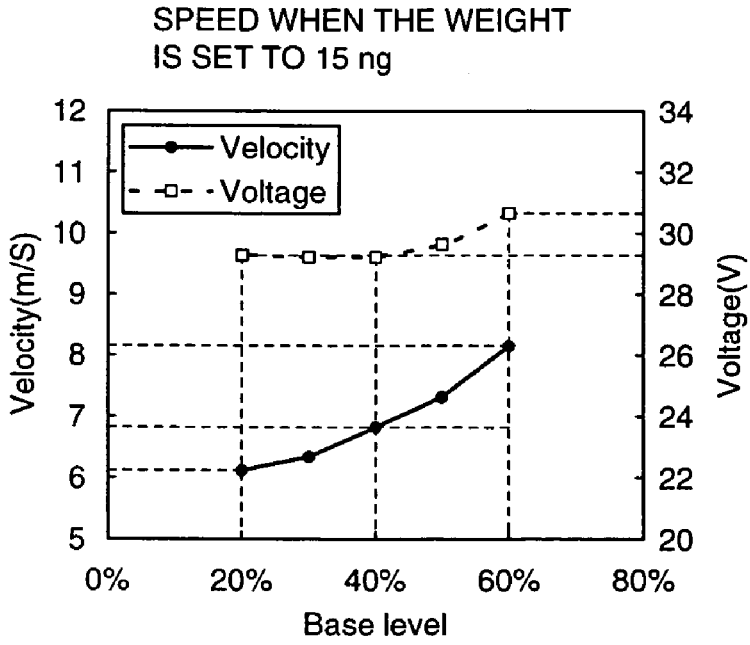

For example, if the flying speed of a liquid drop is set to 7 m/s, the relationship among the driving voltage, the intermediate potential VM and the weight of the liquid drop is determined as shown in FIG. 10(*a*). Referring to FIG. 10(*a*), if the driving voltage is set to 31.5 V and the intermediate potential VM is set to 20% of the driving voltage (that is, the potential of 6.3 V higher than the minimum potential VL), respectively, it can be understood that a liquid drop of approximately 16.5 ng can be discharged. Further, if the driving voltage is set to 29.7 V and the intermediate potential VM is set to 40% of the driving voltage, respectively, it can be understood that a liquid drop of approximately 15.3 ng can be discharged. Furthermore, if the driving voltage is set to 28.0 V and the intermediate potential VM is set to 60% of the driving voltage, it can be understood that a liquid drop of approximately 13.6 ng can be discharged.

Further, if the driving voltage and the intermediate potential VM are appropriately set, there may be a change in the flying speed of liquid drops while the discharge amount of the liquid drop is kept constant.

For example, if the weight of liquid drop is set to 15 ng, the relationship among the driving voltage, the intermediate potential VM and the flying speed of the liquid drop is as shown in FIG. 10(*b*). Referring to FIG. 10(*b*), if the driving voltage is set to 29.2 V and the intermediate potential VM is set to 20% of driving voltage (that is, the potential of 5.7 V higher than the minimum potential VL), respectively, it can be understood that the flying speed of the liquid drop is approximately 6.1 m/s. Further, if the driving voltage is set to 29.0 V and the intermediate potential VM is set to 40% of driving voltage, respectively, it can be understood that the flying speed of the liquid drop is approximately 6.8 m/s. Furthermore, if the driving voltage is set to 30.6 V and the intermediate potential VM is set to 60%, respectively, the flying speed of the liquid drop is approximately 8.1 m/s.

Next, a description will be made of the relationship between the duration (Pwc1) of the expansion component P1 of respective standard driving pulse PS1 to PS3 and the discharge characteristics of liquid drops.

The duration of the expansion component P1 defines the expansion speed of the pressure chamber 47 from the normal volume to the maximum volume. Also, regardless of the duration of the expansion component P1, the start potential of the expansion component P1 is set to the intermediate potential VM and the termination potential thereof is set to the maximum potential VH, respectively, the duration is set shorter than the reference value, thereby making the gradient for the expansion component P1 steeper and making the expansion speed of the pressure chamber 47 faster than the reference value. On the other hand, if the duration is set longer than the reference value, the gradient of the expansion component P1 gets gentler and the expansion speed of the pressure chamber 47 gets lower than the reference value.

The difference in the expansion speed influences the pressure of the liquid material in the pressure chamber 47 just after the supply of the expansion component P1. In other words, if the expansion speed is slower than the reference value, there may be a smaller change in the pressure of the liquid material just after the supply of the expansion element P1, to thereby decrease the inflow speed of liquid material into the pressure chamber 47. On the other hand, if the expansion speed gets faster than the reference value, the pressure of liquid material in the pressure chamber 47 significantly decreases just after the supply of the expansion component P1, to thereby accelerate the pressure vibration and the inflow speed of liquid material into the pressure chamber 47.

Accordingly, if there is a change in the duration of the expansion component P1, the flying speed and weight of liquid drops can be changed even if the potential difference or inclination of the discharge component P3 are identical.

In this time, also, similar to when there is a change in the intermediate potential VM, there is a relatively large variation in the flying speed of liquid drops in comparison with a change in the duration of the expansion component P1.

However, there is a relatively small change in the weight of liquid drops in comparison with a change in the duration of the expansion component P1. Accordingly, if the driving voltage and the duration of the expansion component P1 are properly set, the discharge amount of liquid drops can be changed while the flying speed of liquid drops is kept constant.

Figure 11A:
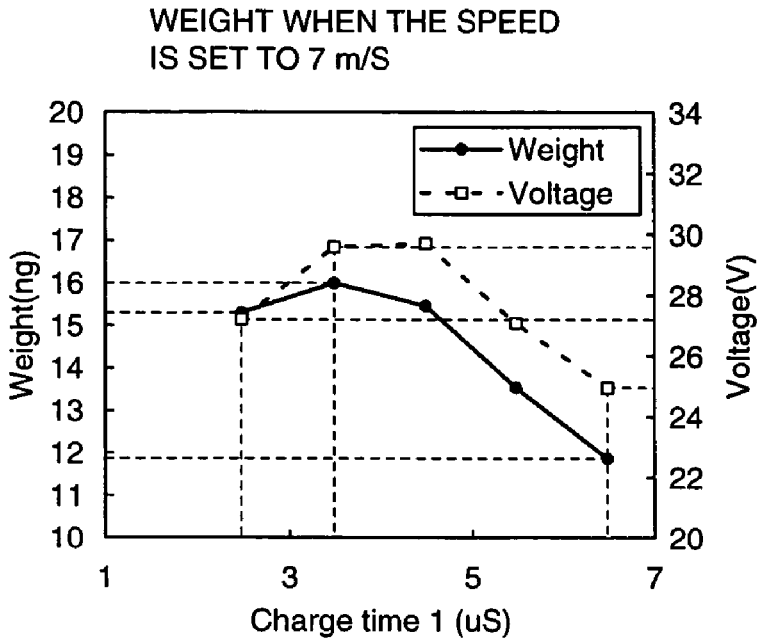
FIG. 11(*a*) illustrates a relationship among driving voltage, duration of an expansion component and weight of liquid drops when the flying speed of the liquid drops is set to 7 m/s in a standard driving pulse, and FIG. 11(*b*) illustrates a relationship among driving voltage, duration of an expansion component and flying speed of liquid drops when the weight of the liquid drops is set to 15 ng.
Figure 11B:
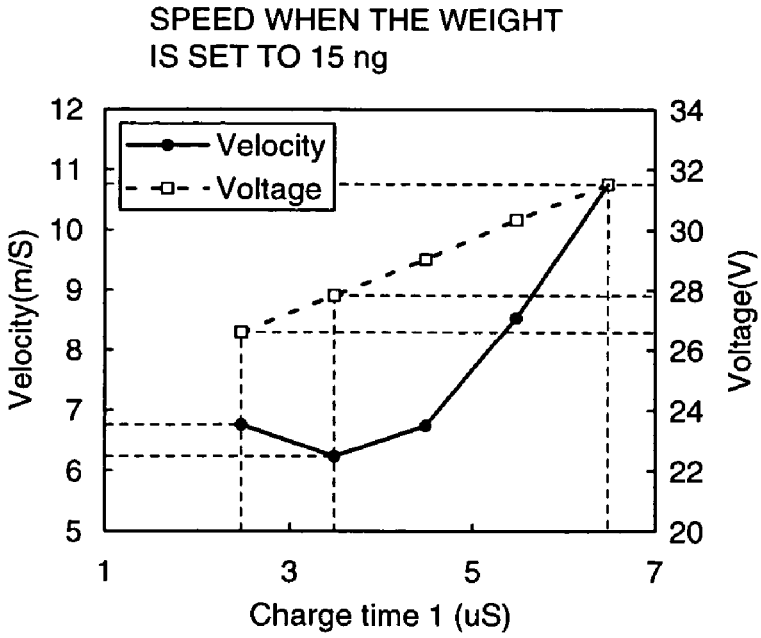

For example, if the flying speed of a liquid drop is set to 7 m/s, the relationship among the driving voltage, the duration of the expansion component P1 and the weight of the liquid drop are as shown in FIG. 11(*a*). As shown in FIG. 11(*a*), if the driving voltage is set to 27.4 V and the duration of the expansion component P1 is set to 2.5 μs, respectively, it can be understood that liquid material of approximately 15.3 ng can be discharged. Further, if the driving voltage is set to 29.5 V and the duration of the expansion component P1 is set to 3.5 μs, respectively, it can be understood that a liquid drop of approximately 16.0 ng can be discharged. Furthermore, if the driving voltage is set to 25.0 V and the duration of expansion component P1 is set to 6.5 μs, respectively, it can be understood that a liquid drop of approximately 11.8 ng can be discharged.

Further, if the driving voltage and the duration of the expansion component P1 are appropriately set, there may be a change in the flying speed of liquid drops while the discharge amount of liquid drops is kept constant.

For example, if the weight of a liquid drop is set to 15 ng, the relationship among the driving voltage, the duration of the expansion component P1 and the flying speed of the liquid drop are as shown in FIG. 11(*b*). Referring to FIG. 11(*b*), if the driving voltage is set to 26.8 V and the duration of the expansion component P1 is set to 2.5 μs, respectively, it can be understood that the flying speed of the liquid drop can be set to approximately 6.7 m/s. Further, if the driving voltage is set to 27.8 V and the duration of the expansion component P1 is set to 3.5 μs, respectively, it can be understood that the flying speed of a liquid drop can be set to approximately 6.3 m/s. Furthermore, if the driving voltage is set to 31.7 V and the duration of the expansion component P1 is set to 6.5 μs, respectively, it can be understood that the flying speed of a liquid drop can be set to approximately 10.8 m/s.

Next, a description will be made of the relationship between the duration of the expansion hold component P2 of respective standard driving pulses PS1 to PS3 (Pwh1) and the discharge characteristics of liquid drops.

The duration of the expansion hold component P2 defines a supply starting timing of the discharge component P3, i.e., a contraction starting timing of the pressure chamber 47. A difference in the contraction starting timing of the pressure chamber 47 affects the flying speed and discharge amount of liquid drops. It is considered to be because there is a change in the resultant pressure according to a difference between a phase of pressure vibration excited by the expansion component P1 and that of the pressure vibration excited by the discharge component P3.

Figure 12A:
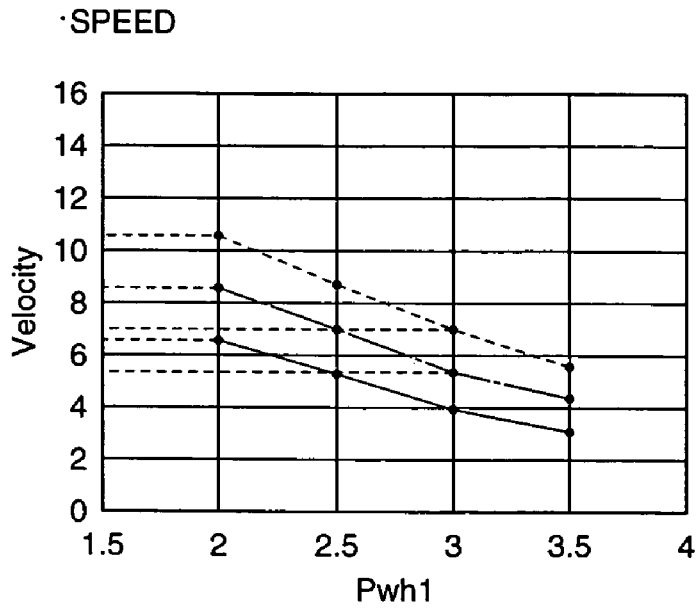
FIG. 12 illustrates a variation in the discharge characteristics when an adjustment is made to the duration of an expansion hold component in a standard driving pulse.
Figure 12B:
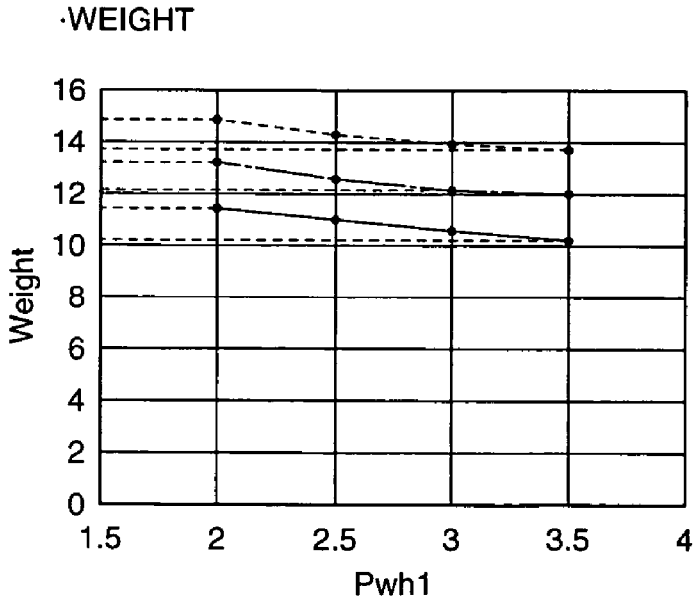

In other words, if the expansion component P1 is supplied to expand the pressure chamber 47, as described above, pressure vibration is excited at the liquid material in the pressure chamber 47 along with the aforementioned expansion. If the pressure chamber 47 starts contraction at the timing when the pressure of liquid material in the pressure chamber 47 is positive pressure, it is possible to fly (eject) liquid drops at a higher speed than when the liquid drops are discharged in its normal state. On the contrary, if the pressure chamber 47 starts contraction at the timing when the pressure of liquid material in the pressure chamber 47 is negative pressure, it is possible to fly liquid drops at a lower speed than when the liquid drops are discharged in its normal state. Further, the weight of liquid drops varies in correspondence with the duration of the expansion hold component P2, and there is a relatively small amount change in the weight of liquid drop. This is similar to the aforementioned cases 23. It is considered to be because the weight of liquid drops is affected by the magnitude of driving voltage.

the above will be described with reference to FIG. 12. At this time, FIG. 12 illustrates a change in the discharge characteristics when an adjustment is made to the duration of the expansion hold component P: FIG. 12(*a*) illustrates a change in the flying speed of liquid drops when there is a change in the duration, and FIG. 12(*b*) illustrates a change in the weight of liquid drops when there is a change in the duration. Furthermore, in those drawings, a solid line indicates a characteristic when the driving voltage is set to 20 V, and a dotted line indicates a characteristic when the driving voltage is set to 23 V. Further, the minimum potential VL and the duration of respective waveform components except the expansion hold component P2 are kept constant with the reference values, and the intermediate potential VM is changed in correspondence with the driving voltage.

As can be understood from in FIG. 12(*a*), within the measurement range, the flying speed of liquid drops gets slower as the duration of the expansion hold component P2 increases. For example, if the driving voltage is set to 20 V, and if the duration of the expansion hold component P2 is set to 2 μs, the flying speed of a liquid drop is approximately 6.5 m/s. If the driving voltage is set to 20 V, and if the duration of the expansion hold component P2 is set to 3 μs, the flying speed of a liquid drop is approximately 4 m/s. Furthermore, the driving voltage is set higher, the flying speed of liquid drops gets faster. For example, if the driving voltage is set to 23 V, and if the duration of the expansion hold component P2 is set to 2 μs, the flying speed of a liquid drop is approximately 8.7 m/s. If the driving voltage is set to 23 V, and if the duration of the expansion hold component P2 is set to 3 μs, the flying speed of a liquid drop is approximately 5.2 m/s. Similarly, if the driving voltage is set to 26 V, and if the duration of the expansion hold component P2 is set to 2 μs, the flying speed of a liquid drop is approximately 10.7 m/s. If the driving voltage is set to 26 V, and if the duration of the expansion hold component P2 is set to 3 μs, the flying speed of liquid drops is approximately 7 m/s.

Further, as can be understood from FIG. 12(*b*), within the measurement range, the weight of liquid drops decreases as the duration of the expansion hold component P2 increases (that is, the discharge amount of liquid drops decreases). For example, if the driving voltage is set to 20 V, and if the duration of the expansion hold component P2 is set to 2 μs, the weight of a liquid drop is approximately 11.5 ng. If the driving voltage is set to 20 V, and if the duration of the expansion hold component P2 is set to 3 μs, the weight of a liquid drop is approximately 10.5 ng. Further, if the driving voltage increases, the weight of liquid drops increases (that is, the discharge amount of liquid drops increases). For example, if the driving voltage is set to 23 V, and if the duration of the expansion hold component P2 is set to 2 μs, the weight of a liquid drop is approximately 13.2 ng. If the driving voltage is set to 23 V, and if the duration of the expansion hold component P2 is set to 3 μs, the weight of a liquid drop is approximately 12.1 ng. Similarly, if the driving voltage is set to 26 V, and if the duration of the expansion hold component P2 is set to 2 μs, the weight of a liquid drop is approximately 15.0 ng. If the driving voltage is set to 26 V, and if the duration of the expansion hold component P2 is set to 3 μs, the weight of a liquid drop is approximately 13.8 ng.

In this case, also if the driving voltage and the duration of the expansion hold component P2 are appropriately set, there may be a change in the discharge amount of liquid drops while the flying speed of liquid drops is kept constant.

Figure 13A:
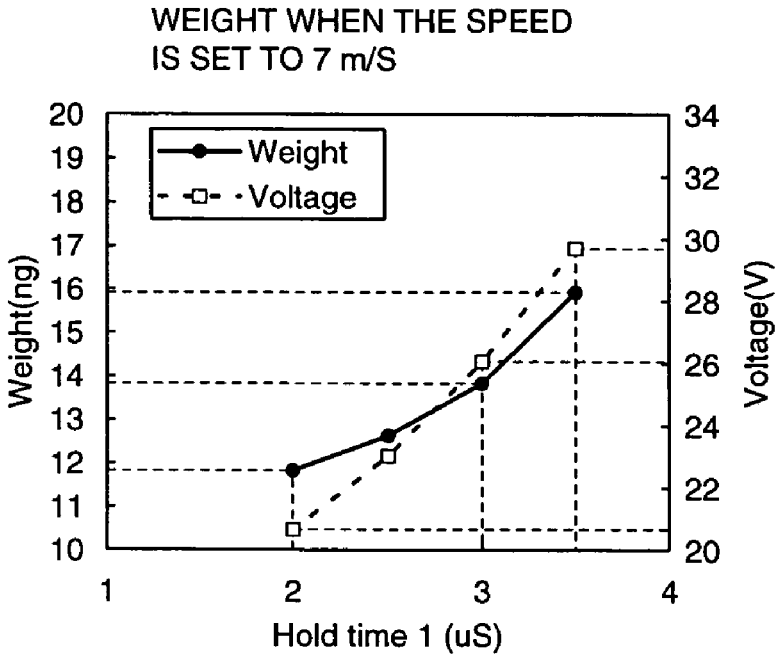
FIG. 13(*a*) illustrates a relationship among driving voltage, duration of an expansion hold component and weight of liquid drops when the flying speed of the liquid drops is set to 7 m/s in a standard driving pulse, and FIG. 13(*b*) illustrates a relationship among driving voltage, duration of an expansion hold component and flying speed of liquid drops when the weight of the liquid drops is set to 15 ng.
Figure 13B:
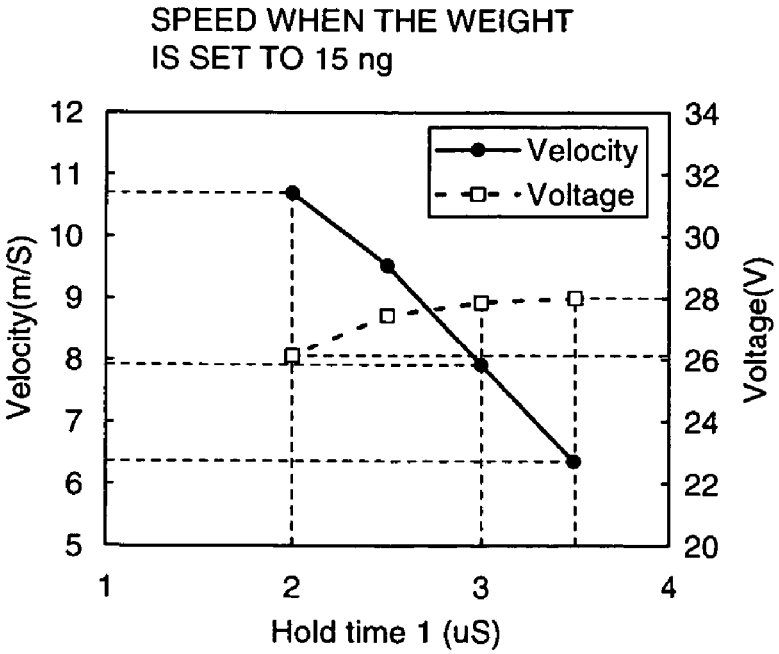

For example, if the flying speed of a liquid drop is set to 7 m/s, the relationship among the driving voltage, the duration of the expansion hold component P2 and the weight of the liquid drop are shown in FIG. 13(*a*). Referring to FIG. 13(*a*), if the driving voltage is set to 20.5 V and the duration of the expansion hold component P2 is set to 2.0 μs, respectively, it can be understood that a liquid drop of approximately 11.8 ng can be discharged. Further, if the driving voltage is set to 26.2 V and the duration of an expansion hold component P2 is set to 3.0 μs, respectively, it can be understood that a liquid drop of approximately 13.8 ng can be discharged. Furthermore, if the driving voltage is set to 29.8 V and the duration of an expansion hold component P2 is set to 3.5 μs, respectively, it can be understood that a liquid drop of approximately 15.9 ng can be discharged.

Further, if the driving voltage and the duration of the expansion hold component P2 are appropriately set, it is possible to change the flying speed of liquid drops while the discharge amount of liquid drops is kept constant.

For example, if the weight of a liquid drop is set to 15 ng, the relationship among the driving voltage, the duration of the expansion hold component P2 and the flying speed of the liquid drop are shown in FIG. 13(*b*). Referring to FIG. 13(*b*), if the driving voltage is set to 26.2 V and the duration of the expansion component P1 is set to 2.0 μs, respectively, it can be understood that the flying speed of a liquid drop can be set to approximately 10.8 m/s. Further, if the driving voltage is set to 28.0 V and the duration of the expansion hold component P1 is set to 3.0 μs, respectively, it can be understood that the flying speed of a liquid drop can be set to approximately 8.0 m/s. Furthermore, if the driving voltage is set to 28.0 V and the duration of the expansion component P1 is set to 3.5 μs, respectively, it can be understood that the flying speed of a liquid drop can be set to approximately 6.3 m/s.

In this manner, if the driving voltage, the intermediate potential VM, the duration of expansion component P1 and the duration of an expansion hold component P2 are appropriately set for respective standard driving pulses PS1 to PS3, it is possible to control the flying speed or weight of a liquid drop. Therefore, a desired amount of a liquid drop can be discharged at a desired speed. As a result, it becomes possible to improve accuracy in the hitting (application) position and discharge amount of liquid drops at the same time.

Next, a description will be made of respective micro-driving pulses PS4 to PS6.

Figure 16A:
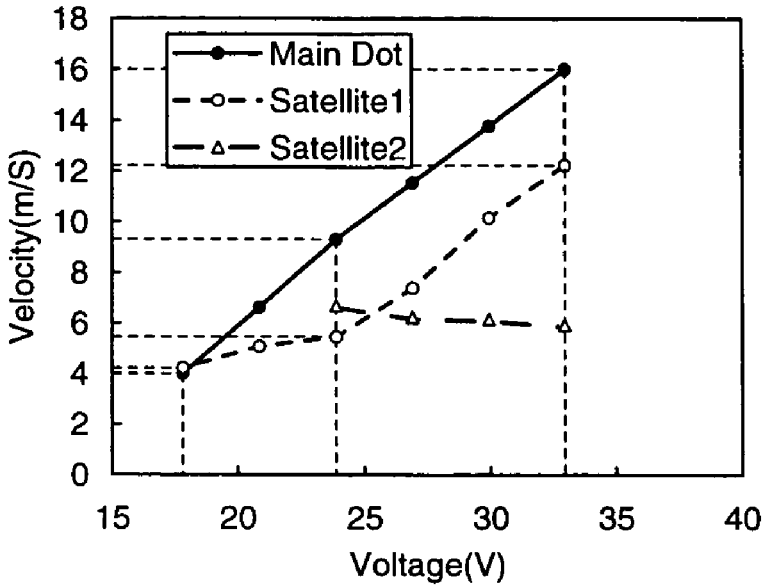
FIG. 16 illustrates a variation in discharge characteristics when an adjustment is made to driving voltage in a micro-driving pulse.
Figure 16B:
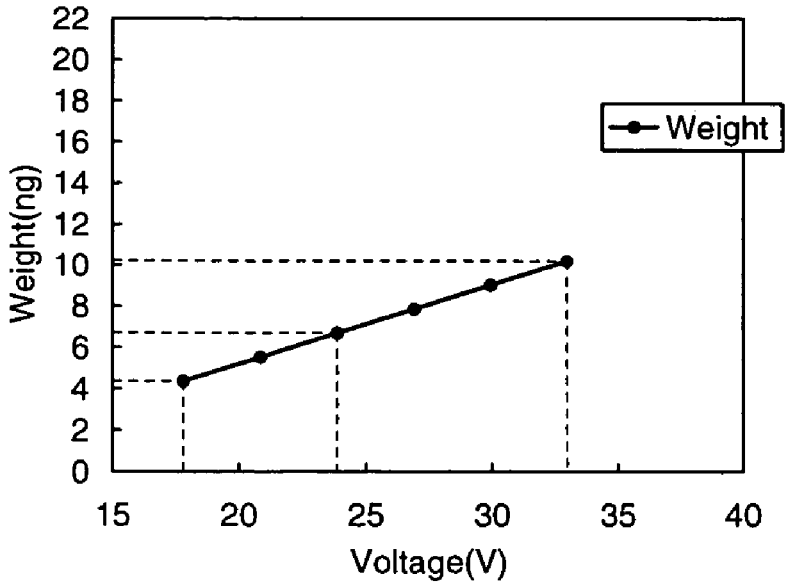

First, a description will be made of a change in the discharge characteristics when a change is made in the driving voltage. At this time, FIG. 16 illustrates a change in the discharge characteristics when an adjustment is made in the driving voltage: FIG. 16(*a*) illustrates a change in the flying speed of liquid drops when a change is made in the driving voltage; and FIG. 16(*b*) illustrates a change in the weight of liquid drops when a change is made in the driving voltage. Furthermore, in FIG. 16(*a*), a solid line having black circles indicates main liquid drops; a dotted line having white circles indicates satellite liquid drops; and a broken line having triangles indicates second satellite liquid drops.

As can be understood from FIG. 16, within the measurement range, the relationship among the magnitude of driving voltage and the flying speed and weight of liquid drops are in proportion (coefficient is positive). In other words, if the driving voltage increases, the flying speed of liquid drops (main liquid drops) and the weight of the liquid drops increase at the same time. For example, if the driving voltage is 18 V, the flying speed of a main liquid drop is approximately 4 m/s and the weight thereof is approximately 4.4 ng. Further, if the driving voltage is 24 V, the flying speed of a main liquid drop is approximately 9.0 m/s and the weight thereof is approximately 6.8 ng. Furthermore, if the driving voltage is 33 V, the flying speed of a main liquid drop is approximately 16 m/s and the weight thereof is approximately 10.2 ng. It is considered to be because there is a change in the variation range in the volume of the pressure chamber 47 due to an increase or decrease in the driving voltage, with the same reason for the standard driving pulses PS1 to PS3. Accordingly, it can be understood that the flying speed and the discharge amount of liquid drops are increased and decreased at the same, time by setting the driving voltage even for these micro-driving pulses.

Furthermore, referring to FIG. 16(*a*), if the driving voltage is set to 18 V, a liquid drop is divided into a main liquid drop and a satellite liquid drop for flight. Furthermore, if the driving voltage is set to over 24 V, second satellite liquid drop appears in addition to the satellite liquid drop. For the micro-driving pulses PS4 to PS6, the satellite liquid drop has a higher speed along with an increase of driving voltage. However, the second satellite liquid drop has an approximately constant flying speed (6 to 7 m/s).

Next, a description will be made of a relationship between the intermediate potential VM of respective micro-driving pulses PS4 to PS6 and the discharge characteristics of liquid drops.

For the micro-driving pulses PS4 to PS6, the intermediate potential VM defines the normal volume of the pressure chamber 47. Accordingly, the expansion margin can be set from the normal volume to the maximum volume by a change in the intermediate potential VM. Also, a change of the expansion margin can set the amount of the meniscus to be drawn into the pressure chamber 47 when the second expansion component P11 is supplied. Furthermore, the duration of the second expansion component P11 is constant, so that there can be a change in the speed of the meniscus being drawn into the pressure chamber 47 if there is a change in the expansion margin.

It is considered that the amount and speed of a drawn-in meniscus affect the discharge amount of liquid drops. In other words, if the amount of the meniscus being drawn into the pressure chamber is greater than the reference value, the amount of liquid material to be discharged as a liquid drop gets smaller than the reference value. On the contrary, if the amount of the meniscus being drawn into the pressure chamber is smaller than the reference value, the amount of liquid material to be discharged as a liquid drop gets greater than the reference value. If the drawn-in speed of the meniscus is higher than the reference value, the moving speed of the central part of the meniscus gets higher than the reference value by the reaction. As a result, the flying speed of a liquid drop gets higher than the reference value. However, if the drawn-in speed of the meniscus is lower than the reference value, the reaction gets smaller, thereby making the moving speed of the central part of the meniscus and the flying speed of a liquid drop lower than the reference value.

Figure 17A:
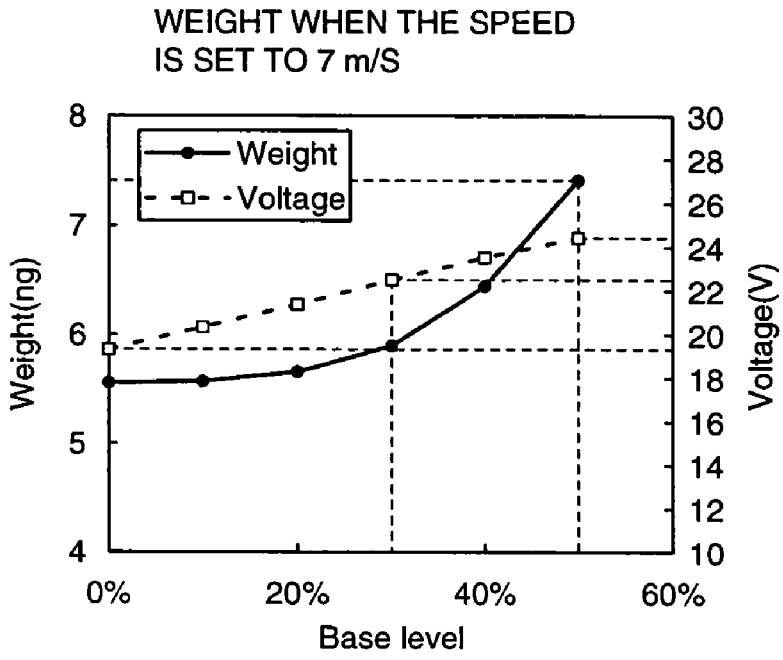
FIG. 17(*a*) illustrates a relationship among driving voltage, intermediate potential and weight of liquid drops when the flying speed of the liquid drops is set to 7 m/s in a micro-driving pulse, and FIG. 17(*b*) illustrates a relationship among driving voltage, intermediate potential and flying speed of liquid drops when the weight of the liquid drops is set to 5.5 ng.
Figure 17B:
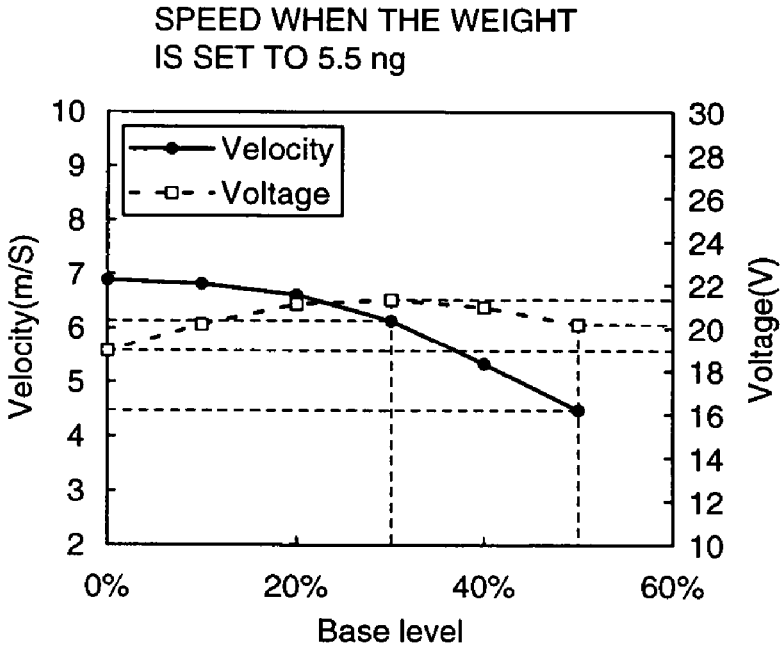

Accordingly, if the driving voltage and the intermediate potential VM are appropriately set, it is possible to change the discharge amount of liquid drops while the flying speed of liquid drops is kept constant. For example, if the flying speed of a liquid drop is set to 7 m/s, the relationship among the driving voltage, the intermediate potential VM and the weight of liquid drops are as shown in FIG. 17(*a*). Referring to in FIG. 17(*a*), if the driving voltage is set to 19.5 V and the intermediate potential VM is set to 0% of the driving voltage (that is, the potential identical to the minimum potential VL), respectively, it can be understood that a liquid drop of approximately 5.6 ng can be discharged. Further, if the driving voltage is set to 22.5 V and the intermediate potential VM is set to 30% of the driving voltage, respectively, it can be understood that a liquid drop of approximately 5.9 ng can be discharged. If the driving voltage is set to 24.5 V and the intermediate potential VM is set to 50% of the driving voltage, respectively, it can be understood that a liquid drop of approximately 7.5 ng can be discharged.

Further, if the driving voltage and the intermediate potential VM are appropriately set, it is possible to change the flying speed of liquid drops while the discharge amount of liquid drops is kept constant. For example, if the weight of a liquid drop is set to 5.5 ng, the relationship among driving voltage, intermediate potential VM and the flying speed of liquid drops are as shown in FIG. 17(*b*). Referring to FIG. 17(*b*), if the driving voltage is set to 19.0 V and the intermediate potential VM is set to 0% of the driving voltage, respectively, it can be understood that the flying speed of a liquid drop can be set to approximately 6.9 m/s. Further, if the driving voltage is set to 21.5 V and the intermediate potential VM is set to 30% of the driving voltage, respectively, it can be understood that the flying speed of a liquid drop can be set to approximately 6.2 m/s. Furthermore, if the driving voltage is set to 20.2 V and the intermediate potential VM is set to 50% of the driving voltage, respectively, it can be understood that the flying speed of a liquid drop can be set to approximately 4.5 m/s.

Next, a description will be made of the relationship between the discharge potential VF (the termination potential of the second discharge component P13) of respective micro-driving pulses PS4 to PS6 and the discharge characteristics of liquid drops.

The discharge potential VF defines the discharge volume of the pressure chamber 47 (the volume when the supply of the second discharge component P13 is finished). Accordingly, if a change is made in the discharge potential VF, it is possible to set the contraction amount of the pressure chamber from the maximum volume to the discharge volume. Further, if the duration of the second discharge component P13 is constant, a change of the discharge potential VF can change the contraction speed. In other words, if the discharge potential VF is set lower than the reference value, the contraction speed gets higher. On the contrary, the discharge potential VF is set higher than the reference value, the contraction speed gets lower.

The contraction amount and speed of the pressure chamber 47 are considered to affect the discharge amount of liquid drops. In other words, if the contraction amount of the pressure chamber 47 is greater than the reference value, the discharge amount of liquid drops gets greater than the reference value. If the contraction amount is smaller than the reference value, the discharge amount of liquid drops gets smaller than the reference value. Further, if the contraction speed is higher, the flying speed of liquid drops gets higher. On the contrary, if the contraction speed is lower, the flying speed gets lower.

Furthermore, in this case, the change amount of the flying speed and that of the discharge amount caused by the change of the discharge potential VF differ from those when a change is made in the driving voltage. Accordingly, if the driving voltage and the discharge potential VF are appropriately set, it is possible to change the discharge weight while the flying speed of liquid drops is kept constant.

Figure 18A:
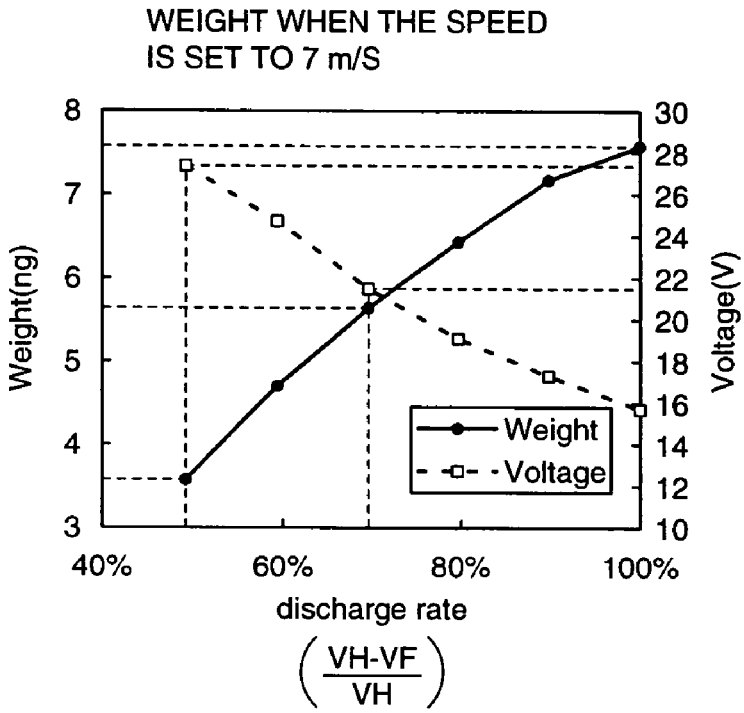
FIG. 18(*a*) illustrates a relationship among driving voltage, discharge potential and weight of liquid drops when the flying speed of the liquid drops is set to 7 m/s in a micro-driving pulse, and FIG. 18(*b*) illustrates a relationship among driving voltage, discharge potential and flying speed of liquid drops when the weight of the liquid drops is set to 5.5 ng.
Figure 18B:
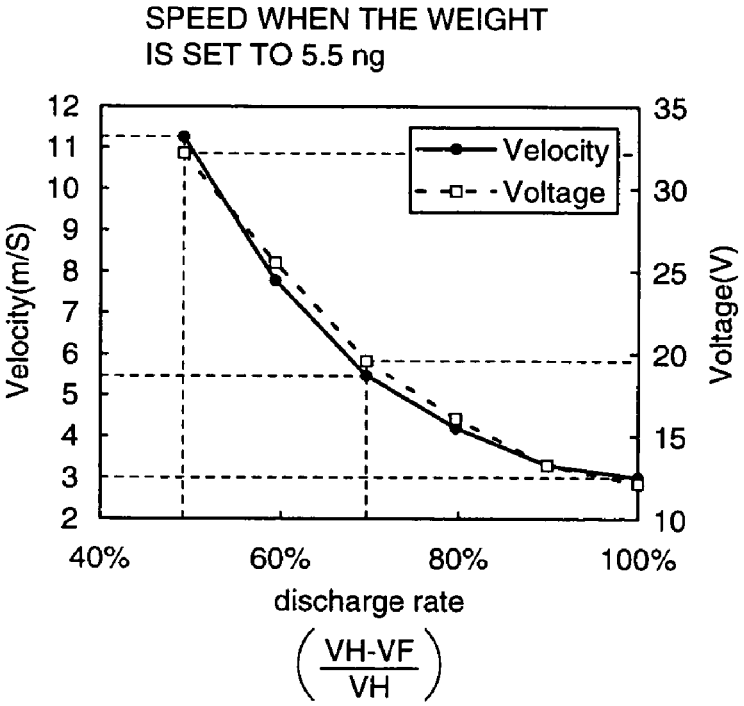

For example, if the flying speed of a liquid drop is set to 7 m/s, the relationship among driving voltage, discharge potential VF and the weight of liquid drops are shown in FIG. 18(*a*). Referring to FIG. 18(*a*), if the driving voltage is set to 27.0 V and the potential of the second discharge component P13 is set to 50% of the driving voltage (that is, the discharge potential VF is 13.5 V lower than the maximum potential VH), respectively, it can be understood that a liquid drop of approximately 3.6 ng can be discharged. Furthermore, if the driving voltage is set to 21.3 V and the potential of the second discharge component P13 is set to 70% of the driving voltage, respectively, it can be understood that a liquid drop of approximately 5.6 ng can be discharged. Furthermore, if the driving voltage is set to 16.6 V and the potential of the second discharge component P13 is set to 100% of the driving voltage (that is, the discharge potential VF is identical to the minimum potential VL), respectively, it can be understood that a liquid drop of approximately 7.6 ng can be discharged. Moreover, of the potential of the second discharge component P13 is set to 100% of the driving voltage, the contraction damping component P15 is not set.

Further, if the driving voltage and the discharge potential VF are appropriately set, it is possible to change the flying speed of liquid drops while the discharge amount of liquid drops is kept constant.

For example, if the weight of a liquid drop is set to 5.5 ng, the relationship among the driving voltage, the discharge potential VF and the flying speed of liquid drops are as shown in FIG. 18(*b*). Referring to FIG. 18(*b*), if the driving voltage is set to 32.0 V and the potential of the second discharge component P13 is set to 50% of the driving voltage, respectively, it can be understood that the flying speed of a liquid drop can be set to approximately 11.2 m/s. Further, if the driving voltage is set to 19.5 V and the potential of the second discharge component P13 is set to 70% of the driving voltage, respectively, it can be understood that the flying speed of a liquid drop can be set to approximately 5.5 m/s. Furthermore, if the driving voltage 12.0 V and the potential of the second discharge component P13 are set to 100% of the driving voltage, respectively, it can be understood that the flying speed of a liquid drop can be set to approximately 3.0 m/s.

Similarly, for respective micro-driving pulses PS4 to PS6, if the driving voltage, the intermediate potential VM and the discharge potential VF are appropriately set, it is possible to control the discharge amount or flying speed of a liquid drop.

Accordingly, the waveform information of the main controller 31 (pulse shape setting means) can set the waveform of respective driving pulses PS1 to PS6, and the driving pulses PS1 to PS6 set as such are then supplied to the piezoelectric vibrators 21. As a result, the desired amount of liquid drops can be discharged at the desired speed. Accordingly, the predetermined amount (target amount) and short amount of liquid drops can be discharged to each pixel region 12*a* by the same injection head 7 (identical nozzle openings 25).

Further, if the flying speed of liquid drops can be set, different amounts of liquid drops can be flied (ejected) at the same speed. Therefore, the scanning speed of injection head 7 can arrange the hitting (application) positions of liquid drops while it is kept constant. As a result, the hitting positions of liquid drops can be accurately controlled without any complex control.

Furthermore, since an extremely small amount of liquid drops having the weight of approximately 4 ng of one liquid drop are easily affected by viscosity resistance of air, the hitting positions of liquid drops can be controlled in greater precision when consideration is taken into the amount of liquid drops lost by the viscosity of air. In the present embodiment, the waveform of driving pulses is set to thereby make it possible to change the flying speed while the amount of liquid drops is kept constant. Therefore, even for the extremely small amount of liquid drops described above, it is possible to control the discharge operation of liquid drops, just like when the weight of one liquid drop is greater than 10 ng, by setting the waveform. As a result, it is possible to facilitate the control.

Next, a description will be made of a method for manufacturing a color filter 2. FIG. 19 is a flowchart illustrating a color filter manufacturing process, and FIG. 20 is a mimetic cross-sectional view of a color filter 2 (filter substrate 2) according to the embodiment of the present invention, which illustrates the manufacturing process in sequence.

Figure 20:
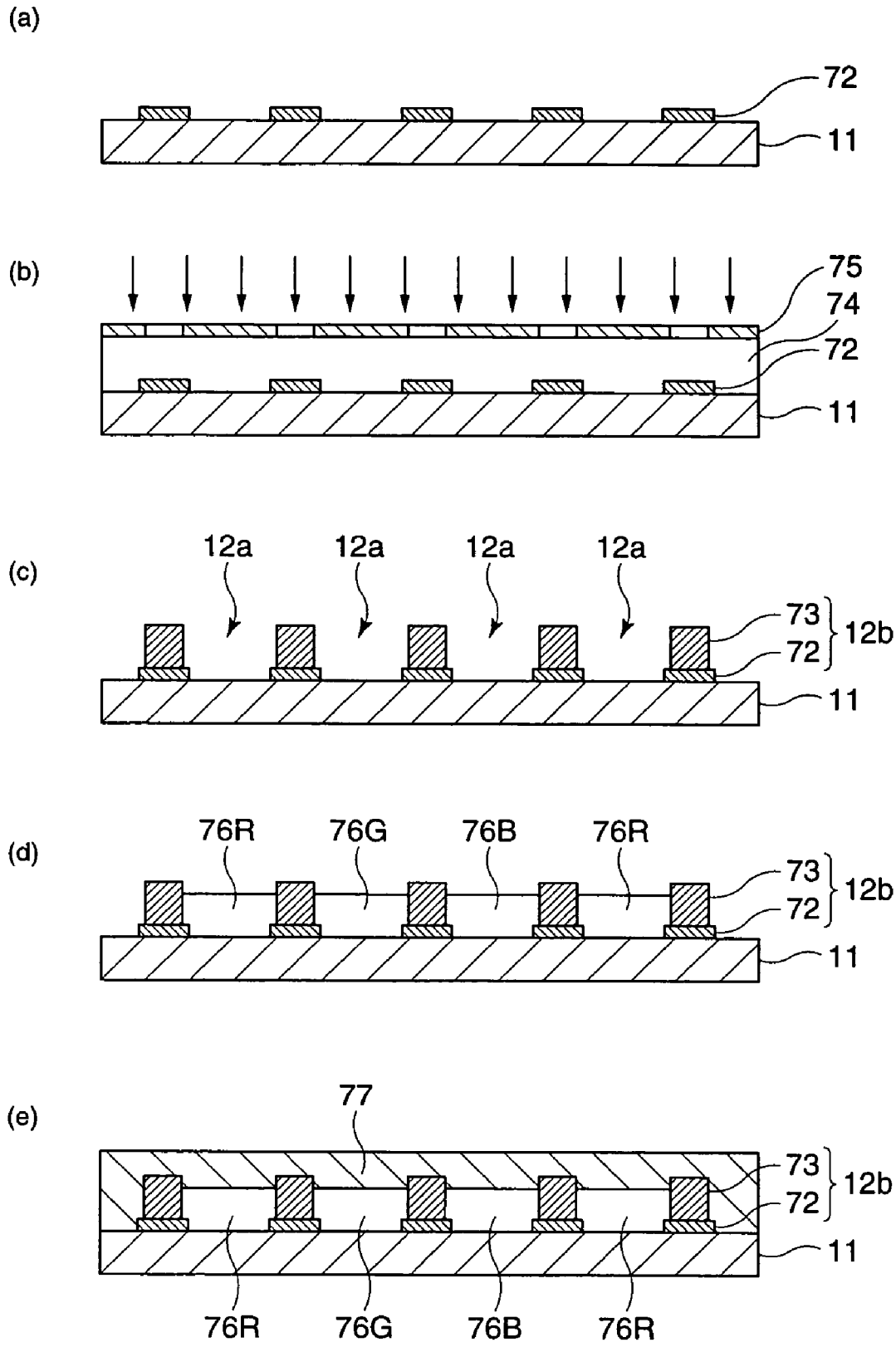
FIGS. 20(*a*) to (*e*) are mimetic cross-sectional views of a color filter illustrating the sequential steps of a color filter manufacturing process.

First, in a black matrix formation step (S1), as shown in FIG. 20(*a*), black matrixes 72 are formed on a substrate 11. The black matrixes 72 are formed by metal chromium, a lamination of metal chromium and chromium oxide, resin black, etc. If the black matrixes 72 are made of a thin metal film, a sputtering or vapor deposition method can be used. If the black matrixes 72 are made of a thin resin film, a gravure printing method, a photo-resist method or a heat transfer method can be used.

Subsequently, in a bank formation step (S2), banks 73 are formed in a state of being superposed on the black matrixes 72. In other words, as shown in FIG. 20(*b*), a resist layer 74 made of negative, transparent, and photosensitive resin is formed to cover the substrate 11 and the black matrixes 72. Then, a photo-exposure treatment is performed in a state that the top surface of the resist layer is covered with on a mask film 75 formed in a matrix pattern.

Furthermore, as shown in FIG. 20(*c*), non-exposed parts of the resist layer 74 are etched out to pattern the resist layer 74, thereby forming banks 73. Moreover, when black matrixes are formed by resin black, it can be used as both the black matrixes and the banks.

The banks 73 and the underlying black matrixes 72 serves as partition walls 12*b* to partition each pixel region, and defines hit (applied) regions of ink drops when colored layers 76R, 76G and 76B are formed by the injection head 7 in a subsequent colored layer formation step.

The filter substrate 2' can be obtained through the black matrix formation step and the bank formation step.

Furthermore, in the present embodiment, a resin making a coated film surface ink-phobic is utilized as a material of the banks 73. Also, the glass substrate (substrate 11) has an ink-philic property, so that it can improve the precision for the hitting position of liquid drops in each pixel region 12*a* surrounded with the banks 73 (or partition walls 12*b*) in the colored layer formation step.

Next, in the colored layer formation step (S3), as shown in FIG. 20(*d*), ink drops are discharged by the injection head 7 and applied into each pixel region 12*a* surrounded with the partition walls 12*b*. Thereafter, the three colored layers 76R, 76G, 76B are formed by the drying treatment in sequence. The colored layer formation step will be described below in detail with reference to FIG. 21.

After the formation of the colored layers 76R, 76G, 76B, the flow proceeds to a protective film formation step (S4), where a protective film 77 is formed to cover the top surfaces of the substrate 11, partition walls 12*b* and colored layers 76R, 76G, 76B, as shown in FIG. 20(*e*).

In other words, after coating liquid for a protective film is discharged all over the surfaces where the colored layers 76R, 76G, 76B of the substrate 11 are formed, a drying treatment is performed to form a protective film 77.

After the formation of the protective film 77, color filters 2 are obtained by cutting the substrate 11 at individual effective pixel regions.

Figure 21:
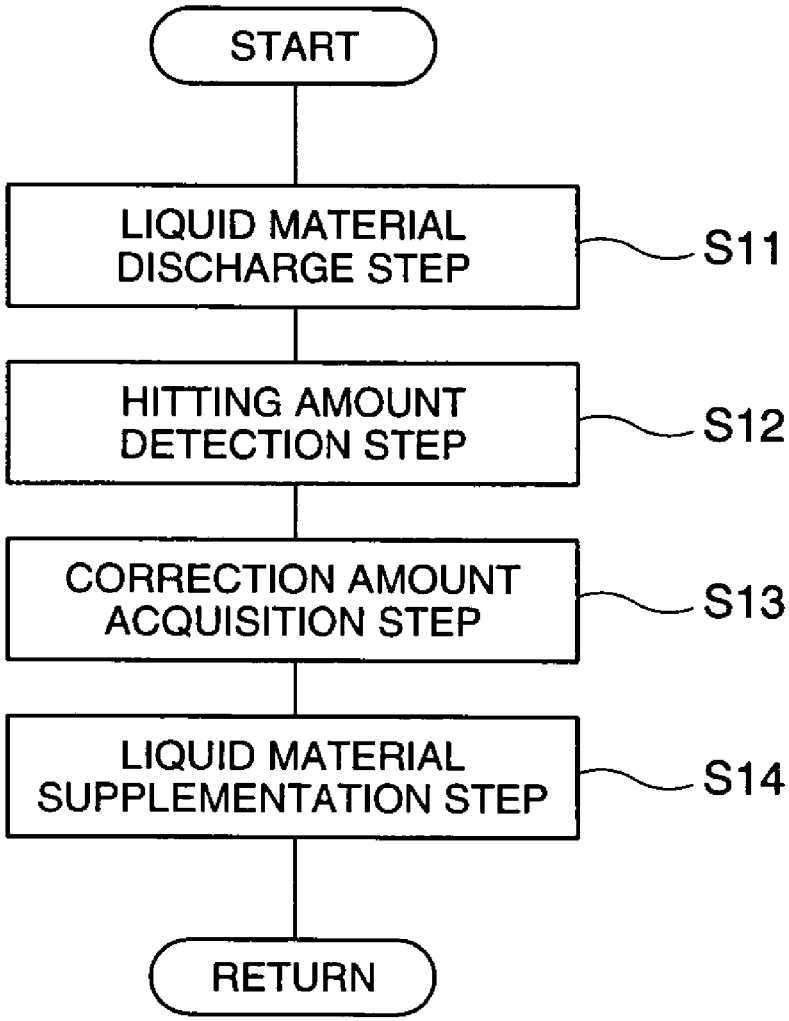
FIG. 21 is a flowchart illustrating a colored layer formation step.

Next, the colored layer formation step will be further described in detail. As shown in FIG. 21, the colored layer formation step comprises: a liquid material discharge step (S11), a hitting (application) amount detection step (S12), a correction amount acquisition step (S13) and a liquid material supplementation step (S14), and these steps are performed in sequence.

In the liquid material discharge step (S 11), the liquid drops (ink drops) of the predetermined colors, for example, R, G and B are driven into each pixel region 12*a* of the substrate 11. In this step, the main controller 31 as pulse shape setting means generates waveform information (DAT) to generate the standard driving pulses PS1 to PS3, and driving signals generator 32 as driving pulse generating means generates standard driving pulses on the basis of the waveform information. Also, the main controller (main control means) generates movement control information (DRV1) to output it to the carriage motor 6, and generates control signals for the injection head 7 to output them to the injection head 7. As a result, the main scanning is performed. In other words, as soon as the guide bar 4 is moved in the main scanning direction (in the direction of X-axis) by the operation of the carriage motor 6, the predetermined colors of ink drops are discharged out of the nozzle openings 25 of the injection head 7.

In this case, in the present embodiment, a waveform of driving pulses is set as described above, so that the discharge amount of ink drops and flying speed thereof can be optimally controlled to thereby cause the predetermined amount of ink drops to be applied to predetermined pixel regions 12*a*.

After the completion of first main scanning, the injection head 7 is moved by a predetermined distance in the sub-scanning direction for the following main scanning. Thereafter, the aforementioned operations are repeatedly performed to drive liquid drops into all the pixel regions 12*a* all over the surface of the substrate 11.

Furthermore, in the liquid material discharge step, the main controller 31 (pulse shape setting means) may generate waveform information (DAT) by addition of detection signals (environment information) generated by the environment condition detecting means such as temperature sensor or humidity sensor. In the structure thus configured, the discharge characteristics of liquid drops can be well managed in spite of a change in the installation environment (temperature and humidity) of the manufacturing apparatus 1.

Further, the main controller 31 (pulse shape setting means) may generate waveform information (DAT) by acquiring physical property information to reveal information on the type of liquid materials to be used, for example, the physical properties such as viscosity or density, and by adding the type information. In the configuration described above, it is possible to generate a waveform of driving pulses suitable to any different kind of liquid material, resulting in a superior generality of the configuration.

In the hitting amount detection step (S12), the amount of ink applied in the liquid material discharge step is detected at every pixel region 12*a* by the liquid material sensor 17 as liquid material amount detecting means. In other words, in the hitting amount detection step (S12), the amount of hitting (applied) ink in which nonuniformity may occur by a difference in the characteristics of respective nozzle openings or a bad discharge of ink drops are detected at every pixel region 12*a*.

In the above step, the main controller 31 (main control means) moves the carriage 5 by outputting movement control information (DRV1) to the carriage motor 6 and then outputs light emission control information (DRV2) to the laser-light emitting element 18, to thereby illuminate a desired pixel region 12*a* with laser light Lb. The laser light Lb is reflected on the placing surface 3*a* as a light-reflecting surface and then received by a laser-light receiving element 19. Then, the laser-light receiving element 19, which has received the reflected laser light Lb outputs a detection signal having a voltage level according to the quantity of received light (the intensity of received light) to the main controller 31. The main controller 31 determines the amount of applied ink from the detection signal (the quantity of received light in the laser-light receiving element 19) outputted from the laser-light receiving element 19.

The amount of applied ink is determined for all pixel regions 12*a*. In other words, after the amount of applied ink for one pixel region 12*a* is detected, the amount of applied ink for the next pixel region 12*a* is detected. After the amount of applied ink is detected for all the pixel regions 12*a* in such a manner, the detection step is completed. Moreover, the acquired amount of applied ink is stored in, for example, in RAM (hitting (applied) liquid material amount storage means, not shown) of the main controller 31 in relation to the position information of the pixel regions 12*a*.

In the correction amount acquisition step (S13), the amount of applied ink for each pixel region 12*a* detected by the hitting amount detection step is compared with the target ink amount (a type of target liquid material amount in the present invention) for the corresponding pixel region 12*a*, thereby acquiring as the correction amount, a difference between the applied ink amount and the target ink amount. At this time, the target ink amount in the present embodiment is regarded as the applied ink amount of a pixel region 12*a* where the applied amount of ink is the greatest. In other words, a maximum value of the applied ink amount detected by the hitting amount detection step is set as the target ink amount and stored in RAM (target liquid material amount storage means, not shown) of the main controller 31. Moreover, the target ink amount can be commonly or separately set with colors (R, G, and B).

In the above step, the main controller 31 functions as a type of short amount acquiring means of the present invention. For example, the main controller 31 reads the applied ink amount and target ink amount stored in RAM, and acquires a difference between the applied ink amount and the target ink amount by calculation. Furthermore, the information on the acquired difference in the ink amount is stored in RAM (equivalent to excess or short amount storage means, not shown) of the main controller 31 as the short amount information (equivalent to a type of excess or short amount of liquid material in the present invention) in relation with the position information of the liquid material regions (pixel regions 12*a*).

In the liquid material supplementation step (S14), the injection head 7 is positioned to the pixel region 12*a* where the applied ink amount is less than the target ink amount, and the waveform of driving pulses (for example, micro-driving pulses PS4 to PS6) according to the shortage of the applied ink amount is supplied to the piezoelectric vibrators 21 to thereby supplement ink to the corresponding pixel region 12*a*.

In other words, in the above step, the main controller 31 first recognizes a pixel region 12*a* that requires the supplementation of ink by the reading of information on the short amount of ink from RAM. Next, for the pixel region 12*a* requiring supplementation of ink, driving pulses for discharging the short amount of ink are set. In other words, the waveform information is set. Furthermore, the set waveform information is stored in RAM (equivalent to supplementation pulse setting information storage means not shown) of the main controller 31, as supplementation pulse setting information, in relation with the position information of the pixel regions 12*a*.

If the supplementation pulse setting information is stored for all pixel regions 12*a* requiring the supplementation of ink, the main controller 31 controls the supplementation of ink. In other words, the injection head 7 is positioned to the pixel region 12*a* for ink to be supplemented by controlling the carriage motor 6. Then, the waveform information (supplementation pulse setting information) is outputted to the driving signal generator 32, and the short amount of liquid drops are discharged and applied to the relevant pixel regions 12*a*.

If ink is completely supplemented for the pixel region 12*a*, the injection head 7 is moved to the next pixel region 12*a* to supplement ink in a similar ink-supplementing sequence. Then, when the supplementation of ink is completed for all the pixel regions 12*a* for ink to be supplemented, the ink supplementation step is completed.

If the series of steps (that is, the colored layer formation step) are completed, ink liquid is fixed in the pixel regions 12*a* by a heating treatment, etc., to thereby form the colored layers 76. Thereafter, the completely fixed filter substrate 2' is transported to the following step (that is, a protective film formation step).

Furthermore, in the present embodiment, although the same injection head 7 discharges the respective colors (R, G, B) of ink, a plurality of (three) injection heads corresponding to the respective colors may be arranged on a manufacturing line to separately discharge the colors of ink. In this configuration, the drying step is carried out after the drawing of the first color, and then the drawing of the second color is performed. Then, the drying step is carried out similar to the treatment of the first color, and then the drawing of the third color is performed. After the drawing of the third color, the drying step is carried out, and the last main drying treatment is carried out. Various colors of the color filters are completely dried by the main drying treatment.

On the other hand, although an example configured for supplementing the shortage of applied ink has been described in the above, the scope of the present invention is not limited to such construction. For example, in the case that a designed value of the applied ink amount is used as the target ink amount and an ink amount exceeding the designed value is applied, the coloring component decomposing means may be operated according to the excess ink amount to thereby decompose the excess amount of ink (coloring component). Hereinafter, a modified example thus constructed will be explained.

Figure 22:
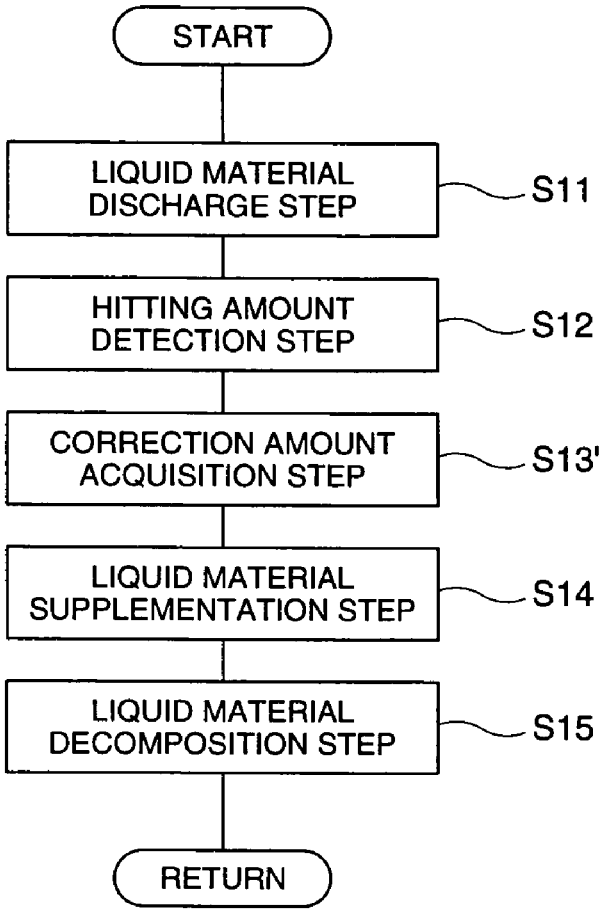
FIG. 22 is a flowchart illustrating a modified example of a colored layer formation step.
Figure 23:
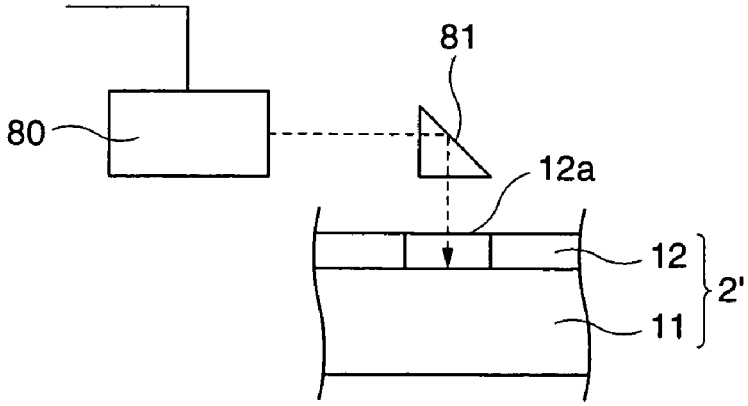
FIG. 23 is a mimetic diagram illustrating an excimer laser light source.

FIGS. 22 and 23 illustrate the modified example of the present invention. FIG. 22 is a flowchart illustrating a colored layer formation step, and FIG. 23 is a mimetic diagram illustrating a type of the coloring component decomposing means, an excimer laser light source 80. Further, since a basic configuration of the manufacturing apparatus 1 in the modified example is similar to that of the above embodiment, a detailed description thereof will be omitted.

The modified example is characterized by comprising an excimer laser light source as a coloring component decomposing means. As used herein, the term 'excimer' means an unstable dimer including two atoms or molecules of the same kind, one atom or molecule being in a ground state and the other being in an excited state, and 'excimer laser light' means laser light which utilizes light emitted when the excimer is dissociated and transited to the ground state.

The excimer laser light is an ultraviolet light having a high level of energy with an effect of cutting the molecular bondage of the coloring component (pigment) in ink liquid. Therefore, the coloring component can be decomposed, and the depth of color can be made thin. Further, it also has a function of preventing scattering of ink or damage of the filter substrate. Moreover, in the excimer laser light, the output and the illumination pulse number (time) can be controlled to adjust the decomposing amount of the color component.

After the excimer laser light is, for example, illuminated by an excimer laser light source 80, it illuminates each pixel region 12*a* through the prism 81. Furthermore, the excimer laser light source 80 is electrically connected to the main controller 31 such that the operation thereof can be controlled. In other words, the main controller 31 controls the output of the excimer laser light and the number of illuminating pulses.

Hereinafter, a description will be made of a coating step in the present embodiment. Moreover, the description will be made mainly about the difference from the above embodiment, and the detailed description about the contents identical to the above embodiment will be omitted.

As illustrated in FIG. 22, the coating step comprises a liquid material discharge step (S11), a hitting (applied) amount detection step (S12), a correction amount acquisition step (S13), a liquid material supplementation step (S14) and a liquid material decomposition step (S 15), and these step are performed in sequence.

In the liquid material discharge step (S11), a predetermined color and amount of ink drops is driven into each pixel region 12*a* on the substrate 11. This step is performed in the same way as that of the above embodiment. In other words, as soon as the guide bar 4 is moved in the main scanning direction (in the direction of X-axis) by the operation of the carriage motor 6, the predetermined colors of ink drops are discharged out of the nozzle openings 25 of the injection head 7.

In the hitting amount detection step (S12), the amount of applied ink is detected at every pixel region 12*a*. This step is also carried out in the same way as that of the above embodiment. For example it is performed by the liquid material sensor 17. Then, the acquired amount of applied ink is stored in RAM (equivalent to hitting (applied) liquid material amount storage means, not shown) of the main controller 31 in relation to the position information of the pixel regions 12*a*. Furthermore, in the present embodiment, the liquid material sensor 17 also functions as a type of liquid material amount detecting means.

In the correction amount acquisition step (S13), the amount of applied ink for each pixel region 12*a* detected by the hitting amount detection step is compared with the target ink amount (a type of target liquid material amount in the present invention) for the corresponding pixel region 12*a*, thereby acquiring a difference between the applied ink amount and target ink amount as the correction amount. At this time, the target ink amount in the present embodiment is used as the designed value of the applied ink amount, which is stored in RAM (equivalent to the target liquid material amount storage means, not shown) of the main controller 31.

In the above step, the main controller 31 (a type of short amount acquiring means or a type of excess amount acquiring means in the present invention) reads the applied ink amount and the target ink amount stored in RAM, and acquires a difference between the applied ink amount and the target ink amount by calculation. Furthermore, the information on the acquired difference in the applied ink amount is stored in RAM (equivalent to an excess or short amount storage means, not shown) of the main controller 31 as the excess or short ink amount information (a type of excess or short amount of liquid material in the present invention) in relation with the position information of the pixel regions 12*a*.

In the liquid material supplementation step (S4) similar to that of the above embodiment, the injection head 7 is positioned on the pixel region 12*a* where the applied ink amount is less than the target ink amount, and the waveform of driving pulses according to the shortage of the applied ink amount is supplied to the piezoelectric vibrators 21 to thereby supplement ink to the corresponding pixel region 12*a*.

In the liquid material decomposition step (S5), the excimer laser light illuminates a pixel region 12*a*, where the applied ink amount exceeds the target ink amount, to thereby decompose the excess amount of coloring component. In this case, the main controller 31 also functions as a laser light illumination controlling means to illuminate a desired pixel region 12*a* with laser light by the movement of the prism 81. Further, the main controller 31 functions as a decomposition amount controlling means to control the output of the excimer laser light and the number of illuminating pulses according to the excess amount and to decompose the required amount of the coloring component.

Furthermore, if the series of steps (that is, the coating step) are completed, a heating treatment, etc., is carried out to fix the coated ink liquid. Thereafter, the filter substrate 2' is transported to the following step.

After the fixation of ink liquid is made by heating step, the liquid material decomposition process may be performed by the excimer laser light.

As described above, in the manufacturing apparatus 1, the applied ink amount is detected for each pixel region 12*a* and it is determined whether the decomposition nor supplementation of ink should be performed, or neither the supplementation nor decomposition need to be performed according to the excess or short amount of applied ink obtained from the difference between the applied ink amount and the target ink amount. In case of supplementation, the driving pulses set according to the short amount of ink drops are supplied to the piezoelectric vibrators 21. On the other hand in case of decomposition, the corresponding pixel region 12*a* is illuminated with the excimer laser light, and the output of the excimer laser light or the illuminating pulse number are controlled according to the excess amount at the same time in order to decompose the required amount of coloring component.

As a result, it is possible to manufacture a high quality of color filters 2 in which every pixel region 12*a* has a designed value of ink density.

Figure 24:
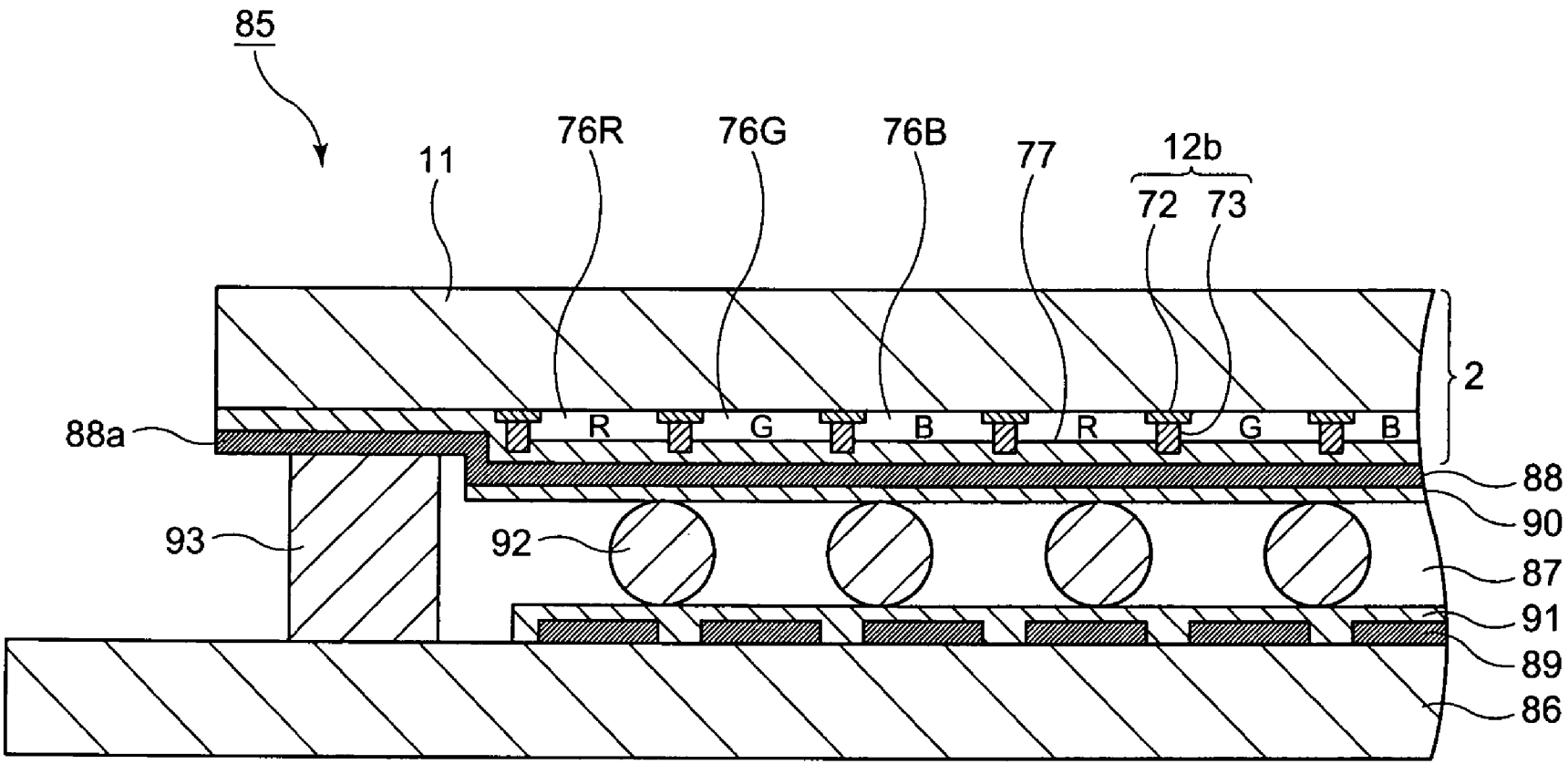
FIG. 24 is a cross-sectional view of parts illustrating a schematic configuration of a liquid crystal device using a color filter to which the present invention is applied.

FIG. 24 is a cross-sectional view of parts illustrating a schematic configuration of a passive matrix type liquid crystal device (simply referred to as a liquid crystal device) as an example of the liquid crystal device using a color filter 2 manufactured according to an embodiment of the present invention. A transmissive liquid crystal display device can be obtained as an end product by mounting additional parts such as liquid crystal driving IC, back light or supporter to the liquid crystal device 85. Furthermore, the color filter 2 is identical to that shown in FIG. 20. Thus, the same reference numerals are given to the corresponding parts, and the description thereof will be omitted.

The liquid crystal device 85 is generally configured with the color filter 2, a counter substrate 86 made of a glass substrate, etc., a liquid crystal layer 87 made of super twisted nematic (STN) liquid crystal composition sandwiched between the color filter 2 and the counter substrate 86. The color filter 2 is arranged at the upper side in the drawing (the observer's side).

Further, although not shown in the drawings, and polarizing plates are respectively arranged at the external surfaces of the counter substrate 86 and the color filter 2 (surfaces opposite to the liquid crystal layer 87).

On the protective film 77 of the color filter 2 (liquid crystal layer side), a plurality of first electrodes 88 are arranged at a predetermined interval in a stripe shape extending lengthwise in the left/right direction in FIG. 24. A first oriented film 90 is formed to cover the surfaces of the first electrodes 88 opposite to the color filter 2.

On the other hand, on the surface of the counter substrate 86 facing the color filter 2, a plurality of second electrodes 89 are arranged at a predetermined interval in a stripe shape extending lengthwise in the direction perpendicular to the first electrodes 88 of the color filter 2. A second oriented film 91 is formed to cover the surfaces of the second electrodes 89 facing the liquid crystal layer 87. The first and second electrodes 88, 89 are made of transparent conductive material such as Indium Tin Oxide (ITO).

Spacers 92 provided in the liquid crystal layer 87 are members to keep the thickness (cell gap) of the liquid crystal layer 87 constant. Further, a sealing material 93 is a member to prevent the liquid crystal composition of the liquid crystal layer 87 from leaking out. Furthermore, ends of the first electrodes 88 are extended to the external side of the sealing material 93 as wiring lines 88*a*.

Also, portions where the first electrodes 88 intersect the second electrodes 89 serve as pixels. It is configured that the colored layers 76R, 76G, 76B of color filter 2 are positioned at the portions as pixels.

Figure 25:
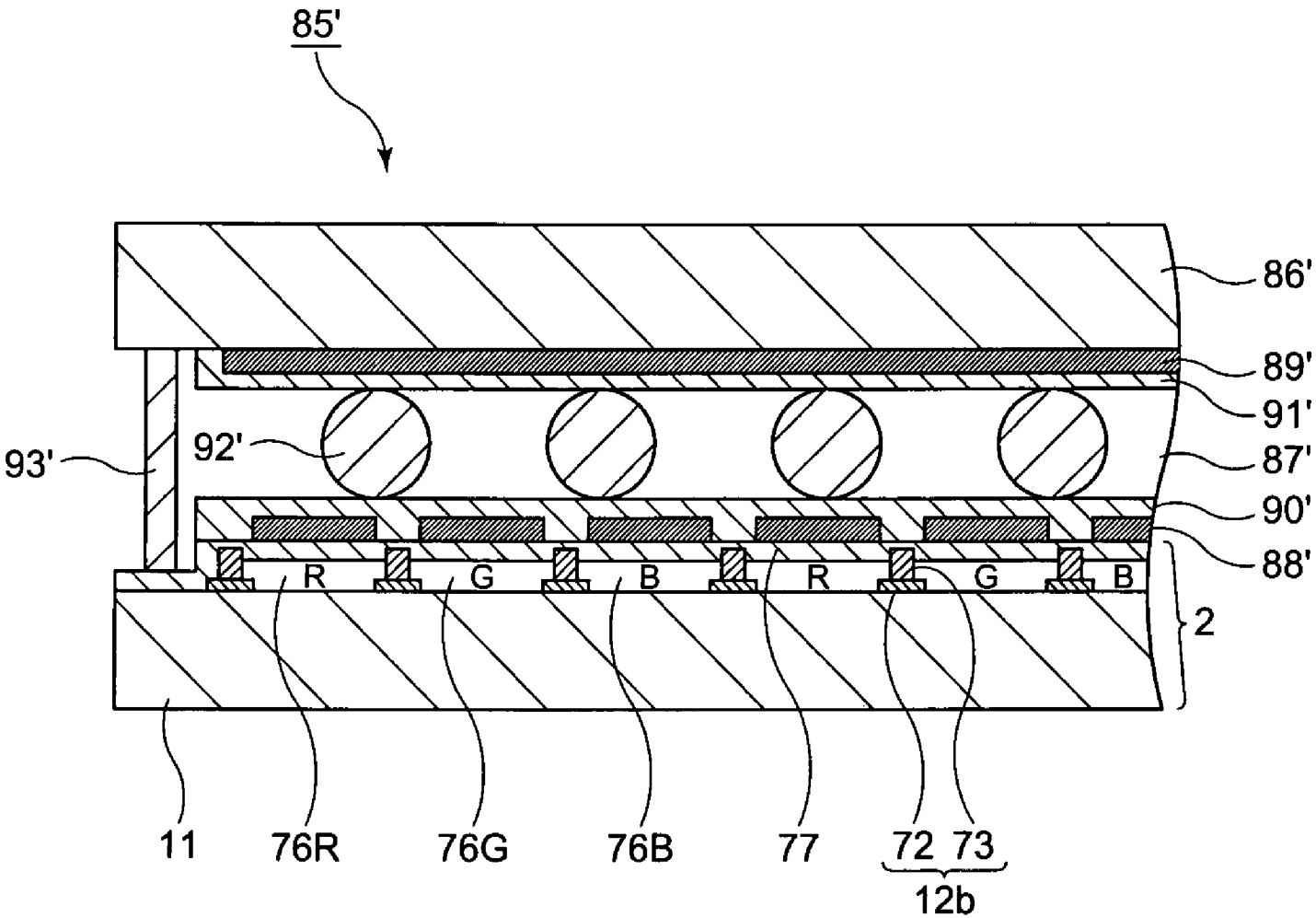
FIG. 25 is a cross-sectional view of parts illustrating a schematic configuration of a second example of a liquid crystal device using a color filter to which the present invention is applied.

FIG. 25 is a cross-sectional view of parts illustrating a schematic configuration of a second example of a liquid crystal device using the color filter 2 manufactured in the present embodiment.

A principle difference between the liquid crystal device 85' and the liquid crystal device 85 is in the arrangement of a color filter 2 at the lower part in the drawing (the side opposite to the observer's side).

The liquid crystal device 85' is generally configured with a liquid crystal layer 87' made of STN liquid crystal sandwiched between the color filter 2 and a counter substrate 86' made of a glass substrate. Further, although not shown in the drawings, polarizing plates are respectively arranged at the external surfaces of the counter substrate 86' and the color filter 2.

On the protective film 77 of the color filter 2 (to the side of the liquid crystal layer 87'), a plurality of first electrodes 88' are arranged at a predetermined interval in a stripe shape extending lengthwise in the direction of depth in the drawing. A first oriented film 90' is formed to cover the surfaces (the side of the liquid crystal layer 87') of the first electrodes 88' opposite to the color filter 2.

On the surface of the counter substrate 86' facing the color filter 2, a plurality of second electrodes 89' are arranged at a predetermined interval in a stripe shape extending lengthwise in the direction perpendicular to the first electrodes 88'. A second oriented film 91' is formed to cover the surfaces of the second electrodes 89' facing the liquid crystal layer 87'.

The liquid crystal layer 87 is provided with spacer 92' to keep the thickness of the liquid crystal layer 87' constant and a sealing material 93' to prevent the liquid crystal composition in the liquid crystal layer 87' from leaking out.

Also, similar to the above mentioned liquid crystal device 85, portions where the first electrodes 88' intersect the second electrodes 89' serves as pixels. It is configured that the colored layers 76R, 76G, 76B of color filter 2 are positioned at the portions as the pixels.

Figure 26:
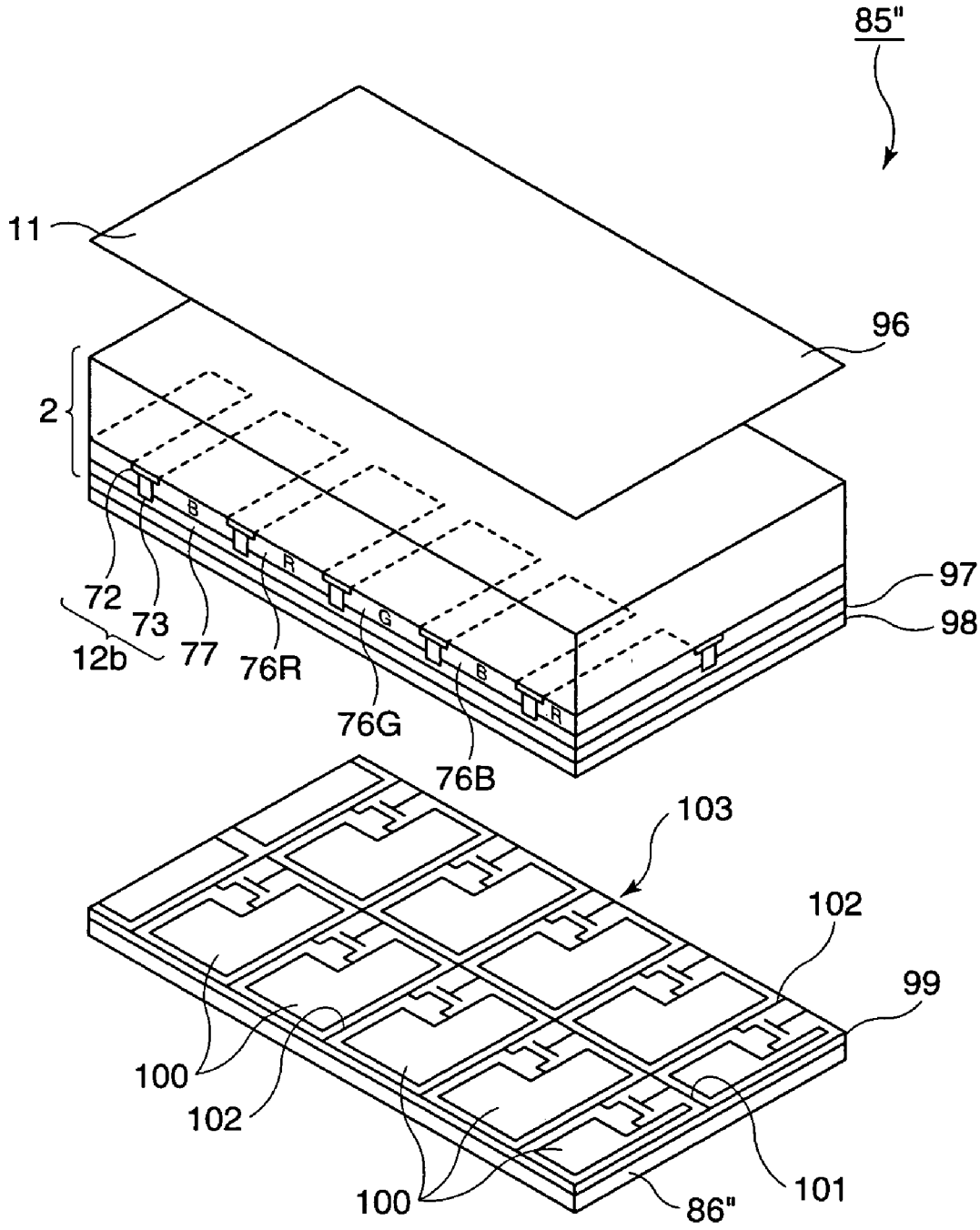
FIG. 26 is an exploded perspective view of parts illustrating a schematic configuration of a third example of a liquid crystal device using a color filter to which the present invention is applied.

FIG. 26 is an exploded perspective view illustrating a schematic configuration of a transmissive thin film transistor (TFT) type liquid crystal device, which is a third example in which a liquid crystal device is configured using a color filter 2 to which the present invention is applied.

In the liquid crystal device 85" a color filter 2 is arranged at the upper part in the drawing (the observer's side).

The liquid crystal device 85" is generally configured with a color filter 2, a counter substrate 86" arranged opposite to the color filter 2, a liquid crystal layer (not shown) sandwiched between the color filter 2 and the counter substrate 86", a polarizing plate 96 arranged at the top surface of the color filter 2 (observer's side) and another polarizing plate (not shown) arranged at the bottom surface of the counter substrate 86".

On the protective film 77 of the color filter 2 (to the side of the counter substrate 86"), liquid crystal driving electrode 97 is formed. The electrode 97 made of transparent conductive material such as ITO is formed into a whole surface electrode to cover all the regions where the pixel electrodes 100 are formed, which will be described later. Further, an oriented film 98 is formed in such a manner to cover the surface of the electrode 97 opposite to the pixel electrodes 100.

An insulating layer 99 is formed on the surface of the counter substrate 86" facing the color filter 2, and these scanning lines 101 and signal lines 102 are formed on the insulating layer 99 in such a manner to intersect each other. And, the pixel electrodes 100 are formed in the region surrounded by these scanning lines 101 and signal lines 102. Furthermore, in an actual liquid crystal device, the oriented film is provided on the pixel electrodes 100, but the illustration thereof is omitted.

Further, thin film transistors 103 each having a source electrode, a drain electrode, a semiconductor and a gate electrode are assembled formed at the corresponding portions surrounded by the scanning lines 101, the signal lines 102 and cut-out portions of pixel electrodes 100. Furthermore, it is configured that the thin film transistor 103 is turned on/off by the application of signals to the scanning lines 101 and the signal lines 102, thereby allowing the application of electrical current to the pixel electrodes 100 to be controlled.

Furthermore, although the liquid crystal devices 85, 85', 85" in the above respective examples are constructed as transmissive ones, a reflective layer or a transflective layer can be provided to construct the liquid crystal device as a reflective or transflective one.

Figure 27:
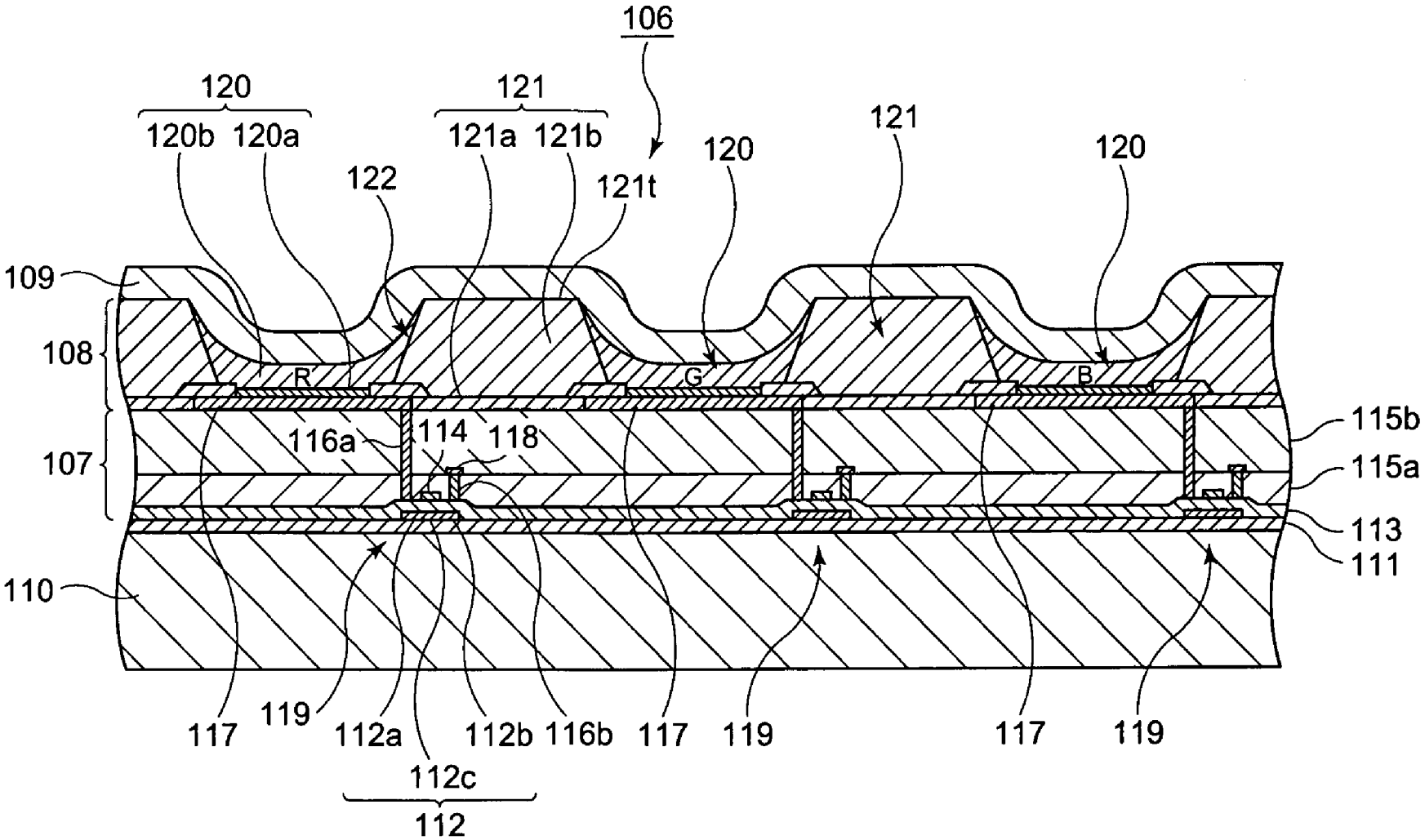
FIG. 27 is a cross-sectional view illustrating parts of a display device according to a second embodiment of the present invention.

Next, a description will be made of a second embodiment of the present invention. FIG. 27 is a cross-sectional view of parts illustrating a display region of an organic EL display device (hereinafter, simply referred to as a display device 106), a type of a display in the present invention.

The display device 106 is generally configured with a circuit element part 107, a light-emitting element part 108 and a cathode 109 laminated on a substrate 110.

In the display device 106, the light emitted from the light-emitting element part 108 to the substrate 110 is transmitted through the circuit element part 107 and the substrate 110 and emitted to the observer's side. On the other hand, the light emitted to the side opposite to the substrate 110 from the light-emitting element part 108 is reflected by the cathode 109, transmitted through the circuit element part 107 and the substrate 110 and emitted to the observer's side.

A base protective film 111 of a silicon oxide film is formed between the circuit element part 107 and the substrate 110, and an island shape of semiconductor films 112, made of polycrystalline silicon, is formed on the base protective film 111 (to the side of light-emitting element part 108). At the left and right regions of each of the semiconductor film 112, a source region 112*a* and a drain region 112*b* are formed by implantation of a high concentration of positive ions. Also, the central part into which positive ions are not implanted becomes a channel region 112*c*.

Further, a transparent gate insulating film 118 is formed in the circuit element part 107 so as to cover the base protective film 111 and the semiconductor films 112. A gate electrode 114 made of, for example, Al, Mo, Ta, Ti, W etc., is formed at a region corresponding to the channel region 112*c* of the semiconductor film 112 of the gate insulating film 113. A first and second transparent interlayer insulating films 115*a*, 115*b* are formed on the gate electrode 114 and the gate insulating film 113. Further, contact holes 116*a*, 116*b* respectively communicated with the source and drain regions 112*a*, 112*b* of the semiconductor film 112 through the first and second transparent interlayer insulating films 115*a*, 115*b*.

Also, transparent pixel electrodes 117 made of ITO, etc., are patterned in a predetermined shape on the second interlayer insulating film 115*b*, and the pixel electrodes 117 are connected to the source regions 112*a* through the contract hole 116*a*.

Further, power source lines 118 are provided on the first interlayer insulating film 115*a* and connected to the drain regions 112*b* through the contact holes 116*b*.

Similarly, thin film transistors 119 for driving connected to each pixel electrode 117 are formed on the circuit element part 107.

The light-emitting element part 108 is generally configured with a plurality of functional layers 120 respectively laminated on the pixel electrodes 117, and bank parts 121 each formed between the pixel electrode 117 and the functional layer 120 for partitioning the functional layers 120, respectively.

A light-emitting element is constructed with the pixel electrode 117, the functional layer 120 and the cathode 109 provided on the functional layer 120. Furthermore, the pixel electrodes 117 are patterned and formed in a substantially rectangular shape (as seen from a plane), and each bank part 121 is formed between two pixel electrodes 117.

For example, the bank part 121 is constructed with an inorganic bank layer 121*a* (a first bank layer) made of, for example, an inorganic material such as SiO, $SiO_2$ or $TiO_2$, and an organic bank layer 121*b* (a second bank layer) having a trapezoidal cross-section made of a resist having an excellent heat resistance and anti-solvent property such as acryl resin or polyamide resin, and laminated on the inorganic bank layer 121*a*. A part of the bank part 121 is formed in a state to ride on the circumferential edge of the pixel electrode 117.

An opening 122 is formed between two bank parts 121 so as to be gradually enlarged upwardly of the pixel electrodes 117.

The functional layer 120 includes a hole injection/transport layer 120*a* laminated on the pixel electrodes 117 in the opening 122 and a light-emitting layer 120*b* formed on the hole injection/transport layer 120*a*. Moreover, another functional layer may be formed close to the light-emitting layer 120*b* for other functions. For example, it is possible to form an electron transport layer.

The hole injection/transport layer 120*a* has a function of transporting a hole from the pixel electrode 117 and injecting it into the light-emitting layer 120*b*. The hole injection/transport layer 120*a* is formed by discharging the first composition (equivalent to a type of liquid material of the present invention) including the hole injection/transport layer forming material. For example, a mixture of polythiophene derivatives such as polyethylenedioxythiophene, and polystyrenesulfonic acid is used as the hole injection/transport layer forming material.

The light-emitting layers 120*b* emit light in any color of red (R), green (G) or blue (B) and they are formed by discharging a second composition (equivalent to a type of a liquid material of the present invention) including the light-emitting layer forming material (light-emitting material). For the light-emitting layer forming material, paraphenylenevinylene derivative, polyphenylene derivative, polyfluorene derivatives, polyvinylcarbazole, poly-thiophene derivative, perylene group pigment, coumarine group pigment, rhodamine group pigment, etc. can be used, or materials can be used in which rubrene, perylene, 9,10-diphenylanthracene, tetraphenylbutadiene, Nile red, coumarin 6, or quinacridon is added to such high polymer materials.

Furthermore, it is preferable that the solvent of the second composition (non-polar solvent) is insoluble at the hole injection/transport layer 120*a*. For example, cyclohexylbenzen, dihydrobenzofran, trimethylbenzene, tetra methyl benzene, etc. can be used. Such non-polar solvent is used for the second composition of the light-emitting layer 120*b*, so that the light-emitting layer 120*b* can be formed without re-dissolution of the hole injection/transport layer 120*a*.

Furthermore, the light-emitting layer 120*b* is configured such that a hole injected from the hole injection/transport layer 120*a* and an electron injected from the cathode 109 is recombined on the light-emitting layer to thereby emit light.

The cathode 109 is formed to cover the whole surface of the light-emitting element part 108 and it forms a pair along with the pixel electrode 117 to complete a role of flowing current from the pixel electrode 117 to the function layer 120. Further, a sealing member (not shown) is arranged over the cathode 109.

Next, a process for manufacturing a display device 106 will be described with reference to FIGS. 28 to 36 according to the present embodiment.

Figure 28:
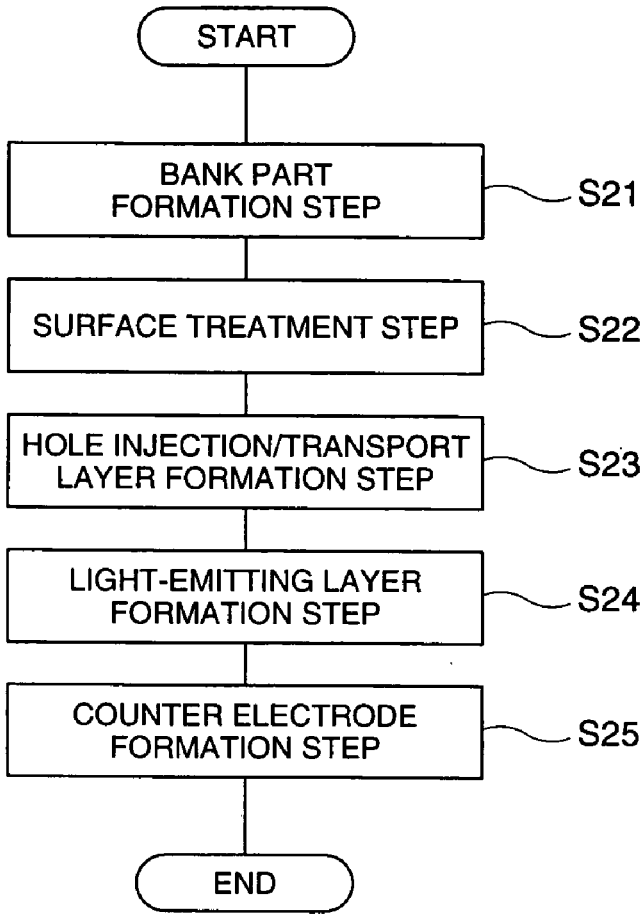
FIG. 28 is a flowchart illustrating a display device manufacturing process according to a second embodiment of the present invention.

The display device 106, as shown in FIG. 28, is manufactured through a bank part formation step (S21), a surface treatment step (S22), a hole injection/transport layer formation step (S23), a light-emitting layer formation step (S24), and a counter electrode formation step (S25). Furthermore, the manufacturing process is not limited to the abovementioned process, but other steps can be omitted or added to the above steps, if necessary.

Figure 29:
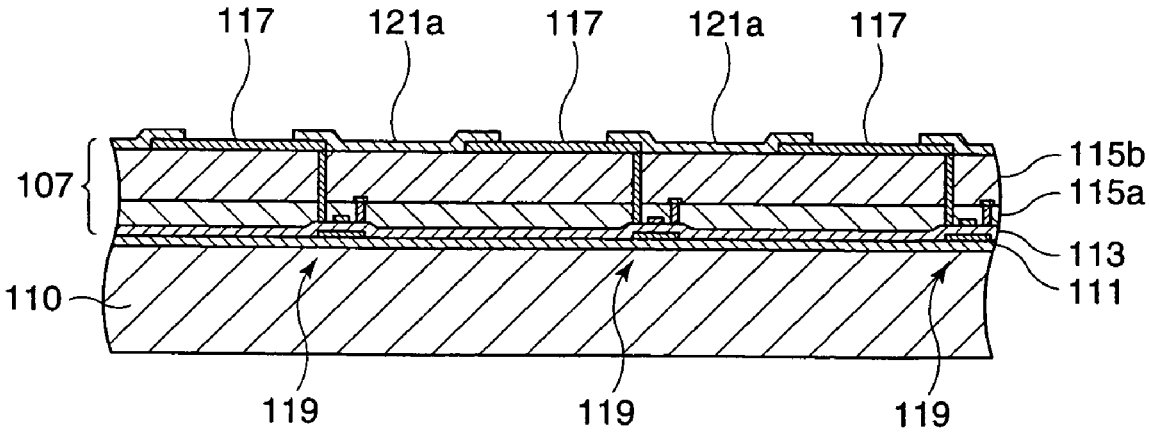
FIG. 29 is a flow diagram illustrating the formation of an inorganic bank layer.

First, in the bank part formation step (S21), as shown in FIG. 29, an inorganic bank layer 121*a* is formed on the second interlayer insulating film 115*b*. An inorganic layer is formed and then patterned through a photolithographic technique, thereby forming each inorganic bank layer 121*a*. A part of the inorganic bank layer 121*a* is formed in such a manner to be superposed on the circumferential edge of the pixel electrode 117.

Figure 30:
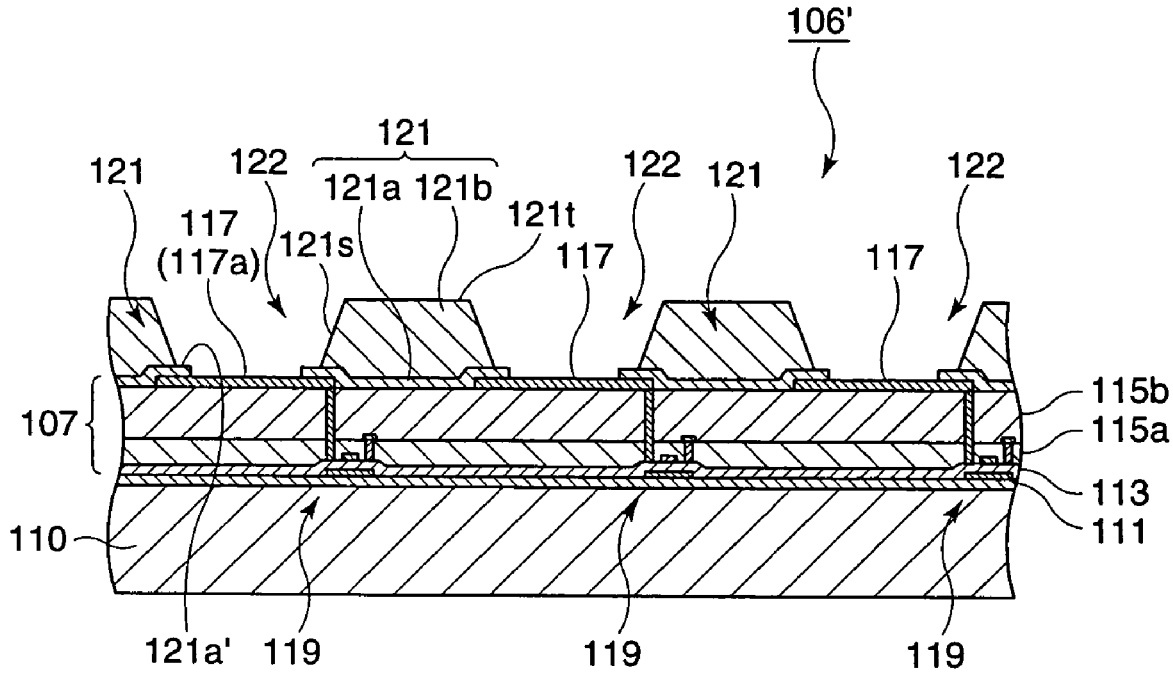
FIG. 30 is a flow diagram illustrating the formation of an organic bank layer.

After the formation of the inorganic bank layer 121*a*, as shown in FIG. 30, an organic bank layer 121*b* is formed on the inorganic bank layer 12*a*. The organic bank layer 121*b* is also patterned and formed through the photolithographic technique similar to the inorganic bank layer 121*a*.

The bank part 121 is formed as described above. An opening 122, which opens upwardly of the pixel electrodes 117, is formed between bank parts 121. The opening 122 defines a pixel region (equivalent to a type of a liquid material region of the present invention).

In the surface treatment step (S22), a lyophilic treatment and lyophobic treatment are carried out. An area for the lyophilic treatment is a first lamination part 121*a* of the inorganic bank layer 121*a* and an electrode surface 117*a* of the pixel electrode 117, to which a surface treatment is performed for lyophilic property by a plasma treatment in which oxygen is used as treatment gas. The plasma treatment also functions to clean ITO, i.e., the pixel electrode 117.

Furthermore, a lyophobic treatment is performed to the wall surface 121*s* of the organic bank layer 121*b* and the top surface 121*t* of the organic bank layer 121*b*. For example, 4 methane fluoride is used as treatment gas for a plasma treatment to make the surfaces fluorinated (lyophobic).

If the surface treatment step is performed to form the functional layer 120 by using the injection 7, the liquid material can be securely applied to the pixel region and the liquid material applied to the pixel region can be prevented from overflowing from the opening 122.

A display device substrate 106' (equivalent to a type of a display substrate of the present invention) can be obtained through the above steps. The display device substrate 106' is placed on the placing base 3 of the display manufacturing apparatus 1 shown in FIG. 1(*a*) to undergo the following hole injection/transport layer formation step (S23) and the light-emitting layer formation step (S24).

In the hole injection/transport layer formation step (S23), the first composition including the hole injection/transport layer forming material is discharged from the injection head 7 to the pixel regions, i.e., the openings 122. Thereafter, the drying and heating treatments are performed to form the hole injection/transport layers 120*a* on the pixel electrodes 117.

Similar to the colored layer formation step, the hole injection/transport layer formation step, as shown in FIG. 21 is performed by undergoing the liquid material discharge step (S11), the hitting (applied) amount detection step (S12), the correction amount acquiring step (S13) and the liquid material supplementation step (S14) in sequence. Furthermore, since a detailed description about the respective steps of S11 to S14 is made in the above first embodiment, the description thereof will be omitted.

Figure 31:
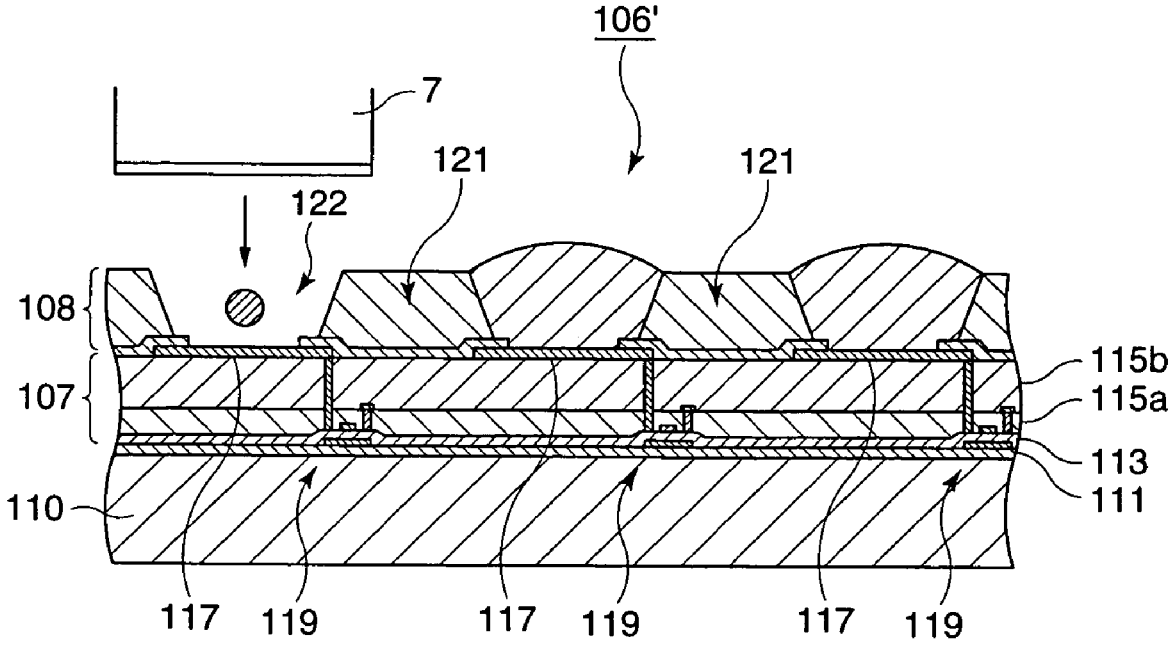
FIG. 31 is a flow diagram illustrating a process of forming a hole injection/transport layer.

As shown in FIG. 31, in the liquid material discharge step (S11), the first composition including the hole injection/transport layer forming material is implanted into the pixel regions (that is, the openings 22) of the display device substrate 106' as a predetermined amount of liquid drops. In this case, since the waveform of driving pulses is also set as described above, the discharge amount or flying speed of a liquid drop can be optimized to apply a predetermined amount of the first composition into the pixel regions.

After the first composition is applied into all the pixel regions, in the hitting amount detection step (S12), the first composition amount (equivalent to a type of liquid material amount of the present invention) applied in the liquid material discharge step is detected at every pixel region by the liquid material sensor 17 as the liquid material amount detecting means. In other words, each pixel region is irradiated with laser light LB, and the light emitted from the pixel regions is received by the laser-light receiving element 19. Thus, the applied amount of the first composition is determined in accordance with the quantity of received light (the intensity of received light). After the amount of the first composition applied to all the pixel regions is detected, the flow proceeds to the following step.

In the correction amount acquisition step (S13), the applied amount of the first composition for each pixel region detected in the hitting amount detection step is compared with the target amount (a type of target liquid material amount in the present invention) of the first composition to the corresponding pixel region, thereby acquiring the difference therebetween as the correction amount.

In the liquid material supplementation step (S14), the injection head 7 is positioned on a pixel region, i.e., the opening 122, where the applied amount of the first composition is less than its target amount, to supply the waveform of driving pulses according to the shortage to the piezoelectric vibrators 21, thereby supplementing the first composition to the pixel region. Furthermore, when the first composition is completely supplemented to all the pixel regions to be supplemented, this step is completed.

Figure 32:
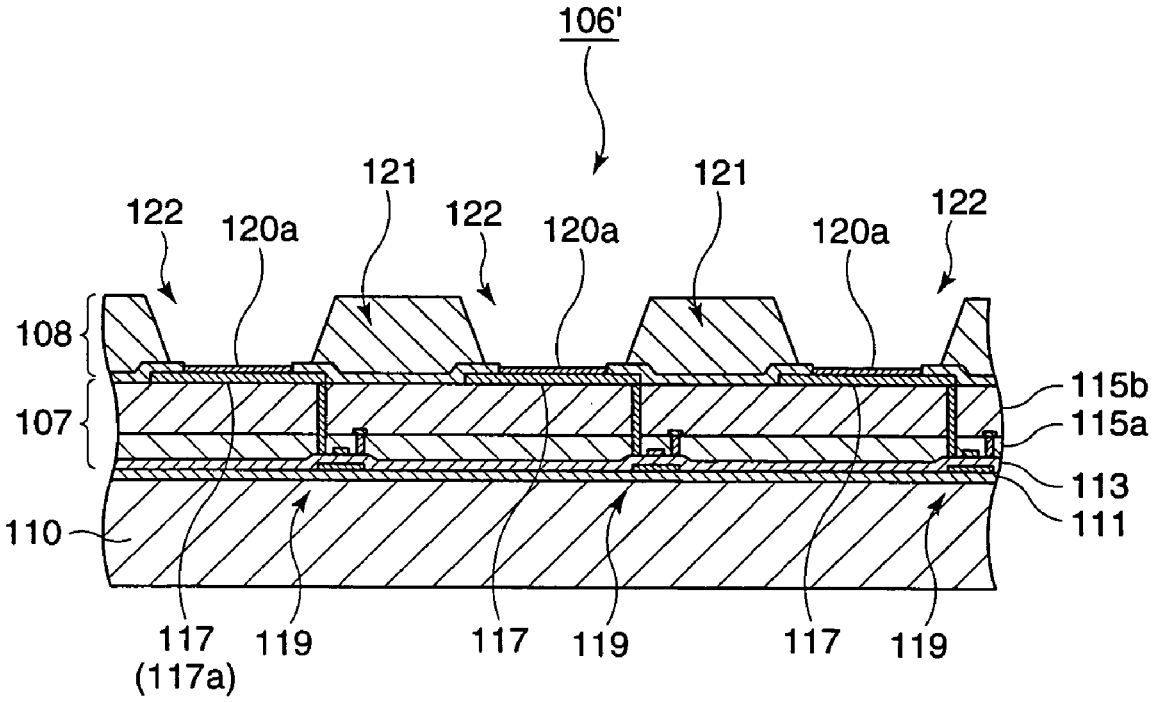
FIG. 32 is a flow diagram illustrating a formed state of a hole injection/transport layer.

Then, a drying step is performed to dry the first composition after discharge and vaporize the polar solvent contained in the first composition. As shown in FIG. 32, the hole injection/transport layers 120*a* are formed on the electrode surfaces 117*a* of the pixel electrodes 117.

As described above, the hole injection/transport layer 120*a* is formed at every pixel region, thereby completing the hole injection/transport layer formation step.

Next, a description will be made of the light-emitting layer formation step (S24). As described above, in the light-emitting layer formation step (S24), in order to prevent re-dissolution of the hole injection/transport layers 120*a*, a non-polar solvent insoluble to the hole injection/transport layers 120*a* is used as the solvent of the second composition which will be used for the formation of the light-emitting layers.

However, since the hole injection/transport layers 120*a* have a lower affinity to the non-polar solvent, the hole injection/transport layers 120*a* may not be brought into close contact with the light-emitting layers 120*b*, respectively, and the light-emitting layers 120*b* may not be uniformly coated even after the second composition containing the non-polar solvent is discharged onto the hole injection/transport layers 120*a*.

Therefore, in order to improve the affinity of the surfaces of the hole injection/transport layers 120*a* to the non-polar solvent and the light-emitting layer forming material, it is preferable that a surface treatment is performed before the formation of the light-emitting layers. The surface treatment is to coat the hole injection/transport layers 120*a* with a surface improving material, which is a solvent identical or similar to the non-polar solvent of the second composition used for the formation of the light-emitting layers and dry it.

Such treatment develops an affinity of the surface of the hole injection/transport layer 120*a* to the non-polar solvent, so that the second composition containing the light-emitting layer forming material can be uniformly coated in the following steps.

Then, the light-emitting layers 120*b* are formed in the light-emitting layer formation step by undergoing the liquid material discharge step (S 11), the hitting amount detection step (S12), the correction amount acquiring step (S13) and the liquid material supplementation step (S14), which are shown in FIG. 21.

Figure 33:
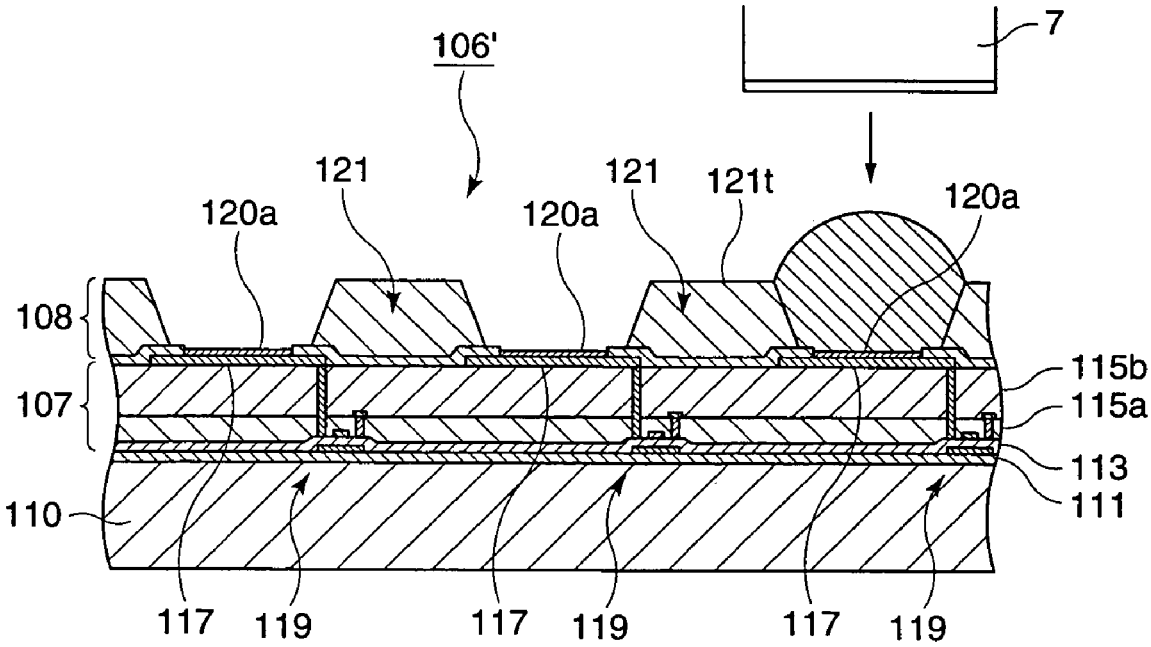
FIG. 33 is a flow diagram illustrating a process of forming a light-emitting layer of blue color.

In the liquid material discharge step (S11), the second composition containing the light-emitting layer forming material corresponding to any of colors (blue (B) in the embodiment of FIG. 33) is implanted into the pixel regions (i.e., openings 22) as a predetermined amount of liquid drops as shown in FIG. 33. At this time, as described above, the waveform of driving pulses is set to optimize the discharge amount or flying speed of a liquid drop and to apply a predetermined amount of the second composition to the hole injection/transport layers 120*a*.

The second composition implanted into the pixel region is spread on the hole injection/transport layers 120*a* to fill up the openings 122. Furthermore, if the second composition is applied to the surface 121*t* of the bank part 121 apart from the pixel region, the surface 12*t* subjected to a lyophobic treatment, as described above, makes the second composition easily roll into the openings 122.

If the second composition is applied into the corresponding pixel region, the second composition applied in the liquid material discharge step is detected by the liquid material sensor 17 as liquid material amount detecting means at each pixel region in the hitting amount detection step (S12). In other words, each pixel region is irradiated with laser light Lb to and the light emitted from the pixel regions is received by the laser-light receiving element 19. Thus, the amount of the second composition applied to all the pixel regions is determined according to the quantity of received light (the intensity of received light). After the amount of the first composition applied to all the pixel regions is detected, the flow proceeds to the following step.

In the correction amount acquisition step (S13), the applied amount of the second composition for each pixel region detected in the hitting amount detection step is compared with the target amount of the second composition to the pixel region, thereby acquiring the difference therebetween as the correction amount.

In the liquid material supplementation step (S14), the injection head 7 is positioned on a pixel region, i.e., the opening 122, where the applied amount of the second composition is less than its target amount, to supply the waveform of driving pulses according to the shortage to the piezoelectric vibrators 21, thereby supplementing the second composition to the pixel region. Furthermore, when the second composition is completely supplemented to all the pixel regions to be supplemented, this step is completed.

Figure 34:
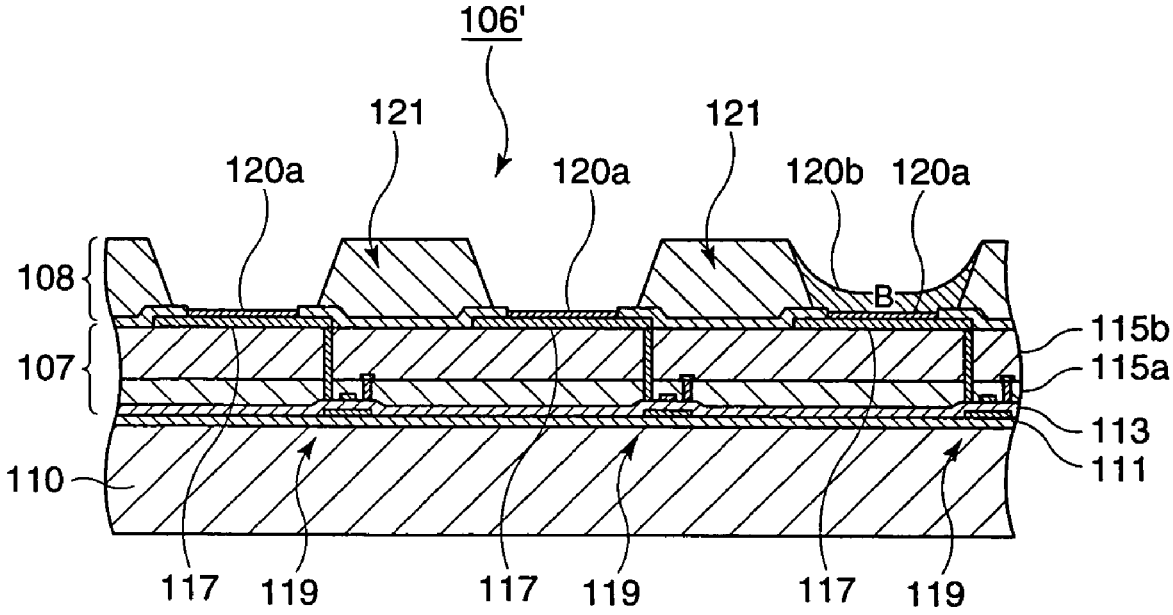
FIG. 34 is a flow diagram illustrating a formed state of a light-emitting layer of blue color.

Thereafter, a drying step is performed to dry the second composition after discharge and vaporize the non-polar solvent contained in the second composition. As shown in FIG. 34, the light-emitting layer 120*b* is formed on the hole injection/transport layers 120*a*. In this case, the light-emitting layer 120*b* corresponding to blue (B) is formed in the drawing.

Figure 35:
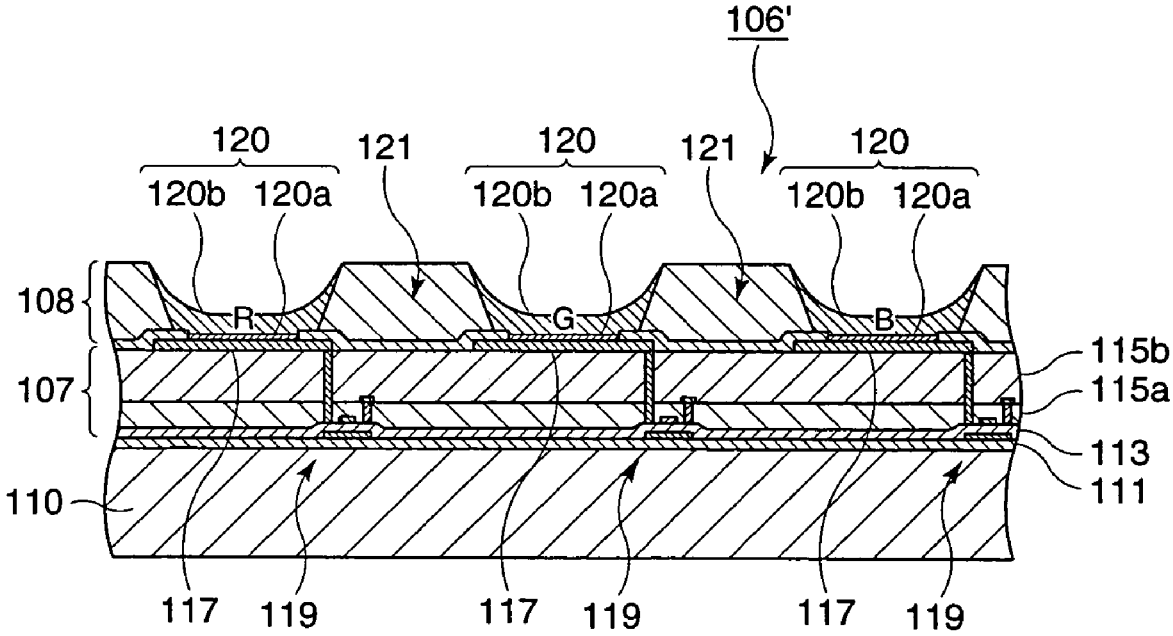
FIG. 35 is a flow diagram illustrating a formed state of a light-emitting layer of an individual color.

As shown in FIG. 35, light-emitting layers 120*bs* are formed to correspond to other colors (red (R) and green (G)) by sequentially performing steps similar to those for the formation of the light-emitting layer 120*b* corresponding to blue (B) described above. The sequence of forming the light-emitting layer 120*b* is not limited to the illustrated one, any other sequential step may be performed to form the light-emitting layer. For example, the sequential steps may be different according to the light-emitting layer forming material.

If the light-emitting layer 120*b* is formed at each pixel region, the light-emitting layer formation step is completed.

As described above, the function layers 120, i.e., the hole injection/transport layers 120*a* and the light-emitting layers 120*b* are formed on the pixel electrodes 117. Then, the flow proceeds to a counter electrode formation step (S25).

Figure 36:
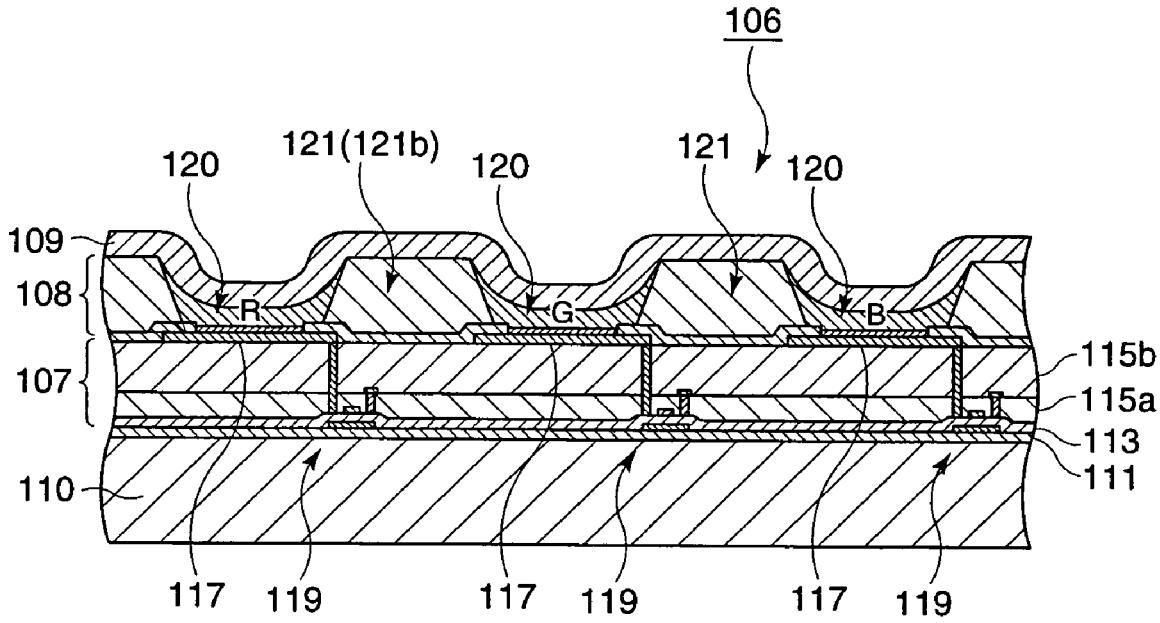
FIG. 36 is a flow diagram illustrating the formation of a cathode.

In the counter electrode formation step (S25), as shown in FIG. 36, a cathode 109 (counter electrode) is formed on all the surfaces of the light-emitting layers 120*b* and the organic bank layers 121*b* by a vapor deposition method, a sputtering method or a CVD method. The cathode 109 is constructed by the lamination of calcium and aluminum layers, for example, in the present embodiment.

On the top of the cathode layer 109, an A1 film, an Ag layer or a protective layer of $Sio_2$, SiN, etc., for anti-oxidation is appropriately provided.

After the cathode 109 is formed as described above, a display device 106 is obtained by other treatments such as a sealing or wiring treatment in which the top of the cathode 109 is sealed with a sealing member.

Figure 37:
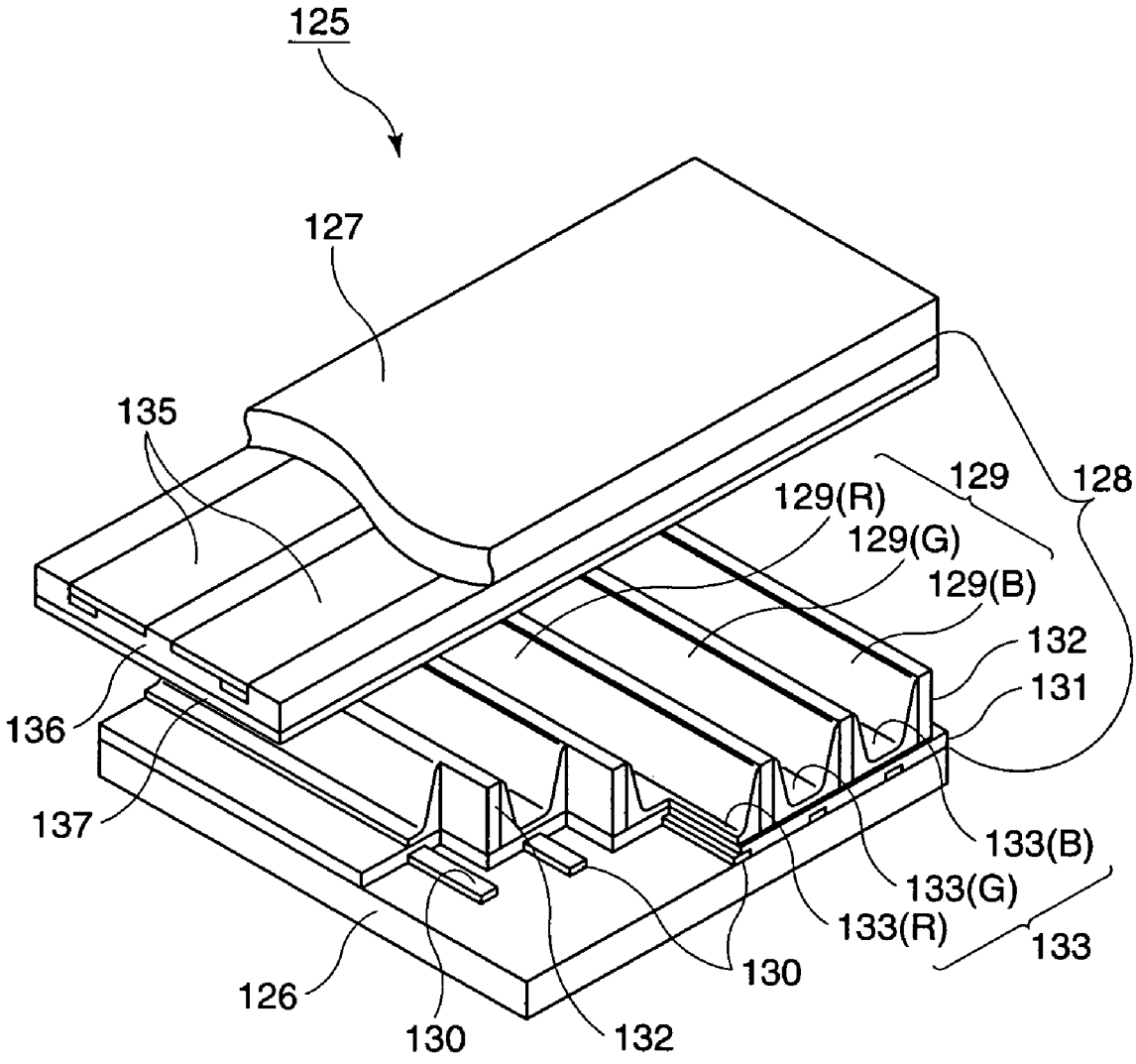
FIG. 37 is a partially exploded perspective view illustrating parts of a display device according to a third embodiment of the present invention.

Next, a third embodiment of the present invention will be described. FIG. 37 is an exploded, perspective view of parts illustrating a plasma type display device (hereinafter, simply referred to as a display device 125), a type of a display in the present invention. Furthermore, the display device 125 is shown in the drawing with a part thereof being cut away.

The display device 125 is generally configured with first and second substrates 126, 127 arranged to face each other and an electric discharge display part 128 to be formed between the two substrates. The electric discharge display part 128 is configured with a plurality of electric discharge chambers 129. Among the plurality of electric discharge chambers 129, three electric discharge chambers 129 of a red electric discharge chamber (129R), a green electric discharge chamber (129G) and a blue electric discharge chamber (129B) are taken into a group to be configured into one pixel.

Address electrodes 130 are formed at a predetermined interval in a stripe shape on the top surface of the first substrate 126. A dielectric layer 131 is formed to cover the top surfaces of the address electrodes 130 and the first substrate 126. On the dielectric layer 131, partition walls 132 are erected such that they are respectively positioned between the address electrodes 130 and extend along the respective address electrodes 130. The partition wall 132, as shown in the drawing, includes one extended to both sides of the width of the address electrodes 130 and the other one extended perpendicular to the address electrodes 130. Furthermore, regions partitioned by the partition wall 132 become discharge chambers 129.

A fluorescent body 133 is arranged in the discharge chamber 129. The fluorescent body 133 emits fluorescence of any one of red (R), green (G) and blue (B) colors, thereby making an arrangement of a red fluorescent body 133(R) at the bottom of the red discharge chamber 129(R), a green fluorescent body 133(G) at the bottom of the green discharge chamber 129(G) and a blue fluorescent body 133(B) at the bottom of the blue discharge chamber 129(B).

At the lower surface of the second substrate 127 in the drawing, a plurality of display electrodes 135 are formed in a stripe shape at a predetermined interval in the direction perpendicular to the address electrodes 130. Also, a dielectric layer 136 and a protective film 137 made of MgO, etc., are bonded to cover the display electrodes 135.

The first and second substrates 126, 127 are combined to face the address electrodes 130 and the display electrodes 135 in the perpendicular arrangement. Moreover, the address electrodes 130 and the display electrodes 135 are connected to an alternating current power source not shown.

Also, the application of electric current to the respective electrodes 130, 135 causes the florescent bodies 133 to be excited to emit light in the electric discharge display part 128, thereby allowing a color display.

In the present embodiment, the address electrodes 130, display electrodes 135, and fluorescent bodies 133 can be manufactured on the basis of the manufacturing method shown in FIG. 21, which is used for a manufacturing apparatus 1 shown in FIG. 1(*a*). Hereinafter, a description will be made of a process for forming the address electrodes 130 of the first substrate 126.

At this time, the first substrate 126 is equivalent to a type of a display substrate in the present invention. The following steps will be performed with the first substrate 126 positioned on the placing base 3.

First, in the liquid material discharge step (S11), a liquid material containing a conductive film wiring forming material (equivalent to a type of liquid material of the present invention) is applied as the liquid drops to an address electrode forming region (equivalent to a type of a liquid material region of the present invention). The liquid material is a conductive film wiring forming material, being made by dispersing a conductive fine particle such as a metal in a dispersion medium. Metallic fine particles containing gold, silver, copper palladium or nickel or conductive polymer is used for the conductive fine particles.

In this case, a waveform of driving pulses is also set as described above, so that the discharge amount and flying speed of the liquid drop can be optimized to apply a predetermined amount of liquid material to the address electrode forming regions.

If the liquid material is applied to the address electrode forming regions of the first substrate 126, the amount of liquid material (a type of liquid material amount in the present invention) applied in the liquid material discharge step is detected at each address electrode forming region by the liquid material sensor 17 as the liquid material amount detecting means in the hitting amount detection step (S12). In other words, each address electrode forming region is irradiated with laser light Lb and the light irradiated from the address electrode forming region is received by the laser-light receiving element 19. Thus, the applied amount (hitting liquid material amount) of the liquid material is determined according to the quantity of received light (the intensity of received light). After the applied amount of the liquid material is detected, the flow proceeds to the following step.

In the correction amount acquisition step (S13), the applied amount of the liquid material for each address electrode forming region detected in the hitting amount detection step is compared with the target amount (a type of target liquid material amount in the present invention) of liquid material to the address electrode forming regions, thereby acquiring the difference therebetween as the correction amount.

In the liquid material supplementation step (S14), the injection head 7 is positioned at an address electrode forming region where the applied amount of liquid material is less than its target amount, to supply the waveform of driving pulses according to the shortage to the piezoelectric vibrators 21, thereby supplementing the liquid material to the address electrode forming region. Furthermore, when the liquid material is completely supplemented to all the address electrode forming regions to be supplemented, this step is completed.

Then, a drying step is performed to dry the liquid material after discharge and to vaporize the dispersion medium contained in the liquid material, thereby forming the address electrode 130.

However, although the formation of the address electrodes 130 is illustrated in the above description, the display electrodes 135 and the fluorescent bodies 133 can also be formed by undergoing the above steps.

In the case of the display electrodes 135, similar to the case of the address electrodes 130, the liquid material containing conductive film wiring forming material (equivalent to a type of liquid material in the present invention) is applied to the display electrode forming regions (equivalent to a type of the liquid material region in the present invention) as liquid drops.

In the case of the formation of the fluorescent bodies 133, liquid material containing a fluorescent material corresponding to each of the colors (R, G and B) is discharged by the injection head 7 as liquid drops, and applied into the electric discharge chamber 129 (equivalent to a type of the liquid material region in the present invention) of the corresponding color.

As described above, in the manufacturing apparatus 1, the applied amount of liquid material is detected at each liquid material region, and the waveform of driving pulses is set according to the shortage of liquid material obtained from a difference between the applied amount and the target amount of liquid material. Then, the set driving pulses are supplied to the piezoelectric vibrators 21, so that the shortage of liquid material is applied to the liquid material region. As a result, it is possible to supplement the optimum amount of liquid material to each liquid material region without using the exclusive nozzles or injection head 7.

Further, the flying speed of liquid drops can be controlled in addition to the amount of liquid drops, so as to realize a precise control of the hitting (application) position. In other words, liquid drops can be precisely implanted into a desired liquid material region by scanning the injection head 7. This allows the period of manufacturing time to be shortened.

Furthermore, in the manufacturing apparatus 1, it is possible to greatly change the single amount and flying speed of one drop of liquid material, so that a variety of displays can be manufactured with different sizes of one liquid material region. In other words, if the size of the liquid material region is different, the amount of liquid material to be needed is different. In the manufacturing apparatus 1, it is possible to control the discharge amount of liquid drops by the type or supply number of driving pulses. If a change is made in the waveform shape of driving pulses, a change can be made in the amount or flying speed of the one drop of liquid material with extremely high precision. Accordingly, it is possible to utilize the manufacturing apparatus 1 as a general purpose manufacturing apparatus, which makes it possible to manufacture a plurality of different types of displays by the same injection head 7 without using the exclusive nozzles or injection head.

Furthermore, the scope of the present invention is not limited to the preferred embodiments described above, a variety of changes can be made on the basis of the following claims.

First, the liquid material amount detecting means of the present invention is not limited to the reflective liquid material sensor 17 described in the above embodiments.

For example, the liquid material amount detecting means may be constructed with a transmissive liquid material sensor 17'. In this transmissive liquid material sensor 17' laser light Lb is irradiated from one surface of the display substrate, and the intensity (the quantity of light) of the laser light Lb transmitted through the other surface of the display substrate opposite to the irradiated side is detected by the laser-light receiving element 19. Similar to the above embodiments, the amount of applied liquid material can be detected at each pixel region 12*a* even in this configuration.

Figure 38:
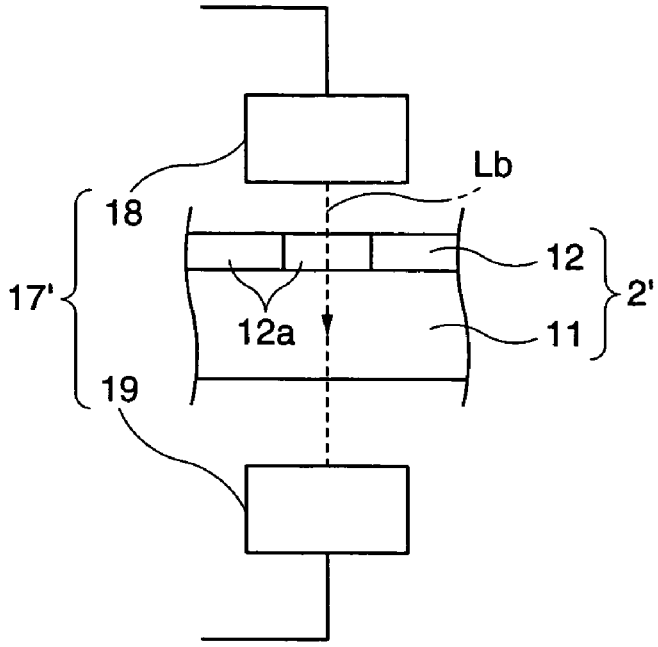
FIG. 38 is a mimetic diagram illustrating an example of liquid material amount detecting means configured by a transmissive liquid material sensor.

In the above configuration, as shown in FIG. 38, the laser-light emitting element 18 and the laser-light receiving element 19 may be arranged to sandwich the display substrate (filter substrate 2' in FIG. 38) therebetween so as to simultaneously scan the laser-light emitting element 18 and the laser-light receiving element 19. Further, it may be configured that the laser light Lb is appropriately reflected by a prism, etc., the laser light Lb emitted from the laser-light emitting element 18 may irradiate the pixel region 12*a*, and the laser light Lb transmitted through the pixel region 12*a* may be guided (entered) into the laser-light receiving element 19.

Figure 39:
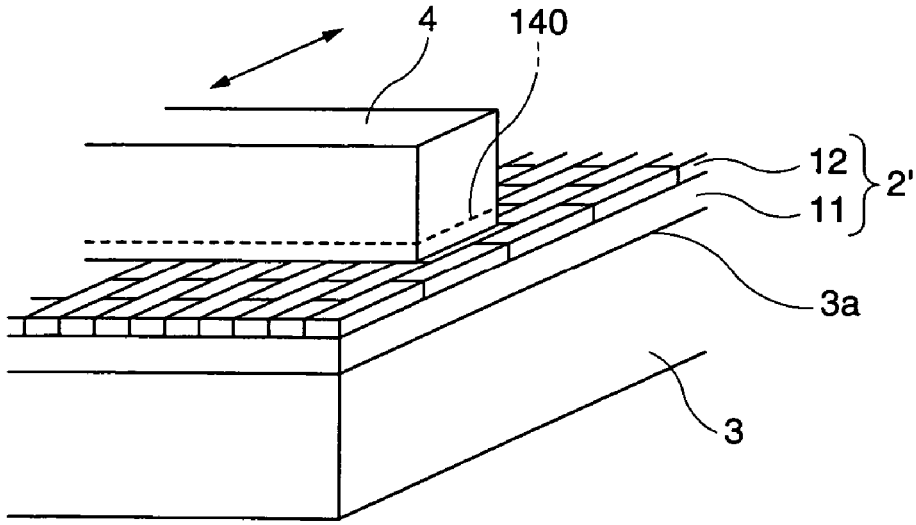
FIG. 39 is a mimetic diagram illustrating an example of liquid material amount detecting means configured by a CCD array.

Also, as shown in FIG. 39, the liquid material amount detecting means may be constructed with a CCD array 140. In this configuration, the placing surface 3*a* of the placing base 3 is constructed with, for example, a surface light-emitting body to emit light with the uniform quantity of light. Also, the CCD array 140 is provided at the surface of the guide bar 4 facing the placing base 3, and the amount of ink applied is detected by receiving the light transmitted through the pixel regions 12*a*. Furthermore, in this configuration, it is preferable that the resolution of the CCD array 140 is higher (finer) than the size of the pixel regions 12*a* from a viewpoint of the improvement of detection precision.

In the above configuration, since the amount of applied liquid material can be detected by a plurality of liquid material regions (in this case, pixel region 12*a*), it is possible to shorten a period of time for detection and to improve the working efficiency.

Further, the liquid material to be discharged as liquid drops is not limited to that with transmissivity. In this case, the amount of applied liquid material can be measured by detecting the surface height of liquid material. Therefore, a liquid surface detecting sensor may be constructed to detect the height of the liquid surface of the injected ink liquid as liquid material amount detecting means.

Further, although there has been illustrated a case in which liquid material is discharged to a narrow range of a liquid material region (for example, a pixel region 12*a*), the present invention is also applicable to a case in which liquid material is discharged to a large range of liquid material region (coating of the whole surface of a substrate), for example, as in the case of forming the protective film 77 shown in FIG. 20.

Further, although the above third embodiment illustrates the construction in which the electrodes 130, 135 are formed in the plasma type display device, the present invention is not limited to such construction, but it is also applicable to the metal wiring of the electrodes of other circuit substrates.

Further, the electromechanical conversion element is not limited to the piezoelectric vibrators 21, but it may be constructed with magnetostrictive element or electrostatic actuator.

What is claimed is:

1. A display manufacturing apparatus for applying liquid material including color components discharged out of nozzle openings to liquid material regions on a surface of a display substrate comprising:

pressure chambers communicating with the nozzle openings and capable of reserving liquid material;

electromechanical conversion elements capable of changing a volume of the pressure chambers;

an injection head capable of discharging the liquid material in the pressure chambers out of the nozzle openings in a liquid drop state upon a supply of driving pulses to the electromechanical conversion elements;

driving pulse generating means capable of generating the driving pulses;

liquid material amount detecting means capable of detecting an applied amount of liquid material at each liquid material region;

short amount acquiring means for acquiring a short amount of liquid material at the liquid material region from a difference between the applied amount of liquid material detected by the liquid material detecting means and a target amount of liquid material;

excess amount acquiring means for acquiring an excess amount of liquid material from a difference between the applied amount of liquid material detected by the liquid material amount detecting means and the target amount of liquid material at the liquid material regions;

color component decomposing means for decomposing a color component of the liquid material, the color component decomposing means comprising an excimer laser light source; and pulse shape setting means for setting a shape of the driving pulses to be generated by the driving pulse generating means;

wherein the pulse shape setting means sets a waveform including waveform components of the driving pulses according to the short amount of liquid material acquired by the short amount acquiring means, the waveform components including an expansion component, an expansion hold component, a discharge component, a discharge hold component, a contraction damping component, a damping hold component and an expansion damping component;

wherein the short amount of liquid material is supplementally applied to liquid material regions by generating the driving pulses from the driving pulse generating means and supplying the driving pulses to the electromechanical conversion elements; and wherein the color component decomposing means is operated according to the excess amount of liquid material to decompose an excess amount of color component.

2. The display manufacturing apparatus according to claim 1, wherein the liquid amount detecting means is constructed with a light-emitting element and a light-receiving element capable of outputting electrical signals corresponding to an intensity of received light;

wherein the liquid material region is irradiated with light from the light-emitting element, and light from the liquid material region is received at the light-receiving element so as to detect the applied amount of liquid material at the liquid material region according to the intensity of the received light.

3. The display manufacturing apparatus according to claim 1, the driving pulses further comprising first driving pulses wherein:

the expansion component expands a normal volume of the pressure chambers at a speed that will not allow for the discharge of liquid material;

the expansion hold component holds the expanded pressure chambers; and the discharge component discharges the liquid material by abruptly contracting the pressure chambers held at an expanded state; and wherein the pulse shape setting means sets a driving voltage from a maximum voltage to a minimum voltage in the first driving pulses.

4. The display manufacturing apparatus according to claim 1, the driving pulses further comprising first driving pulses wherein:

the expansion component expands a normal volume of the pressure chambers at a speed that will not allow for the discharge of liquid material;

the expansion hold component holds the expanded pressure chambers; and the discharge component discharges the liquid material by abruptly contracting the pressure chambers held at an expanded state; and wherein the pulse shape setting means sets an intermediate potential corresponding to the normal volume of the pressure chambers.

5. The display manufacturing apparatus according to claim 1, the driving pulses further comprising first driving pulses wherein:

the expansion component expands a normal volume of the pressure chambers at a speed that will not allow for the discharge of liquid material;

the expansion hold component holds the expanded pressure chambers; and the discharge component discharges the liquid material by abruptly contracting the pressure chambers held at an expanded state;

wherein the pulse shape setting means sets a duration of the expansion component.

6. The display manufacturing apparatus according to claim 1, the driving pulses further comprising first driving pulses wherein:

the expansion component expands a normal volume of the pressure chambers at a speed that will not allow for the discharge of liquid material;

the expansion hold component holds the expanded pressure chambers; and the discharge component discharges the liquid material by abruptly contracting the pressure chambers held at an expanded state;

wherein the pulse shape setting means sets a duration of the expansion hold component.

7. The display manufacturing apparatus according to claim 1, the driving pulses further comprising second driving pulses wherein:

the second expansion component abruptly expands a normal volume of the pressure chambers so as to draw in a meniscus to a side of the pressure chambers; and the second discharge component discharges a central part of the meniscus drawn in by the second expansion component in a liquid drop state by contracting the pressure chambers;

wherein the pulse shape setting means sets a driving voltage from a maximum voltage to a minimum voltage in the second driving pulses.

8. The display manufacturing apparatus according to claim 1, the driving pulses further comprising second driving pulses wherein:

the second expansion component abruptly expands a normal volume of the pressure chambers so as to draw in a meniscus to a side of the pressure chambers; and the second discharge component discharges a central part of the meniscus drawn in by the second expansion component in a liquid drop state by contracting the pressure chambers;

wherein the pulse shape setting means sets an intermediate potential corresponding to the normal volume of the pressure chambers.

9. The display manufacturing apparatus according to claim 1, the driving pulses further comprising second driving pulses wherein:

the second expansion component abruptly expands a normal volume of the pressure chambers so as to draw in a meniscus to a side of the pressure chambers; and the second discharge component discharges a central part of the meniscus drawn in by the second expansion component in a liquid drop state by contracting the pressure chambers;

wherein the pulse shape setting means sets a termination potential of the second discharge component.

10. The display manufacturing apparatus according to claim 1, wherein the driving pulse generating means is constructed to be capable of generating a plurality of driving pulses within a unit period to adjust a discharge amount of liquid material by varying a supply number of driving pulses to the pressure generating element at the unit period.

11. The display manufacturing apparatus according to claim 1, wherein the liquid material is liquid state material including light emitting material.

12. The display manufacturing apparatus according to claim 1, wherein the liquid material is liquid state material including hole injection/transport layer forming material.

13. The display manufacturing apparatus according to claim 1, wherein the liquid material is liquid state material including conductive fine particles.

14. The display manufacturing apparatus according to claim 1, wherein the electromechanical conversion elements further comprise piezoelectric vibrators.

15. A display manufacturing apparatus for applying liquid material including coloring components discharged out of nozzle openings to liquid material regions on a surface of a display substrate comprising:

pressure chambers communicating with the nozzle openings and capable of reserving liquid material;

electromechanical conversion elements capable of changing a volume of the pressure chambers;

an injection head capable of discharging the liquid material in the pressure chambers out of the nozzle openings in a liquid drop state upon a supply of driving pulses to the electromechanical conversion elements;

liquid material amount detecting means capable of detecting an applied amount of liquid material at each liquid material region;

excess amount acquiring means for acquiring an excess amount of liquid material from a difference between the applied amount of liquid material detected by the liquid material amount detecting means and a target amount of liquid material at the liquid material regions; and coloring component decomposing means for decomposing a coloring component of the liquid material, wherein the coloring component decomposing means is operated according to the excess amount of liquid material to decompose an excess amount of coloring component.

16. The display manufacturing apparatus according to claim 15, wherein the coloring component decomposing means further comprises an excimer laser light source.

* * * * *